US006021095A

United States Patent [19]

Tubel et al.

[11] Patent Number: 6,021,095

[45] **Date of Patent: *Feb. 1, 2000**

[54] METHOD AND APPARATUS FOR REMOTE CONTROL OF WELLBORE END DEVICES

[75] Inventors: Paulo S. Tubel, The Woodlands; David Eugene Rothers, Houston; Michael Wayne Holcombe, Katy; Albert A. Mullins, II, Humble, all of Tex.; Mark McCorry, Aberdeen, United Kingdom

[73] Assignee: Baker Hughes Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,176

[22] Filed: Jun. 26, 1997

Related U.S. Application Data

[63] Continuation of application No. 08/386,565, Feb. 10, 1995, abandoned, which is a continuation-in-part of application No. 08/071,422, Jun. 3, 1993, Pat. No. 5,579,283, which is a continuation-in-part of application No. 07/751,861, which is a continuation-in-part of application No. 07/873,654, Apr. 23, 1992, Pat. No. 5,226,494, which is a continuation of application No. 07/784,666, Oct. 24, 1991, abandoned, which is a continuation of application No. 07/549,803, Jul. 9, 1990, abandoned, and a continuation-in-part of application No. 07/831,202, Jan. 31, 1992, Pat. No. 5,343,963, which is a continuation-in-part of application No. 07/751,861, Aug. 28, 1992, abandoned, which is a continuation-in-part of application No. 07/873,654, which is a continuation of application No. 07/784,666, which is a continuation of application No. 07/549,803.

[51] Int. Cl.[7] ..... E21B 43/00; E21B 34/16; E21B 49/08

[52] U.S. Cl. ..... 367/82; 367/911; 340/855.6; 166/166

[58] Field of Search ..... 367/82, 911; 340/855.6, 340/856.4; 166/66

[56] References Cited

U.S. PATENT DOCUMENTS

| | | | |
|---|---|---|---|
| 4,038,632 | 7/1977 | Parker | 367/911 |
| 4,073,341 | 2/1978 | Parker | 166/65 |
| 4,896,722 | 1/1990 | Upchurch | 166/250 |
| 5,166,908 | 11/1992 | Montgomery | 367/82 |
| 5,319,610 | 6/1994 | Airhart | 367/82 |
| 5,458,200 | 10/1995 | Lagerlef et al. | 166/372 |

*Primary Examiner*—Nelson Moskowitz
*Attorney, Agent, or Firm*—Melvin A. Hunn

[57] ABSTRACT

A wellbore remote control system is disclosed which includes (1) a transmission apparatus for generating at least one acoustic transmission having a particular transmission frequency, (2) a reception apparatus which includes an electronic circuit (preferably digital) which detects and identifies the acoustic transmissions, and which provides an actuation signal to an electrically-actuated wellbore tool if a match is detected.

20 Claims, 43 Drawing Sheets

PRESSURE CHANGE DETECTION CIRCUIT

PRESSURE CHANGE DETECTION CIRCUIT

TERMINAL MAGNETIC COMMUNICATION INTERFACE

MAGNETIC COMMUNICATION CIRCUIT

MAGNETIC COMMUNICATION CIRCUIT

POWER-UP CIRCUIT FOR
PRESSURE CHANGE DETECTION CIRCUIT

POWER-UP CIRCUIT FOR MICROPROCESSOR

METHOD AND APPARATUS FOR REMOTE CONTROL OF WELLBORE END DEVICES

CROSS-REFERENCE TO RELATED APPLICATIONS

This is a continuation, of application Ser. No. 08/386,565, filed Feb. 10, 1995, now abandoned.

The present application is a continuation-in-part of:

A. U.S. patent application Ser. No. 08/071,422, filed Jun. 3, 1993, and now U.S. Pat. No. 5,579,283, entitled "Method And Apparatus For Communicating Coded Messages In A Wellbore", further identified by Attorney Docket No. 284-6355-US, which is a continuation-in-part of:

1. U.S. patent application Ser. No. 07/751,861, filed Aug. 28, 1991, and now abandoned, entitled "Subsurface Well Apparatus", further identified by Attorney Docket No. 284-3648-CIP, which is a continuation-in-part of:

(a) U.S. patent application Ser. No. 07/873,654, filed Apr. 23, 1992, entitled "Subsurface Well Apparatus", which issued on Jul. 13, 1993 as U.S. Pat. No. 5,226,494, further identified by Attorney Docket No. 284-3648-C2, which was a continuation under 37 C.F.R. §1.62 of:

(b) U.S. patent application Ser. No. 07/784,666, filed Oct. 24, 1991, entitled "Subsurface Well Apparatus", further identified by Attorney Docket No. 284-3648-C, now abandoned, which was a continuation under 37 C.F.R. §1.62 of:

(c) U.S. patent application Ser. No. 07/549,803, filed Jul. 9, 1990, now abandoned, entitled "Subsurface Well Apparatus", further identified by Attorney Docket No. 284-3648-US; and 2. U.S. patent application Ser. No. 07/831,202, filed Jan. 31, 1992, entitled "Subsurface Well Apparatus", further identified by Attorney Docket No. 284-5401-US, which issued on Sep. 6, 1994 as U.S. Pat. No. 5,343,963, which is a continuation-in-part of:

(a) U.S. patent application Ser. No. 07/751,861, filed Aug. 28, 1991, now abandoned, entitled "Subsurface Well Apparatus", further identified by Attorney Docket No. 284-3648-CIP, which is a continuation-in-part of:

(i) U.S. patent application Ser. No. 07/873,654, filed Apr. 23, 1992, entitled "Subsurface Well Apparatus", which issued on Jul. 13, 1993 as U.S. Pat. No. 5,226,494, further identified by Attorney Docket No. 284-3648-C2, which was a continuation under 37 C.F.R. §1.62 of:

(ii) U.S. patent application Ser. No. 07/784,666, filed Oct. 24, 1991, entitled "Subsurface Well Apparatus", further identified by Attorney Docket No. 284-3648-C, now abandoned, which was a continuation under 37 C.F.R. §1.62 of:

(iii) U.S. patent application Ser. No. 07/549,803, filed Jul. 9, 1990, now abandoned, entitled "Subsurface Well Apparatus", further identified by Attorney Docket No. 284-3648-US.

Each of these applications is hereby incorporated herein fully by reference.

BACKGROUND OF THE INVENTION

1. Field of the Invention

The present invention relates in general to data transmission systems, and in particular to data transmission systems which may be utilized in wellbores to communicate remote control signals through fluid columns disposed therein.

2. Description of the Prior Art

In the oil and gas industry, it has been one longstanding objective to develop data transmission systems which do not require the utilization of electrical conductors to carry control signals between wellbore locations which are separated by great distances. Experience has revealed that data transmission systems which require the utilization of electrical conductors extending between communication nodes in a wellbore are advantageous when data must be communicated within the wellbore at extremely fast transmission rates, or when large blocks of data need to be transferred between communication nodes; however, the utilization of electrical conductors has several serious disadvantages including: (1) since most wellbores include regions which are exposed to corrosive fluids and high temperatures, a long service life cannot be expected from a data transmission system which utilizes electrical conductors; (2) since most wellbores extend for substantial distances, data transmission systems which utilize electrical conductors are not generally considered to be cost effective, particularly when such systems are utilized only infrequently, or in a limited manner; (3) since all wellbores define fairly tight operating clearances, utilization of a wireline conductor to transmit data may reduce or diminish the operating clearance through which other wellbore operations are performed; and (4) since wellbores typically utilize a plurality of threaded tubular members to make up tubular strings, utilization of an electrical conductor to transmit data within the wellbore complicates the make-up and break-up of the tubular string during conventional operations.

Accordingly, the oil and gas industry has moved away from the utilization of electrical conductor data transmission systems (frequently referred to as "hardwire" systems), and toward the utilization of pressure changes in a fluid column to transmit data within the wellbore. One example of the extensive use of fluid columns within a wellbore to transmit data is that of measurement-while-drilling data transmission systems, also referred to as "MWD" systems. Typically, these systems are utilized only in drilling operations. Generally, a plurality of sensors are provided in a tubular subassembly located within the bottom hole assembly, near the rock bit which is utilized to disintegrate the formation. The electrical sensors detect particular wellbore parameters, such as temperature, pressure, and vibration, and develop electrical signals corresponding thereto. The electrical signals are converted into a digital signal stream (generally multiplexed sensor data) and utilized to develop a plurality of pressure changes in a fluid column, typically the tubing fluid column, which are sensed at the earth's surface and converted into a format which allows the drilling engineers to make decisions which affect the drilling operations. Some attempts have been made to apply the concepts of MWD data transmission systems to completion operations, during which the drilled wellbore is placed in condition for continuous production of oil and gas from selected wellbore regions.

One of the more interesting of the prior art approaches is that described and depicted in U.S. Pat. No. 3,227,228 to Bannister. The Bannister reference is directed to a method and system for remotely actuating coring devices which are located in a drillstring. The coring devices may be individually and selectively actuated from a surface location, and function to automatically obtain core samples from the wellbore formation surrounding particular portions of the drill collar. The invention of the Bannister reference is succinctly summarized at Column 1, commencing at line 58, as follows:

"These and may other objects and advantages of my invention are accomplished in one embodiment by having one of the drill collars (hereinafter called a coring collar) in the drill string of a rotary rig contain a plurality of sample-taking devices and means for firing the devices in response to a remotely located wave energy source. The wave energy can be a controlled vibration of the drill string, a radio wave transmission, or a pressure variation transmitted down the drill mud. . . . When a formation sample is to be taken the operation of one or more coring devices is selectively controlled by wave energy transmission from a remote location."

The Bannister reference teaches the alternative utilization of three techniques for remotely controlling the firing of the coring devices in a coring collar. Those techniques include (1) applying vibration energy to the drillstring, (2) utilizing a pressure pulse generator to alter the pressure in the fluid column, or (3) utilizing a radio transmitter. All three of the alternative actuation techniques are depicted graphically in FIG. 1 of the Bannister reference. The vibratory energy supply 40 is depicted as being directly mechanically linked to the drillstring. The radio transmitter 42 is depicted as utilizing an antenna to transmit radio frequency actuation signals. The pressure pulse generator 41 is shown as communicating with the flowlines of the drilling rig, to allow the direct application of the pressure pulses to the fluid column in the wellbore. The Bannister reference uses the term "wave energy" to encompass all three types of alternative actuation systems. The broad objective of the Bannister invention is stated at Column 3, commencing at line 30, as follows:

"The coring collar 20 mounts a number of coring devices 21 that are fired by firing selector 22 (FIG. 2) controlled by wave energy transmitted from a wave energy source at the surface to receiver 23 located in coring collar 20. The coring devices 21 can be fired selectively at any desired formation level."

This is further elaborated on commencing at Column 3, line 74, as follows:

The coring devices 21 can be fired by several forms of controlled wave energy originating from wave energy source at the surface. The wave energy can be a vibration transmitted down the drillstring 8 from a vibration wave energy source 40 (FIG. 1), a pressure variation from a pressure wave energy source 41, or an electromagnetic transmission from a radio wave source 42. Each of these wave energy sources is conveniently associated with a rotary rig without interfering or significantly delaying the operation, as will be described hereinafter.

In the figures of the Bannister reference, the vibration transmitter is depicted in FIGS. 3, 4, and 5. The pressure pulse generators (two alternative embodiments) are depicted in FIGS. 6 and 7. A radio frequency actuation apparatus is depicted in FIG. 8. The remaining figures (FIGS. 9 through 14) depict the mechanical components of the coring tool itself.

The pressure pulse transmission equipment is described in the specification between Column 4, line 66 and Column 5, line 68. Bannister plainly teaches the utilization of a "distinct characteristic" in the pressure signals, as stated at Column 4, commencing at line 66, which states as follows:

The coring devices can be fired by a pressure vibration having a distinctive characteristic transmitted down the drill mud 6. A pulse or a wave having a preset frequency can select which coring device is to be fired.

It is also clear from the Bannister reference that a high velocity pressure change is contemplated. In all probability, the pressure change can be characterized as an acoustic pulse. The specification clearly states this commencing at Column 4, line 70, which states as follows:

One embodiment of a pressure pulse firing system is illustrated in FIGS. 1 and 6. The pressure pulse source 41 fires an explosive charge 75 when switch 76 is closed in a fluid filled explosion chamber 77 connected through valve 73 to the stand pipe 7. Drill mud circulation is stopped, normally closed valve 78 is open and normally open valve 79 and 85 in the inlet and outlet pipe 17 and 15, respectively, are closed. The explosion creates a steep front, high amplitude pressure variation that travels down the drill mud 6 inside drillstring 8 to the coring collar 20.

Thus, it appears that the pressure pulse is probably traveling close to the velocity of sound for the particular transmission medium. The two different types of pressure pulse generators which are depicted in FIGS. 6 and 7 are described separately in Column 5 of the Bannister reference. The embodiment of in FIG. 6 is described as follows:

Disposed within coring collar 20 is a pressure responsive receiving means 80 (FIG. 6) that actuates a firing selector 81 to selectively fire the coring devices 21. The pressure variation flexes a diaphragm 94 disposed in the wall of passage 30, transmitting a force through an incompressible fluid 82 to a piston 83. An outward force (to the left as viewed in FIG. 6) is applied to piston 83 by a spring 84 keeping contact 86 at the end of piston rod 87 from stationary contact 88. When the high amplitude pressure variation reaches the coring collar 20, the contacts 86 and 88 close an energizing circuit including battery 89 to a solenoid 96 that operates a pawl 90 and rotates a ratchet wheel 91 to a new position. At each position of ratchet wheel 91 an attached contact arm 92 connects with a fixed contact that closes an energizing circuit including battery 93 to fire the electric detonator in one of the coring devices 21. Each pressure pulse fires another one of coring devices 21 as the ratchet wheel 91 is progressively moved to new positions.

The alternative embodiment of the pressure pulse generator of FIG. 7 is described as follows, commencing at Column 5, line 25:

Another form of pressure responsive receiving means that uses electronic techniques to duplicate the above describe electromechanical system is illustrated in FIG. 7.

The present data miniaturization of electronic components facilitates the compact arrangement of this apparatus, wherein the pressure variation is sensed by a pressure responsive transducer 100, preferably a piezoelectric device, and a voltage proportional to the pressure, after being amplified by amplifier 101, is coupled to a threshold limiter 102. The threshold limiter serves to prevent normal pressure variations in the drill mud 6 from firing the coring device 21 by producing an output signal only if the pressure-proportional input voltage exceeds a preset minimum. The Schmidt trigger circuit is one suitable type of threshold limiter, producing for each input pulse about (sic) a preset level an output pulse that is coupled to a univibrator 107, (a mono-stable multivibrator) to produce a pulse that is amplified in amplifier 103. Each pulse activates a stepping switch 104 having an input to successively connect an input 105 to each of outputs 106, closing an energizing circuit including battery 108 for the electric detonator of one of the coring devices 21.

Yet another alternative system, which is not depicted in the drawings, is discussed for use in pressure pulse actuation, commencing at Column 5, line 58 which reads as follows:

Another pressure wave firing system suitable for use in the present invention utilizes a pressure source that generates an alternating pressure variation in a single frequency in the drill mud 6. The pressure wave responsive receiver includes a pressure variation transducer that produces an A.C. signal from the transmitted pressure wave, using a filter channel to fire one of the coring devices. As in the mechanical vibration arrangement, other frequencies and filter channels can be incorporated to selectively fire additional coring devices 21.

The particular reference to the "mechanical vibration arrangement" is an identification of the foregoing text which relates to the mechanical vibration actuated firing, which commences at Column 5, lines 48, which states as follows:

It is apparent that the vibration wave system previously described can be modified to operate on a series of pulses as in the pressure responsive system embodiment just described with reference to FIG. 7. In such an arrangement only one frequency need be used and the A.C. generator 45 would be connected to vibrator 47 only for a moment to produce each vibratory pulse. The vibration response receiver would include a band-pass filter preferably following amplifier 101 that responds only to the selected frequency.

SUMMARY OF THE INVENTION

It is one objective of the present invention to provide a method and apparatus for communicating remote control signals in a wellbore between a transmission node and a reception node, through a fluid column extending therebetween, wherein potential fluid leak paths are minimized in general, and in particular are minimized by sensing the acoustic transmissions having one or more identifying transmission frequencies through a rigid structural component of the reception apparatus at the reception node.

It is still another objective of the present invention to provide a method and apparatus for communicating remote control signals in a wellbore between a transmission node and a reception node, through a fluid column extending therebetween, wherein the opportunity for error in the reception of the acoustic transmissions is minimized by making the reception circuitry insensitive to acoustic signals having a frequency other than the one or more transmission frequencies uniquely associated with the particular reception equipment.

It is still another objective of the present invention to provide a method and apparatus for communicating acoustic transmissions having one or more identifying frequencies in a wellbore between a transmission node and a reception node, through a fluid column extending therebetween, wherein the acoustic transmissions are generated in an automated manner by a fluidic circuit located at the transmission node which is under the control of a data processing system.

It is still another objective of the present invention to provide a method and apparatus for communicating acoustic transmissions in a wellbore between a transmission node and a reception node, through a fluid column extending therebetween, with a reception apparatus located within the wellbore at a desired location on a wellbore tubular conduit string, wherein detection of the acoustic transmissions uniquely identified with the reception apparatus causes the actuation of a wellbore tool, and wherein said fluid column is monitored for at least one fluid pressure change which provides a positive indication at a surface location of actuation of the wellbore tool.

These and other objectives are achieved as is now described. When characterized broadly as a method, the present invention is directed to a method for communicating remote control signals in a wellbore between a transmission node and a reception node, through a fluid column extending therebetween. The method is comprised of a plurality of method steps. A transmission apparatus is provided at the transmission node, which is in communication with the fluid column, for altering pressure of the fluid column to generate an acoustic transmission having one or more identifying frequencies which is composed of either "positive" or "negative" rapid changes in pressure amplitude. A reception apparatus is also provided, but is disposed at the reception node. The reception apparatus includes: (1) a rigid structural component with an exterior surface which is in contact with the fluid column and an interior surface which is not in contact with the fluid column, and (2) a sensor assembly which detects changes in elastic deformation of the rigid structural component, which is also maintained out of contact with the fluid column. The transmission apparatus is utilized to alter pressure of the fluid column in at least one predetermined pattern to generate at least one remote control signal having one or more acoustic transmission frequencies. Preferably, the generation of the acoustic transmissions is accomplished by a fluidic circuit which is under computer control. The reception apparatus is utilized to detect the frequency of the acoustic transmissions in the fluid column through changes in the elastic deformation of the rigid structural component. In one embodiment, the sensor assembly includes a fluid body in communication with the interior surface of the rigid structural component, but which is not in communication with the fluid column. The fluid body is responsive to changes in the elastic deformation of the rigid structural component. Also, preferably, a pressure sensor is provided for directly sensing pressure changes in the fluid body to detect elastic deformation of the rigid structural component. In the alternative embodiment, a strain gage bridge may be utilized to detect elastic deformation of the rigid structural component. In the described embodiments of the present invention, the rigid structural component comprises a mandrel member which at least partially defines the central bore to the wellbore tubular member. The mandrel member is a substantially imperforate component which contains very few, if any, potential fluid leak paths, thus allowing the present invention to be utilized in wellbore completions which are intended for extremely long service lives.

The present invention may be utilized to perform completion operations in a wellbore. A single transmission apparatus is provided at the wellhead for remote control signals which are transmitted to a plurality of reception apparatuses which are disposed at selected locations within a string of tubular members. A plurality of wellbore tools are provided in the string in selective communication with the plurality of reception apparatuses. The wellbore tools may include (a) electrically-actuable wellbore packers; (b) electrically-actuable perforating guns; (c) electrically-actuable values; and (d) electrically-actuable liner hangers. The transmission apparatus may be utilized to generate particular control signals to selectively actuate the plurality of wellbore tools in a predetermined manner to complete the wellbore. Typically, liner hangers may be utilized to hang casing off cemented casing segments. Cementing operations should follow to cement all portions of the casing. Next, perforating operations should be conducted to perforate selected portions of the cased wellbore. Then, one or more packers should be set to isolate particular regions between a production tubing string and the cased wellbore. Finally, valves should be opened to allow the selective flow of wellbore fluids into the cased wellbore for production upward through the production tubing string. Three different electrically-actuated end devices are described and claimed which have special utility in completion operations.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

The detailed description which follows is organized under the following topic headings:

1. EXPLANATION OF ALTERNATIVE EMBODIMENTS;
2. OVERVIEW OF THE SYSTEM;
3. THE NEGATIVE PRESSURE PULSE GENERATOR;
4. THE POSITIVE PRESSURE PULSE GENERATOR;
5. COMPUTER CONTROL OF THE POSITIVE PRESSURE PULSE GENERATOR;
6. PRESSURE-TRANSDUCER TYPE SENSOR;
7. THE STRAIN GAGE TYPE SENSOR;
8. THE PRESSURE CHANGE DETECTION CIRCUIT;
9. FREQUENCY DETERMINATION CIRCUIT;
10. THE PROGRAMMING TERMINAL;
11. OVERVIEW OF THE RECEPTION APPARATUS;
12. THE MAGNETIC INTERFACE TERMINAL OF THE PROGRAMMING UNIT;
13. THE MICROPROCESSOR CIRCUIT;
14. THE MAGNETIC COMMUNICATION INTERFACE OF THE RECEPTION APPARATUS;
15. THE POWER-UP CIRCUIT FOR PRESSURE CHANGE DETECTION CIRCUIT;

16. THE POWER-UP CIRCUIT FOR THE MICROPROCESSOR;
17. THE COMPUTER PROGRAM;
18. COMPLETION OPERATIONS;
19. EXPLODING FASTENER END DEVICE;
20. THE KEVLAR COUPLING END DEVICE; and
21. THE SLIDING SLEEVE END DEVICE.

1. EXPLANATION OF ALTERNATIVE EMBODIMENTS

In the present invention, several alternatives are provided.

There are alternative techniques for generating a remote control signal at a transmission node, including: a "negative pulse technique" which utilizes a conventional fluid pump and a conventional valve to generate a plurality of "negative" pressure pulses which constitute a control signal, and a "positive pulse technique" which utilizes a unique valving apparatus to generate a plurality of "positive" acoustic pulses which constitute a control signal.

There are also alternative techniques for sensing the remote control signal at a remotely located reception node, including: a "pressure transducer technique" which utilizes a pressure transducer which is maintained out-of-contact with wellbore fluids but which nonetheless detects the remote control signal in a wellbore fluid column through changes in elastic deformation of a rigid structural component, and a "strain gage technique" which utilizes a conventional strain gage bridge to detect directly a sequence of circumferential elastic deformations of a rigid structural component, such as a mandrel.

There are also several different embodiments of electrically-actuable wellbore tools, including: an electrically-fragmented pin member and a valve assembly.

2. OVERVIEW OF THE SYSTEM

Figure 1:
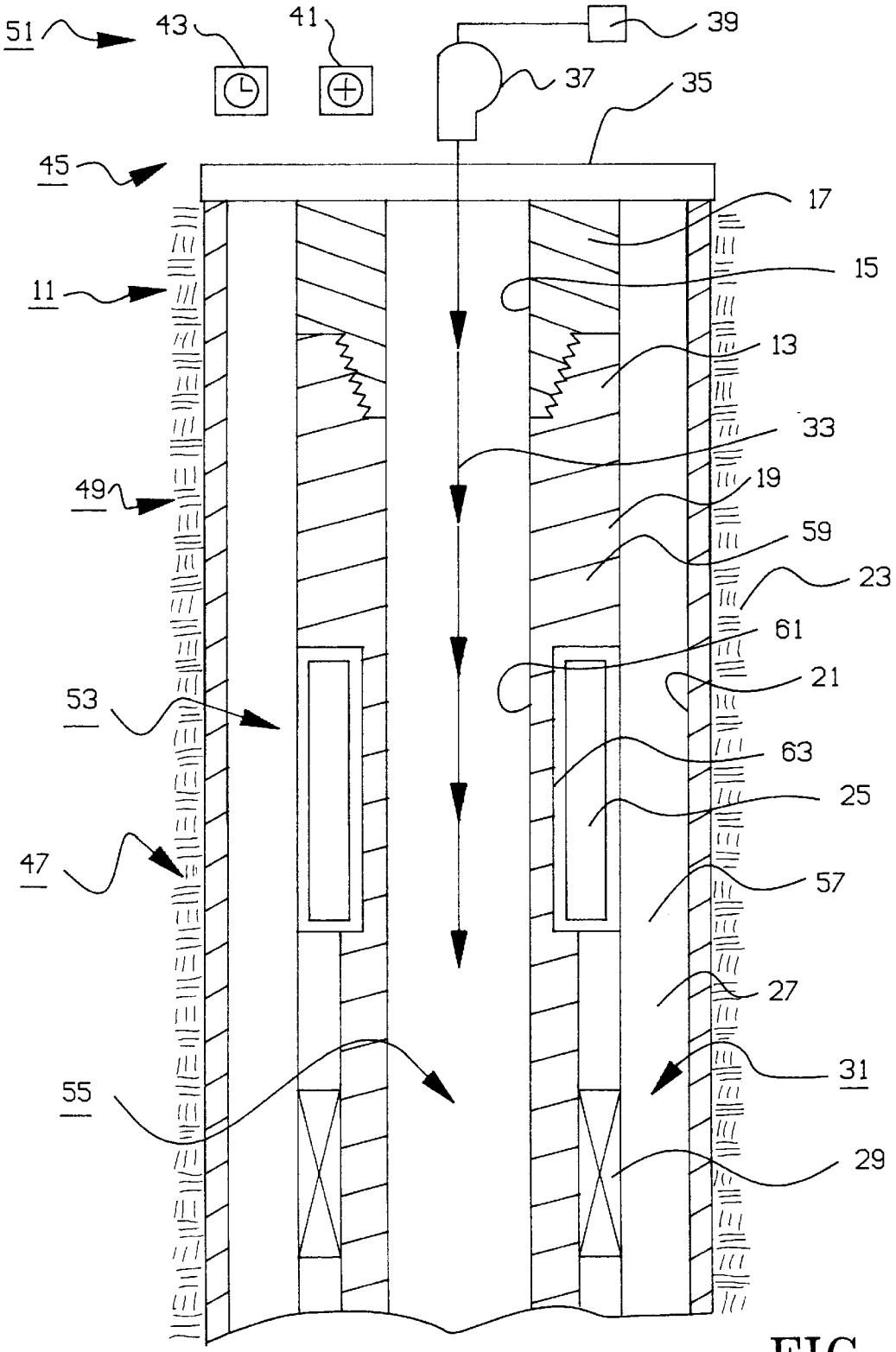
FIG. 1 is a simplified and schematic view of one embodiment of the remote control apparatus of the present invention, which will be utilized to present the broad concepts underlying the present invention.

FIG. 1 is a simplified and schematic view of the wellbore communication apparatus 11 of the embodiment for the positive pulse technique. As is shown, communication apparatus 11 is disposed within wellbore 49. Considered broadly, wellbore communication apparatus 11 is utilized to communicate remote control signals within any fluid column, but in the preferred embodiment fluid column 55, from transmission apparatus 51 which is located at transmission node 45 to reception apparatus 53 which is located at reception node 47 within wellbore 49. In this embodiment, reception apparatus 53 is located within wellbore 49 on tubular conduit string 13 which is composed of a plurality of tubular members, such as tubular member 17 and tubular member 19, which are threaded together at conventional pin and box threaded couplings. In the view of FIG. 1, tubular conduit string 13 is greatly simplified; in actual practice, typically, several hundred tubular conduit members are coupled together to define tubular conduit string 13 which extends from the wellhead to a remote wellbore location, possibly several thousand feet below the earth's surface. Central bore 15 is defined within tubular conduit string 13. As is shown in FIG. 1, tubular conduit string 13 may be concentric with other wellbore tubulars, such as casing 21 which is utilized to prevent the washout or deterioration of formation 23, and to allow for the selective communication of oil, gas, and formation water with wellbore 49 through perforations within casing 21 which are provided at selected locations (and which are not shown in this figure).

Wellbore communication apparatus 11 includes sensor assembly 25 for detecting changes in the pressure of fluid column 55 within central bore 15, drive mechanism 27 which is electrically-actuated by sensor assembly 25, and tool mechanism 29 which achieves an engineering objective within the wellbore in response to interaction with drive mechanism 27. Viewed broadly, drive mechanism 27 and tool mechanism 29 comprise an electrically-actuated wellbore tool 31 which may be selectively switched between operating modes or states in response to electrical signals received from sensor assembly 25. Preferably, sensor assembly 25 includes a microprocessor which is utilized to record either one or two frequency values which are uniquely associated with a particular wellbore tool. This allows wellbore communication apparatus 11 to be utilized in an engineering environment wherein a plurality of electrically-actuated wellbore tools are provided at selected locations within tubular conduit string 13, each of which is responsive to one or two frequency values and which is thus independently operable.

Sensor assembly 25 is partially housed within mandrel member 59 which comprises a rigid structural component with an exterior surface 61 which is in direct contact with fluid column 55, and interior surface 63 which is not in direct contact or communication with fluid column 55. As is shown in FIG. 1, mandrel member 59 cooperates with adjoining tubular members to define central bore 25 within tubular conduit string 13. In the preferred embodiment, sensor assembly 25 is utilized to detect elastic deformation of mandrel member 59 in response to changes in pressure amplitude of fluid column 55, and in particular to detect changes in the elastic deformation of mandrel member 59. In the preferred embodiment, mandrel member 59 is formed of 4140 steel, which has a modulus of elasticity of 30,000,000 pounds per square inch, and a Poisson ratio of 0.3. Also, in the preferred embodiment, the portion of mandrel member 59 which is adjacent reception apparatus 53 is cylindrical in shape, having an outer diameter of 5.5 inches, and an inner diameter of 4.67 inches. As can be seen from FIG. 1, mandrel member 59 serves to form a substantially imperforate conduit wall within tubular member 19 of tubular conduit string 13.

3. THE NEGATIVE PRESSURE PULSE GENERATOR

In the particular embodiment which employs the negative pulse technique, wellbore communication apparatus 11 includes transmission apparatus 51 which is shown in FIG. 1 as being located at the wellhead, which for purposes of discussion can be considered to be a "transmission node" 45. Also, as is shown in FIG. 1, reception apparatus 53 is distally located from transmission apparatus 51, and in particular is shown as being located at reception node 47 within wellbore 49. Pressure waves of one or more predefined frequencies are communicated from transmission apparatus 51 for detection by reception apparatus 53. Reception apparatus 53 is utilized to detect rapid changes in amplitude of the pressure exerted by fluid column 55 upon mandrel member 59, while maintaining sensor assembly 25 out of direct, or indirect, contact or communication with fluid column 55. The amplitude, and rate of change of the amplitude, of fluid column 55 is manipulated with respect to time by a human operator who operates and monitors fluid pump 37, which communicates through valve assembly 35 with fluid column 55. Pressure gage 39 is utilized to monitor the pressure of fluid column 55, while amplitude control 41 is utilized by a human operator to urge fluid column 55 toward a preselected pressure amplitude, or to maintain a particular amplitude. Timer 43 is also utilized by a human operator to monitor time intervals.

In this embodiment, the human operator manually first operates valve assembly 35, which is shown in simplified form in FIG. 1, to allow for the pressurization of fluid column 55 by pump 37, and then allows the selective venting of high pressure fluid from central bore 15 to annulus 57, or more preferably to a reservoir, which is maintained at a lower pressure. After pressurizing fluid column 55 a predetermined amount, the human operator may vent fluid from fluid column 55 through valve assembly 35 to such a reservoir. This process is repeated a certain number of times in a sequence which defines one or two transmission frequencies. These rapid changes in the amplitude of the pressure of fluid column 55 affect the elastic deformation of mandrel member 59 of reception apparatus 53 in a manner, which will be discussed herebelow, which is detected by sensor assembly 25. Timer 43 is utilized to maintain timing for the message segments to help the human operator obtain the one or two transmission frequencies uniquely associated with any one of particular wellbore tool.

In the preferred embodiment, pump 37 should have sufficient capacity to provide fluid pressurized to a selectable amount in the range of zero pounds per square inch to twenty thousand pounds per square inch, and should preferably have an output capacity of between six to twenty gallons per minute. In its most rudimentary form, timer 43 may comprise a standard clock which is not coordinated in operation with pump 37. In the preferred embodiment, valve assembly 35 is a conventional one-quarter turn cock valve which is utilized at wellheads. In alternative embodiments, the operation of timer 43, amplitude control 41, pump 37, pressure gage 39, and valve assembly 35 may be coordinated and subjected to computer control to render wellbore communication apparatus 11 easier to utilize.

Figure 2:
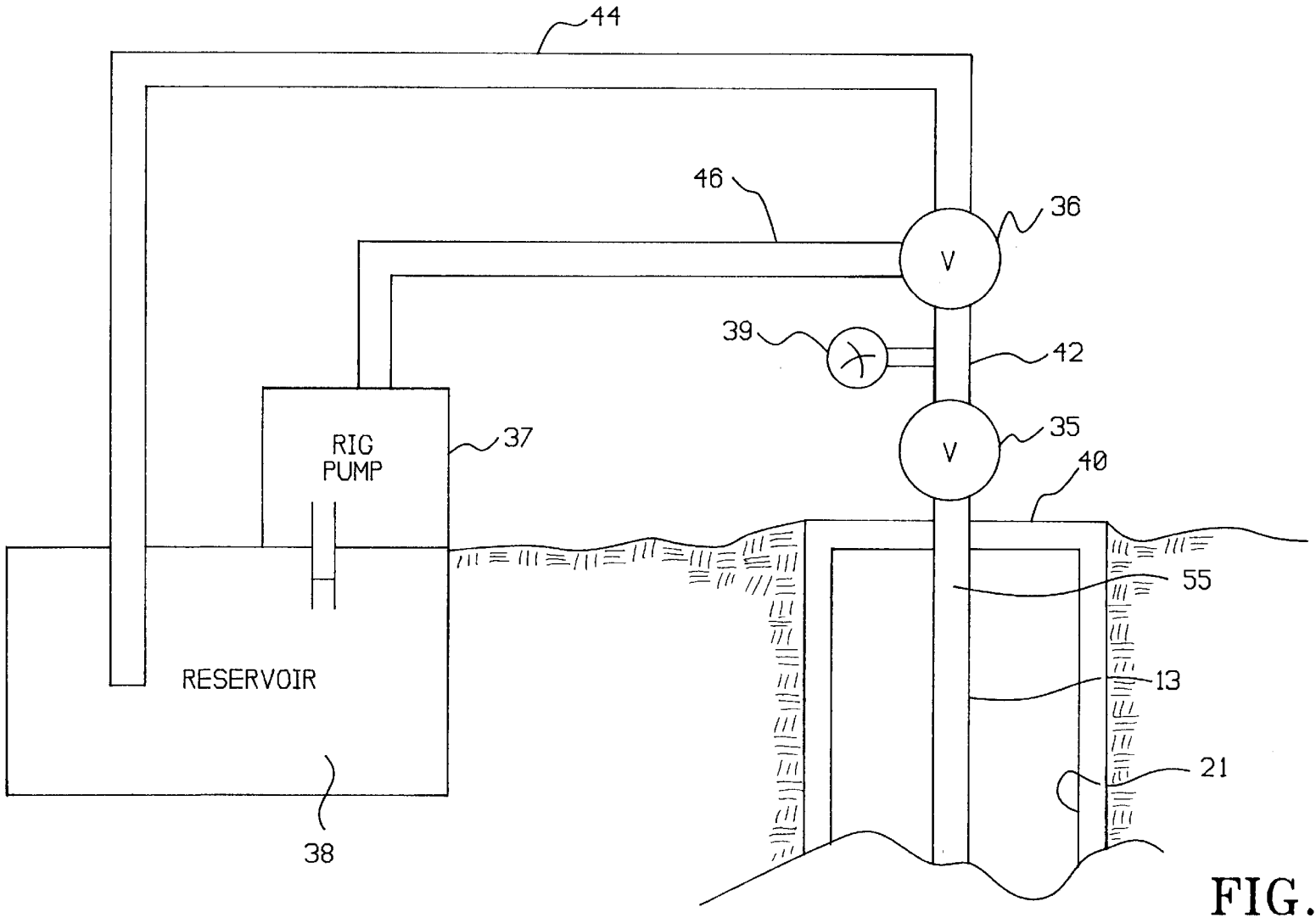
FIG. 2 is a simplified and schematic view of a pressure pulse generator, in accordance with one embodiment of the present invention, for generating "negative" pressure pulses.

FIG. 2 is a more detailed view of the pressure pulse generator which can implement the "negative pulse technique". As is shown, valves 35, 36 are utilized to allow the selective communication of rig pump 37 and reservoir 38 with fluid column 55 disposed within tubular conduit string 13. As is shown, valve 35 is disposed adjacent wellhead 40. As identified above, valve 35 comprises a one-quarter turn cock valve, which may be physically operated by a human operator at the wellhead. Valve 36 is also manually-operable to allow the selective communication of conduits 44, 46 with conduit 42 which extends between valve 35 and valve 36. Conduit 44 extends between valve 36 and reservoir 38, while conduit 46 extends between valve 36 and rig pump 37.

When the operator desires to increase the pressure of fluid column 55 within tubular conduit string 13, valve 35 and valve 36 are manually operated to allow the passage of fluid from rig pump 37 to fluid column 55 by passage through conduit 46, valve 36, conduit 42, valve 35, and wellhead 40. As is shown in FIG. 2, rig pump 37 draws fluid from reservoir 38. When a sufficient fluid pressure amplitude is obtained within fluid column 55, as determined by readings of pressure gage 39, valve 35 is manually closed. When the operator desires to transmit an acoustic pulse, valve 36 is manually operated to allow the communication of fluid from fluid column 55 to reservoir 38, by allowing passage from conduit 42 to conduit 44. Then, the operator manually operates valve 35 in a predetermined sequence to create a series of rapid changes in fluid pressure amplitude which define a particular predefined frequency, as will be discussed in greater detail herebelow. In this negative pressure pulse technique of generating coded message segments, it is the rapid decrease in fluid pressure amplitude of fluid column 55 which comprises the acoustic pulse. The volume of fluid evacuated from fluid column 55 to reservoir 38 need not be great in order to create a plurality of sequential rapid decreases in pressure amplitude, and the absolute volume of fluid within fluid column 55 need not be altered to a great extent in order to create coded messages. Utilizing an alternative pressure pulse generator, a particular transmission frequency can be generated from a plurality of rapid, and momentary, increases in the fluid pressure amplitude of fluid column 55.

4. THE POSITIVE PRESSURE PULSE GENERATOR

Figure 3:
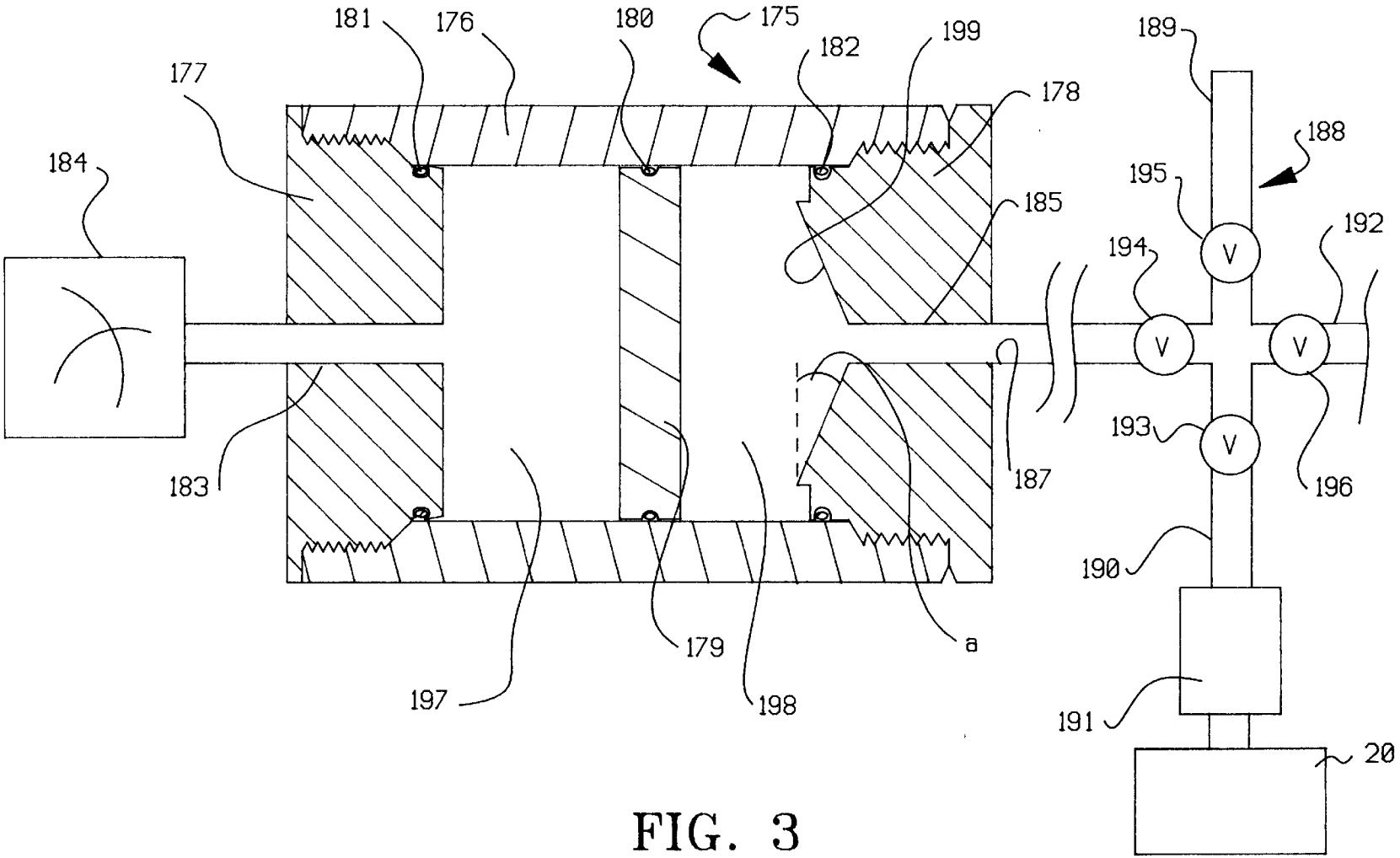
FIG. 3 is a simplified and schematic view of a unique pressure pulse generator, in accordance with another embodiment of the present invention, for generating "positive" acoustic pulses.

An apparatus which can be utilized to perform the alternative positive pulse transmission technique is depicted in FIG. 3. In this view, pressure pulse generator 175 is shown in longitudinal section view, and the remainder of the components which interact therewith are depicted in simplified and block diagram form. As is shown, pressure pulse generator 175 includes cylindrical housing 176, which is preferably approximately eighteen and one-half inches long, having an internal diameter of just under twelve inches. Cylindrical housing 176 is threaded at both ends for engaging end caps 177, 178. O-ring seals 181, 182 are provided at the interface of end caps 177, 178 and the interior surface of cylindrical housing 176. Preferably, a disk-shaped piston 179 is disposed within cylindrical housing 176, and includes O-ring 180 to provide for a dynamic sealing engagement with the interior bore of cylindrical housing 176. In the preferred embodiment, end caps 177, 178 include bores 183, 185, which preferably have a diameter of approximately 0.17 inches, and a length of three inches. Bore 183 is utilized to allow pressure gage 184 to monitor the pressure within compartment 197 which is defined between end cap 177 and disk-shaped piston 179. Bore 185 is utilized to allow the selective communication between compartment 198 and four-way valve 188.

In the preferred embodiment, compartment 197 is filled with an inert gas. The compartment is air-tight, and leak-free. Displacement of disk-shaped piston 179 toward end cap 177 will cause an increase in pressure of the inert gas contained within compartment 197, which is detected by pressure gage 184. In the preferred embodiment, compartment 198 is filled with a liquid, such as water, which is propelled outward through bore 185 if disk-shaped piston 179 is urged right-ward toward end cap 178. In the preferred embodiment, end cap 178 includes conical region 199 which defines an angle 198 of thirty degrees, and a diameter at its base of ten inches. This conical-shaped surface 199 serves to direct fluid from compartment 198 into bore 185. Bore 185 communicates through hose 187 to four-way valve 188. In the preferred embodiment, hose 187 comprises a five foot length of rubber hose, which is rated to three thousand, five hundred pounds per square inch, and which is identified by Model No. SS-8R8-PM8-PM8-60. Fluid pump 191 communicates with four-way valve 188 through hose 190, which is identical to hose 187. Additionally, hose 192 is utilized to communicate fluid between four-way valve 188 and fluid column 55 (of FIG. 1). Four-way valve 188 also communicates with bleed port 189.

Four-way valve 188 includes pump valve 193, pressure pulse generator valve 194, bleed valve 195, and well valve 196. Well valve 196 allows selective communication of fluid between four-way valve 188 and hose 192, which is preferably a rubber hose, which is fifty feet long, and which is identified by Model No. SS-8R8-PM8-PM8-600.

In the preferred embodiment, pressure pulse generator 175 is utilized to discharge a small amount of fluid, such as water or wellbore fluid, into fluid column 55 (of FIG. 1) which produces a rapid pressure change which may be detected at substantial distances within the wellbore, but which does not substantially impact the absolute volume of the fluid contained within fluid column 55. Preferably, compartment 198 is configured in size to allow the discharge of between one-half gallon to one gallon of fluid, an infinitesimal amount of fluid considering that fluid column 55 may be thousands of feet in length. Pressure pulse generator 175 may be utilized in a manner to provide a plurality of rapid pressure pulses, each pulse occurring at a preestablished time, to create a an acoustic transmission having a particular predefined frequency which may be detected at reception node 47 by reception apparatus 53 (of FIG. 1).

The low-volume pressure pulses are generated utilizing pressure pulse generator 175 in the following manner:

1. pressure pulse generator valve 194 of four-way valve 188 is closed to prevent communication of fluids into compartment 198;
2. bleed valve 195 is opened to allow communication of fluid between four-way valve 188 and bleed port 189;
3. pump valve 193 of four-way valve 188 is closed to prevent communication between fluid pump 191 and four-way valve 188;
4. well valve 196 is opened to allow communication between fluid column 55 and four-way valve 188;
5. the rig pump (not depicted) is then utilized to completely fill central bore 15 (of FIG. 1) to provide a fluid column which extends from the wellhead (not depicted) downward through the wellbore conduit string which defines central bore 15 (of FIG. 1);
6. bleed port 89 is then monitored by a human operator until fluid is detected as flowing outward therefrom, an indication that central bore 15 is completely full of fluid, and that hose 192 is likewise completely full of fluid;
7. operation of the rig pump is then terminated;
8. bleed port 195 is then closed to prevent fluid from escaping through bleed port 189;
9. well valve 196 is then closed to prevent fluid from passing between four-way valve 188 and hose 192;
10. pump valve 193 is opened to allow the communication of fluid from pump 191 to four-way valve 188;
11. pressure pulse generator valve 194 is opened to allow the communication of fluid from four-way valve 188 to compartment 198 through hose 187;
12. pump 191 is then utilized to pump fluid, such as water or wellbore fluid, from reservoir 202, through four-way valve 188, through hose 187, to fill compartment 198 with fluid, causing the leftward displacement of disk-shaped piston 179, and corresponding compression of the inert gas contained within compartment 197;
13. gage 184 is monitored to detect the compression of the inert gas to one thousand pounds per square inch (1,000 p.s.i.) of force;
14. upon obtaining a force of one thousand pounds per square inch within compartment 197, the operation of pump 191 is discontinued;
15. pump valve 193 is then closed to prevent the communication of fluid between four-way valve 188 and pump 191;
16. well valve 196 is then opened, allowing the compressed inert gas within chamber 197 to urge disk-shaped piston 180 rightward to discharge fluid contained within compartment 198 through hose 187, through four-way valve 188, and into fluid column 55 of FIG. 1.

The execution of these operating steps generates a low volume, low frequency pressure pulse, with a volume of approximately one-half to one gallon of fluid, and a fundamental frequency of approximately one to two Hertz. The pressure pulse is essentially a step function of fixed (short) duration. Hose 187, four-way valve 188, and hose 192 serve to attenuate the pressure pulse and ensure that only the main harmonic of the pressure pulse is introduced into fluid column 55 (of FIG. 1). However, the pulse does not substantially change the absolute volume of fluid column 55 (of FIG. 1). The low frequency (one to two Hertz) pressure pulse travels downward within fluid column 55 of FIG. 1 to reception node 47 where it is detected by reception apparatus 53.

A comparison of the pressure pulse generating techniques of FIGS. 1 and 2 reveal that the technique of FIG. 1 operates by providing a brief negative pressure pulse by venting fluid from fluid column 55, while pressure pulse generator 175 is utilized to create a "positive" pressure pulse by introducing fluid into fluid column 55.

Viewed broadly, the positive pressure pulse generator is utilized to generate a series of pressure pulses in a fluid column, each of which creates a temporary and transient change in fluid pressure amplitude in the column which travels the length of a column, but which does not substantially change the absolute volume of a fluid column. The known volume of fluid which is discharged from the positive pressure pulse generator must be introduced into the fluid column at a very rapid rate in order to ensure that the pressure "pulses" have the above-identified attributes. For optimal performance, the fluid which is discharged from the positive pressure pulse generator into the fluid column should be introduced at or about a velocity which approximates the velocity of sound within the particular transmission medium. Of course, the velocity of sound varies with the viscosity of the transmission medium. A rather clean fluid, such as water, has one transmission velocity for sound, while a more viscous fluid, such as water containing numerous impurities and additives, will have a different transmission velocity for sound. For all practical purposes, the pressure pulses generated by the positive pressure pulse generator are "acoustic" waves which travel the length of the fluid column and have only a temporary and transient impact on the fluid pressure amplitude at any particular location within the fluid column. It is the impulse nature of the fluid pressure pulses generated by the positive pressure pulse generator which allow for the transmission of pulses over significant distances, without requiring a significant change in the absolute volume of the fluid contained within the fluid column.

5. COMPUTER CONTROL OF THE POSITIVE PRESSURE PULSE GENERATOR

Figure 29:
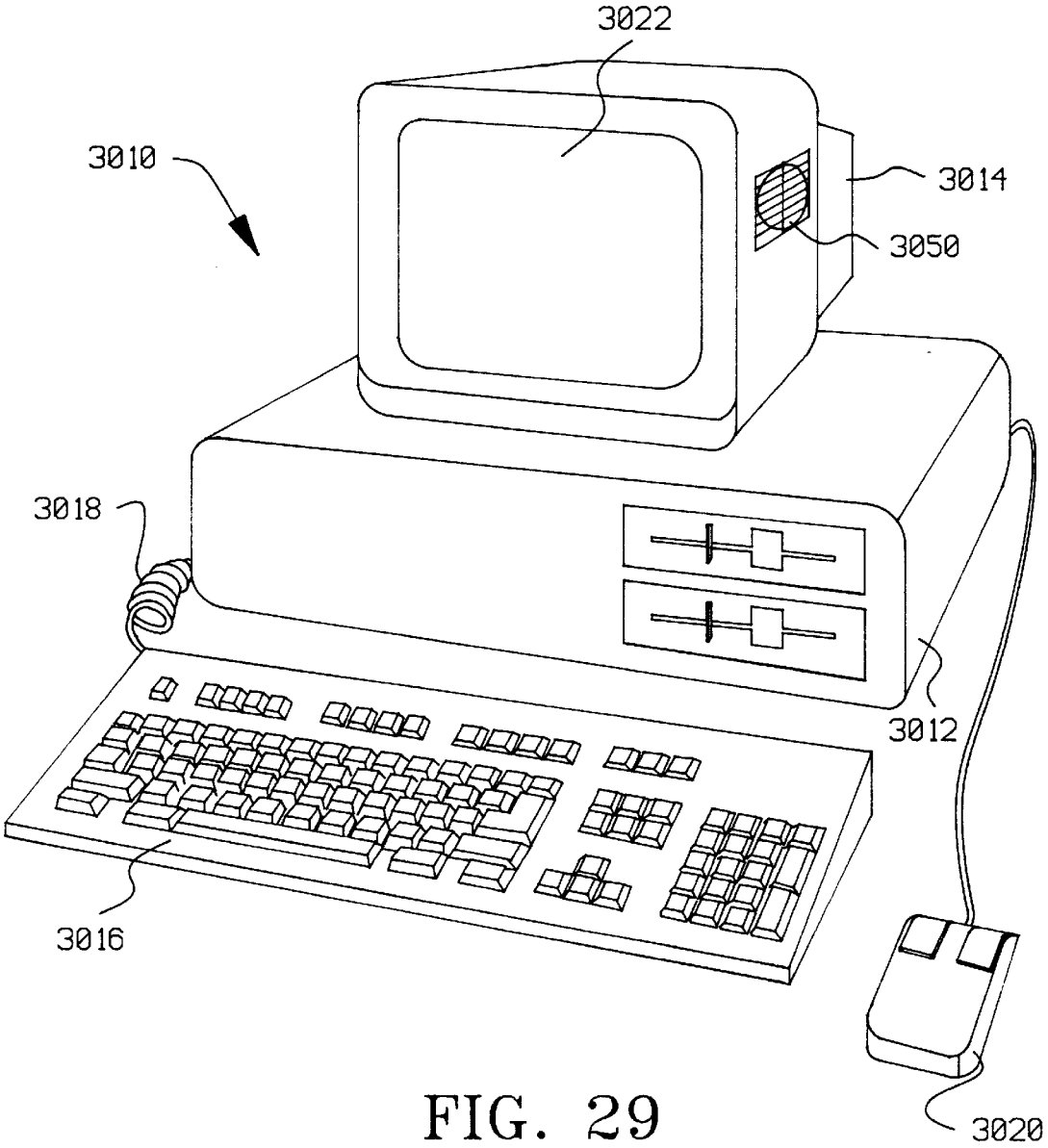
FIG. 29 is a pictorial representation of a data processing system programmed in accordance with the flowcharts of FIGS. 30 through 33.

With reference now to the figures and in particular with reference to FIG. 29, there is depicted a pictorial representation of data processing system 3010 which may be programmed in accordance with the present invention to control and monitor the positive pressure pulse generator valve. As may be seen, data processing system 3010 includes processor 3012 which preferably includes a graphics processor, memory device and central processor (not shown). Coupled to processor 3012 is video display 3014 which may be implemented utilizing either a color or monochromatic monitor, in a manner well known in the art. Also coupled to processor 3012 is keyboard 3016. Keyboard 3016 preferably comprises a standard computer keyboard which is coupled to the processor by means of cable 3018.

Also coupled to processor 3012 is a graphical pointing device, such as mouse 3020. Mouse 3020 is coupled to processor 3012, in a manner well known in the art, via cable 3022. As is shown, mouse 3020 may include left button 3024, and right button 3026, each of which may be depressed, or "clicked", to provide command and control signals to data processing system 3010. While the disclosed embodiment of the present invention utilizes a mouse, those skilled in the art will appreciate that any graphical pointing device such as a light pen or touch sensitive screen may be utilized to implement the method and apparatus of the present invention. Upon reference to the foregoing, those skilled in the art will appreciate that data processing system 3010 may be implemented utilizing a so-called personal computer, such as the Model 80 PS/2 computer manufactured by International Business Machines Corporation of Armonk, N.Y., or any other commercially available data processing system.

In the preferred embodiment, pressure pulse generator 175 is placed under computer control to discharge a small amount of fluid, such as water or wellbore fluid, into fluid column 55 (of FIG. 1) which produces a rapid pressure change which may be detected at substantial distances within the wellbore, but which does not substantially impact the absolute volume of the fluid contained within fluid column 55. Preferably, compartment 198 is configured in size to allow the discharge of between one-half gallon to one gallon of fluid, an infinitesimal amount of fluid considering that fluid column 55 may be thousands of feet in length. Pressure pulse generator 175 may be automatically actuated in a manner to provide a plurality of rapid pressure pulses, each pulse occurring at a preestablished time, to create an acoustic transmission having a particular predefined frequency which may be detected at reception node 47 by reception apparatus 53 (of FIG. 1).

The low-volume pressure pulses are generated utilizing pressure pulse generator 175 under the control of a computer program with program instructions being executed by data processing system 3010 in the following manner:

1. pressure pulse generator valve 194 of four-way valve 188 is electrically actuated to be closed to prevent communication of fluids into compartment 198;
2. bleed valve 195 is electrically actuated to be opened to allow communication of fluid between four-way valve 188 and bleed port 189;
3. pump valve 193 of four-way valve 188 is electrically actuated to be closed to prevent communication between fluid pump 191 and fourway valve 188;
4. well valve 196 is electrically actuated to be opened to allow communication between fluid column 55 and four-way valve 188;
5. a dedicated pump or the rig pump (not depicted) is then electrically actuated to completely fill central bore 15 (of FIG. 1) to provide a fluid column which extends from the wellhead (not depicted) downward through the wellbore conduit string which defines central bore 15 (of FIG. 1);
6. bleed port 89 is then monitored by an electrical sensor until fluid is detected as flowing outward therefrom, an indication that central bore 15 is completely full of fluid, and that hose 192 is likewise completely full of fluid and a signal is provided to data processing system 3010;
7. operation of the dedicated pump or the rig pump is then terminated by a command from data processing system 3010;
8. bleed port 195 is then electrically actuated to be closed to prevent fluid from escaping through bleed port 189;
9. well valve 196 is then electrically actuated to be closed to prevent fluid from passing between four-way valve 188 and hose 192;
10. pump valve 193 is electrically actuated to be opened to allow the communication of fluid from pump 191 to four-way valve 188;
11. pressure pulse generator valve 194 is electrically actuated to be opened to allow the communication of fluid from four-way valve 188 to compartment 198 through hose 187;
12. pump 191 is then electrically actuated to be utilized to pump fluid, such as water or wellbore fluid, from reservoir 202, through four-way valve 188, through hose 187, to fill compartment 198 with fluid, causing the leftward displacement of disk-shaped piston 179, and corresponding compression of the inert gas contained within compartment 197;
13. gage 184 provides an electrical signal to data processing system 3010 which is monitored to detect the compression of the inert gas to one thousand pounds per square inch (1,000 p.s.i.) of force;
14. upon obtaining a force of one thousand pounds per square inch within compartment 197, the operation of pump 191 is discontinued;
15. pump valve 193 is then electrically actuated to be closed to prevent the communication of fluid between four-way valve 188 and pump 191;
16. well valve 196 is then electrically actuated to be opened, allowing the compressed inert gas within chamber 197 to urge disk-shaped piston 180 rightward to discharge fluid contained within compartment 198 through hose 187, through four-way valve 188, and into fluid column 55 of FIG. 1.

The execution of these operating steps automatically generates a low volume, low frequency pressure pulse, with a volume of approximately one-half to one gallon of fluid, and a fundamental frequency of approximately one to two Hertz. The pressure pulse is essentially a step function of fixed (short) duration. Hose 187, four-way valve 188, and hose 192 serve to attenuate the pressure pulse and ensure that only the main harmonic of the pressure pulse is introduced into fluid column 55 (of FIG. 1). However, the pulse does not substantially change the absolute volume of fluid column 55 (of FIG. 1). The low frequency (one to two Hertz) pressure pulse travels downward within fluid column 55 of FIG. 1 to reception node 47 where it is detected by reception apparatus 53.

Figure 30:
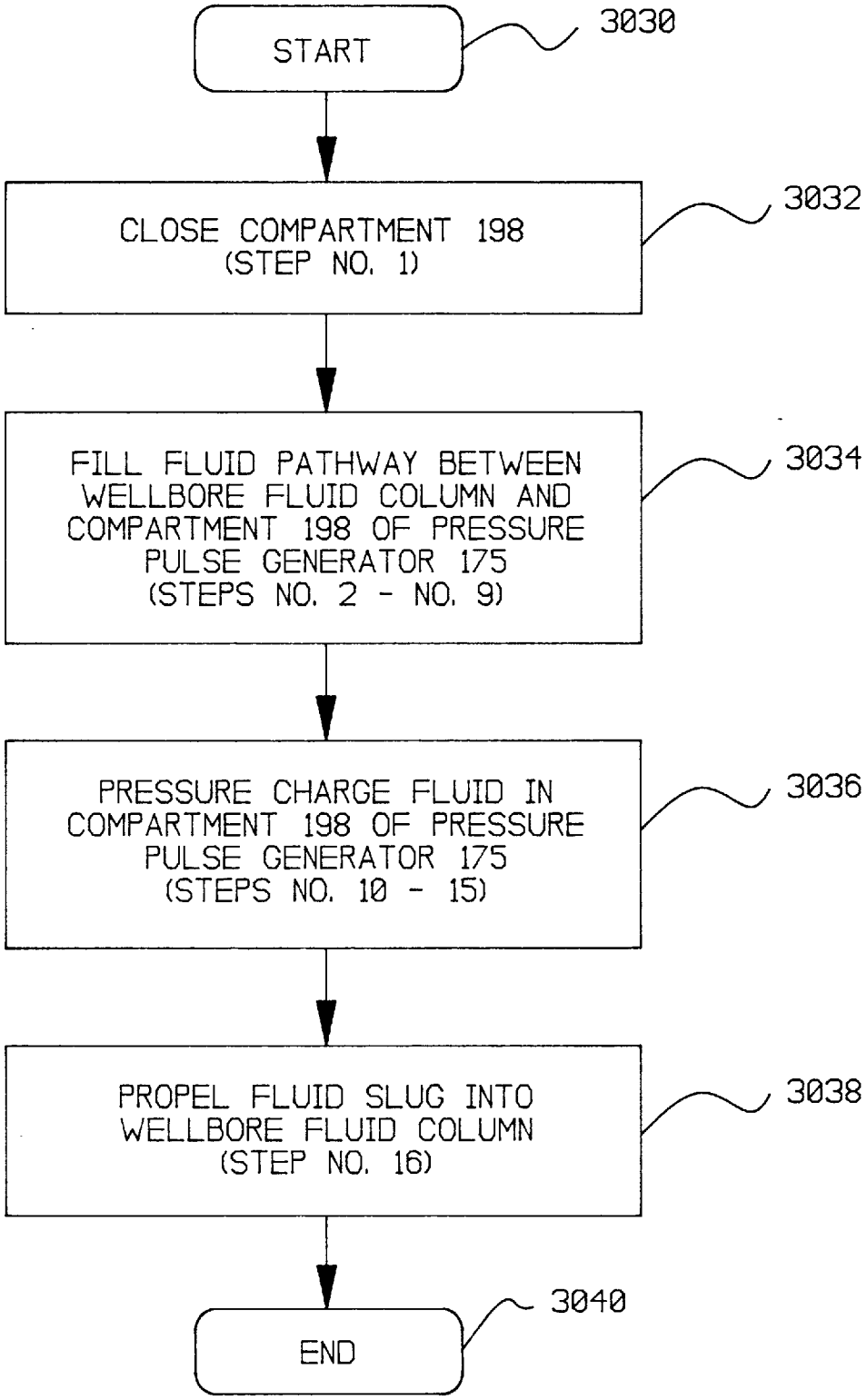

The steps set forth above are performed by the execution of program instructions by data processing system 3010 in accordance with the flowchart representation of FIG. 30. The process begins at software block 3030, wherein the routine is called for processing. Next, in accordance with software block 3032, data processing system 3010 closes compartment 198 of the pressure pulse generator 175. This activity corresponds to step number one enumerated above. Then, in accordance with software block 3034, data processing system 3010 fills the fluid pathway between the wellbore fluid column and compartment 198 of pressure pulse generator 175. This software action corresponds to the steps numbered two through nine which are set forth above. Then, in accordance with software block 3036, data processing system 3010 pressure charges fluid in the compartment 198 of pressure pulse generator 175. This software activity corresponds to the steps numbered ten through fifteen which are set forth above. Then, in accordance with software block 3038, data processing system 3010 propels a fluid slug into the wellbore fluid column. This corresponds to step number sixteen which is set forth above. The process ends at software block 3040.

Figure 31:
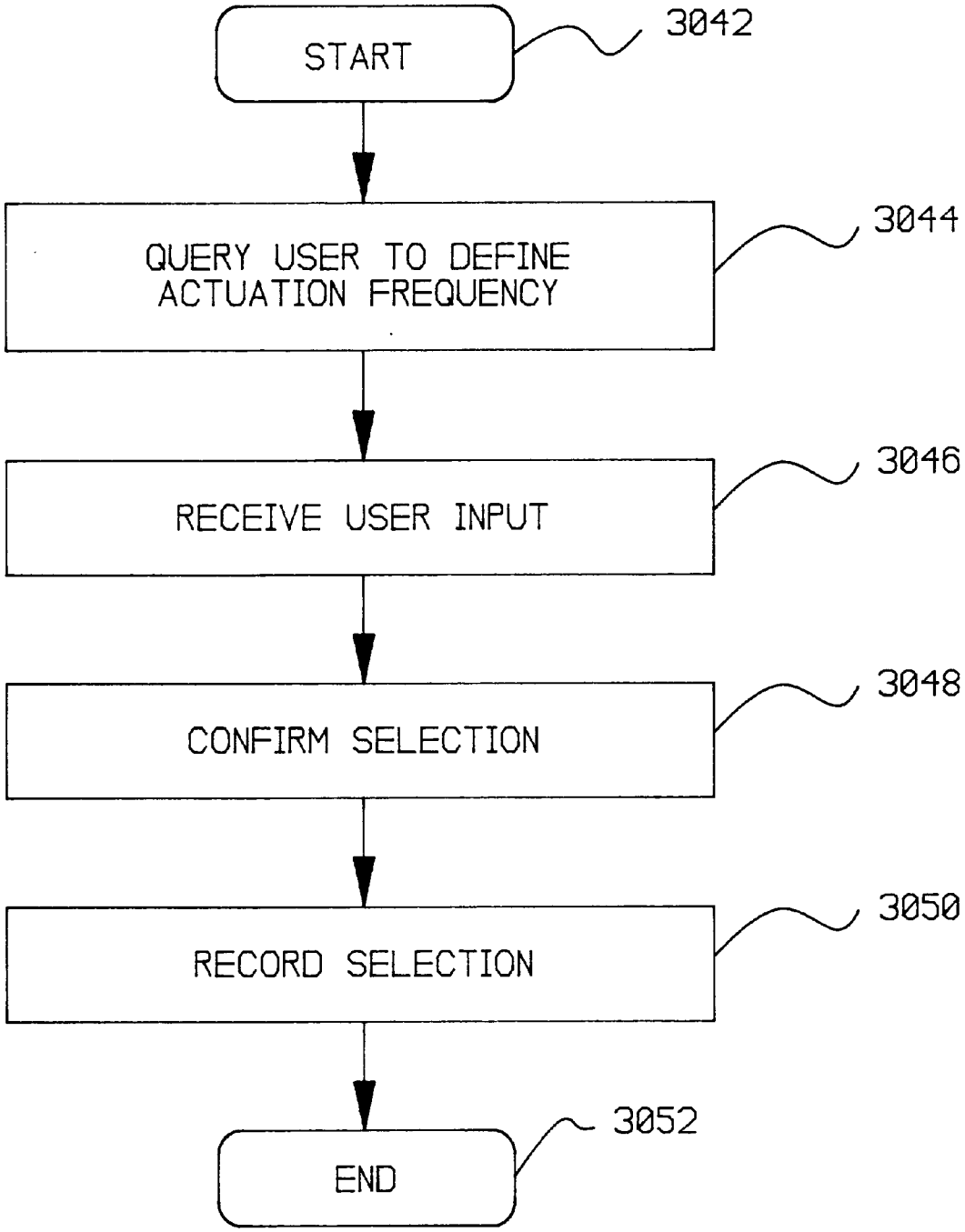

In the preferred embodiment of the present invention, the computer program includes a subroutine for defining the one or more acoustic actuation frequencies which can be utilized to remotely control subsurface wellbore equipment. As will be explained in greater detail, each remotely actuable wellbore tool is responsive to either one or two acoustic transmissions, each defining an actuation frequency. In accordance with the present invention, data processing system 3010 may be utilized to repeatedly actuate the pressure pulse generator 175 in a pattern which defines the one or two particular acoustic transmission frequencies, and thus which repeatedly performs the software operations depicted and described in connection with FIG. 30. FIG. 31 is a flowchart representation of the programming operations, which start at software block 3042. The operations continue at software block 3044, wherein data processing system 3010 queries a user to define the actuation frequencies, preferably by keyboard input. Next, in accordance with software block 3046, data processing system 3010 receives the user input, and in accordance with software block 3048, confirms this selection by engaging the user in a verification dialog. Finally, the operator selections are recorded in memory in accordance with software block 3050, and the routine ends at software block 3052.

Figure 32:
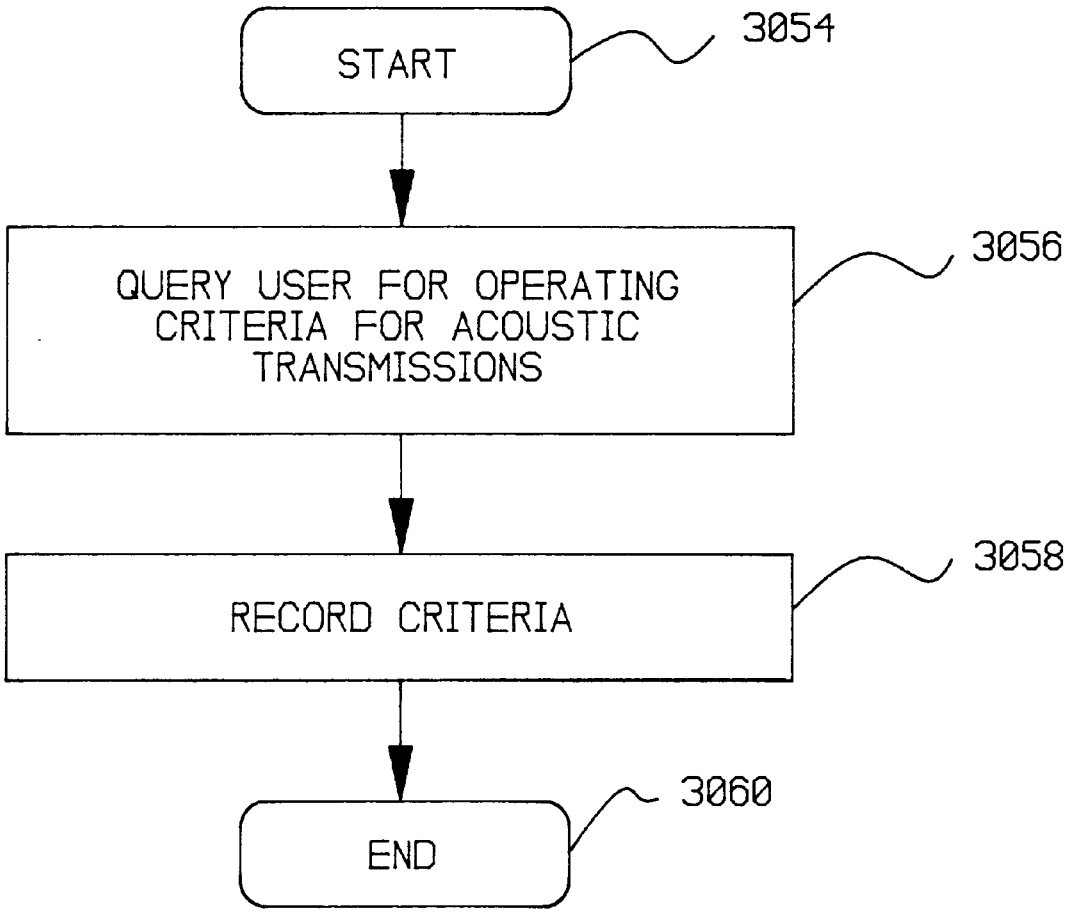

In one particular embodiment of the present invention, data processing system 3010 may be utilized in combination with pressure sensors to monitor and record the operating performance of pressure pulse generator 175, and the software steps of FIG. 30 which are utilized to consecutively actuate the pressure pulse generator 175. Preferably, one or more acoustic transmission qualities or attributes are monitored during actuation of pressure pulse generator 175. These attributes may include, but are not limited to, the following: pressure pulse amplitude, pressure pulse duration, pressure pulse velocity, and the exact time the pressure pulse was applied to the wellbore fluid column. The operator may interact with data processing system 3010 prior to actuation of pressure pulse generator 175 to define one or more of these attributes or criteria for proper operations. For example, the operator may establish a minimum pressure pulse amplitude, below the acoustic pulse which is considered to be unacceptable. Alternatively, the operator may define acoustic pulse velocity thresholds which must be exceeded for proper operation. Alternatively, the operator may define a pressure pulse duration which must be satisfied for proper operation. These attributes may be defined and quantified through experimental and controlled actuation of pressure pulse generator 175 in a variety of wellbore types and geometries. Provided a sufficiently large sampling is obtained, a statistically significant criterion may be established for particular types of wells and operating conditions (such as altitude, temperature, and the physical properties of the wellbore fluid column). Preferably, a variety of operating criteria are established for different well types and operating conditions. If remote actuation is desired in extremely cold operations in particular well configurations and geometries, the thresholds which abide for other different wells and operating conditions may not apply. Therefore, a routine is established which allows the operator to independently set the operating thresholds for pressure pulse generator 175. This routine is depicted in broad flowchart form in FIG. 32. The process starts at software block 3054, and continues at software block 3056, wherein data processing system 3010 queries the user for operating criteria for acoustic transmissions, for the particular environment and well type. Then, in accordance with software block 3058, data processing system 3010 records the operator criteria, and the process ends in software block 3060.

Figure 33:
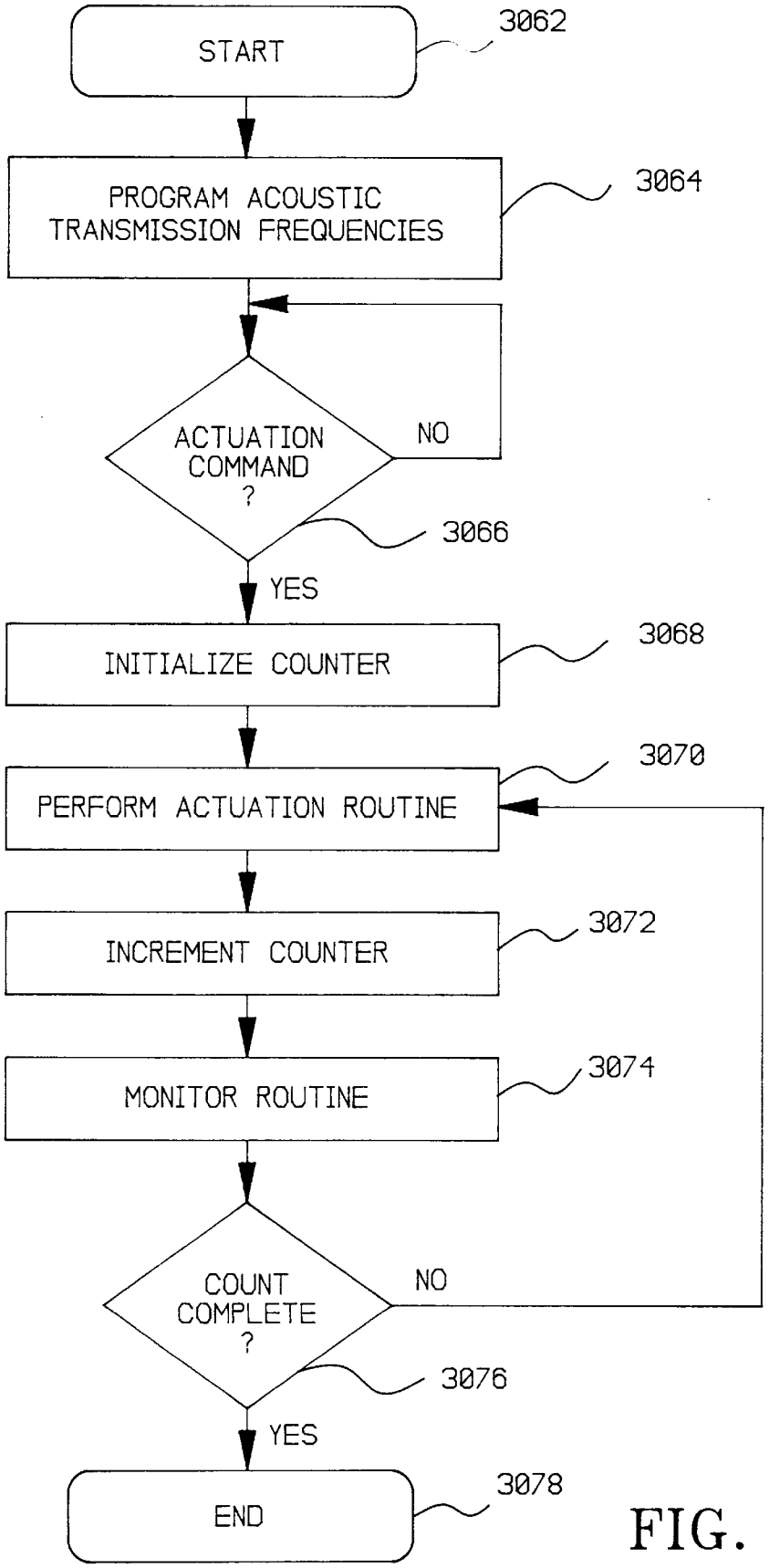

The overall operation of computer control of pressure pulse generator 175 is depicted in flowchart form in FIG. 33. The process starts at software block 3062, continues at software block 3064, wherein data processing system 3010 calls the programming routine to allow programming of the acoustic transmission frequencies. Next, in accordance with software block 3066, data processing system 3010 continually monitors for an actuation command which is received from either operator input, or from another programmed subroutine. Once an actuation command is received, the process continues at software block 3068, wherein a counter is initialized. In accordance with software block 3070, data processing system 3010 performs the actuation routine of FIG. 30. Then, a counter is incremented in accordance with software block 3072. Next, a monitor routine is called which analyzes the amplitude, duration, and/or velocity of the acoustic transmissions emanating from pressure pulse generator 175, and compares them to the operator established operating criteria. In the event that one or more operating criteria are violated, the operator is alerted through prompts provided by data processing system 3010. Next, in accordance with software block 3076, data processing system 3010 examines the count to determine whether a predefined number of actuation operations have been completed; if not, the process returns to software block 3070; if so, the process continues at software block 3078 by ending the routine.

6. PRESSURE-TRANSDUCER TYPE SENSOR

Figure 4A:
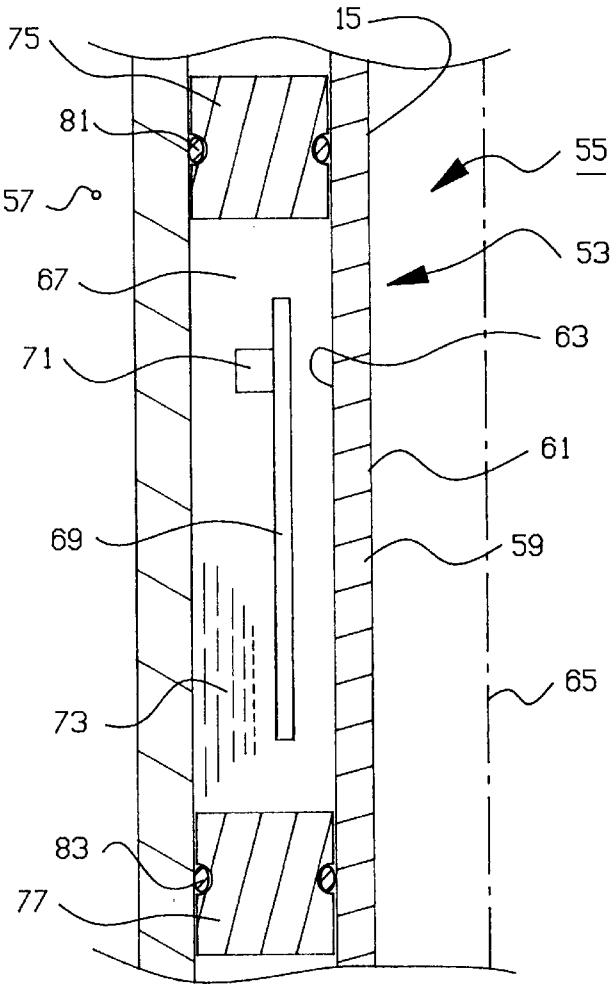
FIGS. 4A and 4B are simplified one-quarter longitudinal section views of a pressure-transducer type reception apparatus, in accordance with one embodiment of the present invention, for detecting rapid changes in fluid pressure amplitude or acoustic pulses in a wellbore fluid column which serves as a communication channel.
Figure 4B:
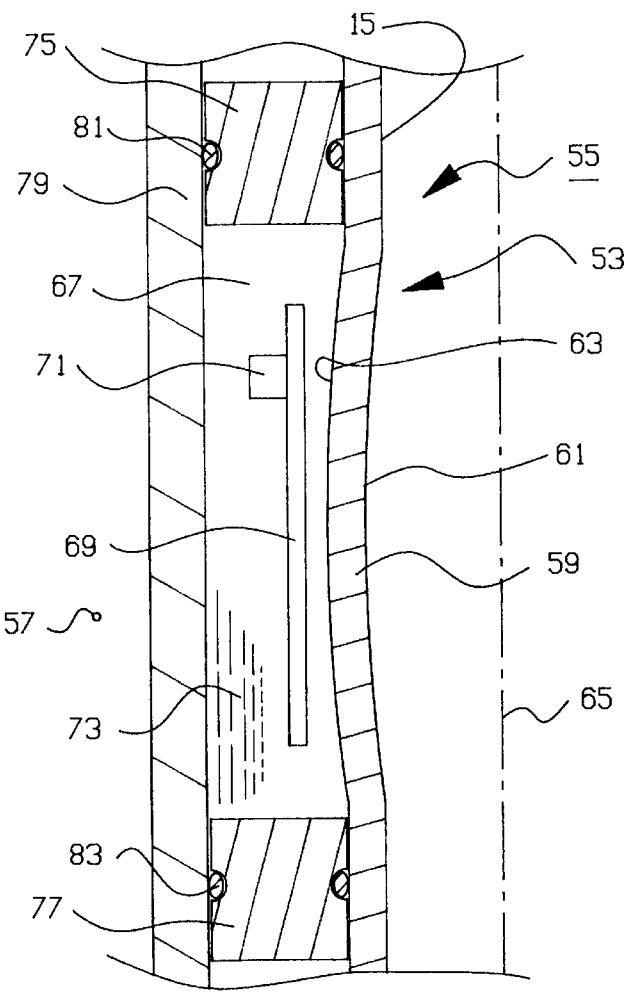

FIGS. 4A and 4B are detail views of reception apparatus 53 of wellbore communication apparatus 11, depicted in fragmentary longitudinal section view, and in simplified form which may be utilized with either the negative pressure pulse generation technique or the positive pressure pulse generation technique, but which is depicted and described as used in conjunction with the negative pressure pulse generation technique. As is shown, mandrel member 59 helps define central bore 15 in the region of reception apparatus 53. Central axis 65 of fluid column 55 is depicted to provide orientation in these figures.

FIG. 4A depicts reception apparatus 53 when the pressure of fluid column 55 equals the pressure within sensor cavity 67, which is preferably maintained at atmospheric pressure. In contrast, FIG. 4B depicts, in exaggerated form, reception apparatus 53, when the pressure of fluid column 55 is far greater than that of sensor cavity 67. As is shown, mandrel member 59 is elastically deformed radially outward from central axis 65 by the pressure differential between fluid column 55 and sensor cavity 67. As is shown in both FIGS. 4A and 4B, reception apparatus 53 includes sensor cavity 67 which is defined between mandrel member 59, outer mandrel 79, and end pieces 75, 77 which are ring-shaped, and which include O-ring seals 81, 83 to provide a fluid-tight seal at the interface of end piece 75 with mandrel member 59 and outer mandrel 79, and end piece 77 with mandrel member 59 and outer mandrel 79. As is shown, circuit board 69 is disposed within sensor cavity 67. Pressure sensor 71 is coupled to circuit board 69. The electrical components which are disposed within sensor cavity 67 will be discussed in greater detail below. In the preferred embodiment, sensor cavity 67 is completely filled with a substantially incompressible fluid 73. When the rigid mandrel member 59 is elastically deformed by the pressure differential between fluid column 55 and sensor cavity 67, pressure is applied to pressure sensor 71 through the substantially incompressible fluid 73.

In this embodiment, pump 37 (of FIG. 1) and valve assembly 35 (of FIG. 1) are utilized to create and maintain the pressure differential between fluid column 55 and sensor cavity 67. In this embodiment, it is desirable to utilize pump 37 to create a pressure differential between fluid column 55 and sensor cavity 67 which is in the range of 1 pound per square inch to 10 pounds per square inch. Once this pressure differential is obtained, valve assembly 35 is utilized to selectively vent fluid from fluid column 55 to a reservoir at the surface, or more-rarely to annulus 57, in an operator-controlled manner to provide a plurality of sequential rapid changes in the pressure amplitude of fluid column 55 which result in the gradual return of mandrel member 59 from the position shown in FIG. 4B to the position shown in FIG. 4A. Therefore, mandrel member 59 is maximally elastically deformed at the beginning of a transmission of the remote control signal, and returns eventually, to the undeformed condition shown in FIG. 4A. Of course, FIG. 4B is an exaggerated depiction of the elastic deformation of mandrel member 59. Keep in mind that mandrel member 59 is formed of 4140 steel, and has a thickness of approximately 0.4 inches, so the actual elastic deformation of this rigid structural component will be slight. In the preferred embodiment, mandrel member 59 is elastically deformed in the range of 0.001 inches to 0.003 inches, and returns to its undeformed condition as the pressure differential between fluid column 55 and sensor cavity 67 is reduced.

The elastic deformation of mandrel member 59 reduces the volume of sensor cavity 67 which is filled with substantially incompressible fluid 73, such as a light oil. An increase in the volume of sensor cavity 67 results in a decrease in pressure applied through substantially incompressible fluid 73 to pressure sensor 71. A decrease in the volume of sensor cavity 67 results in an increase in pressure applied through substantially incompressible fluid 73 to pressure sensor 71. In this embodiment, pressure sensor 71 comprises a Model No. SX010 pressure transducer, manufactured by SenSym of California. Also, in this embodiment, the substantially incompressible fluid comprises Silicone oil, or any similar noncorrosive, electrically-inert fluid.

In this embodiment it is not the pressure amplitude of fluid column 55 which is important; rather, it is the change in the pressure amplitude which is detected by receiver apparatus 53, ensuring that the receiver apparatus 53 is substantially unaffected by slow changes in the amplitude of the pressure exerted by fluid column 55 on mandrel member 59. This is a desirable result, since many conventional wellbore operations require that the pressure within fluid column 55 be altered with respect to time to achieve some other engineering objectives. A pressure threshold is provided, below which reception apparatus 53 is substantially insensitive to accidental, ambient, or unintentional changes in the pressure of fluid column 55, so the accidental creation of a control signal is unlikely.

Figure 5A:
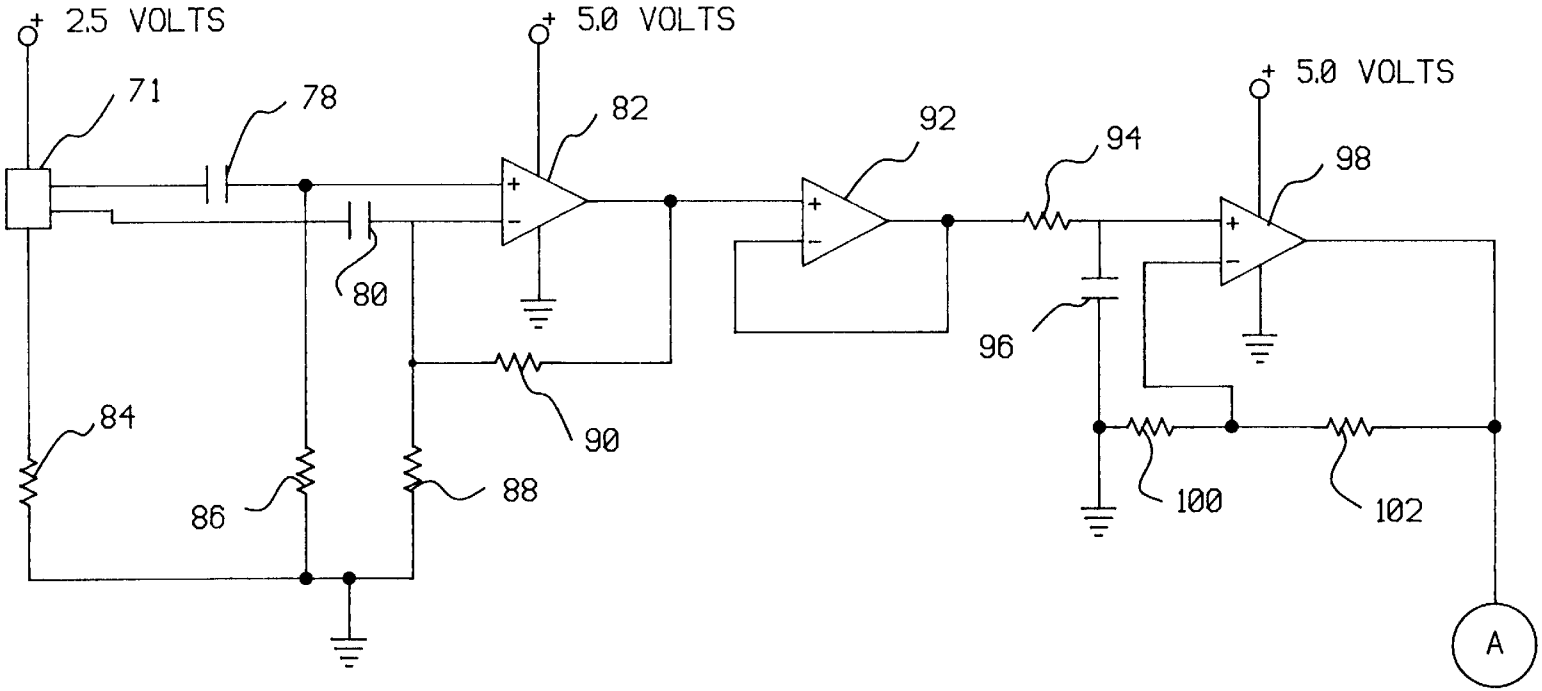
FIGS. 5A and 5B are an electrical schematic depiction of components utilized to perform signal conditioning operations upon the output of the pressure-transducer type reception apparatus depicted in FIGS. 4A and 4B.
Figure 5B:
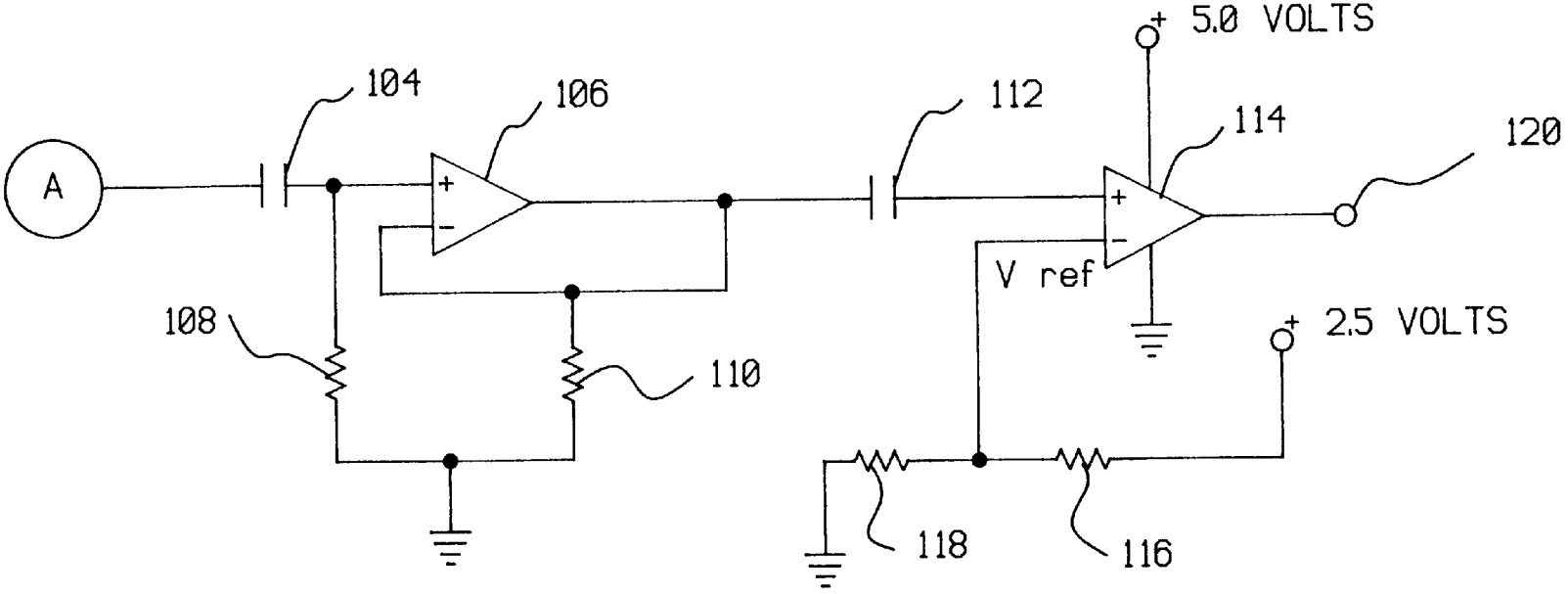

FIGS. 5A and 5B are an electrical schematic depiction of components utilized to perform signal conditioning operations upon the output of pressure sensor 71. Pressure sensor 71 develops as an output a differential voltage. The voltage at one output terminal is supplied through the integrating R-C circuit composed of capacitor 78 and resistor 86 to the non-inverting input of operational amplifier 82, while the voltage at the other output terminal of pressure transducer 71 is supplied through integrating R-C circuit composed of capacitor 80 and resistor 88 to the inverting input of operational amplifier 82. Feedback resistor 80 is supplied between the inverting input of operational amplifier 82 and the output of operational amplifier 82. In this configuration, operational amplifier 82 is performing the operation of an alternating current, differential voltage amplifier. The gain of this differential voltage amplifier is established by the resistor value selected for resistors 88, 90. Preferably a gain of 500 is established by this circuit. The output of operational amplifier 82 is supplied to the non-inverting input of operational amplifier 92, which is operated as a buffer.

The output of operational amplifier 92 is supplied through resistor 94 to the non-inverting input of operational amplifier 98. Capacitor 96 is coupled between the non-inverting input of operational amplifier 98 and ground, while resistor 100 is coupled between the inverting input of operational amplifier 98 and ground, and resistor 102 is coupled between the inverting input of operational amplifier 98 and the output of operational amplifier 98. In this configuration, operational amplifier 98 is operated as a single pole, low pass filter. The cut-off frequency of this low pass filter is established by the values of resistor 94 and capacitor 96. Preferably, the cut-off frequency for this low pass filter is 2 Hertz.

The output of operational amplifier 98 is provided, through capacitor 104, to the non-inverting input of operational amplifier 106. Resistor 108 is coupled between the non-inverting input of operational amplifier 106 and ground, while resistor 110 is coupled between the inverting input of operational amplifier 106 and ground. In this configuration, operational amplifier 106 is performing the operations of a high-pass filter. The cut-off frequency for this high pass filter is preferably 1 Hertz, and is established by the values selected for capacitor 104 and resistor 108.

The output of operational amplifier 106 is supplied through capacitor 112 to the non-inverting input of operational amplifier 114. Capacitor 112 AC-couples operational amplifier 106 to operational amplifier 114. Therefore, no DC component is passed to operational amplifier 114. The inverting input of operational amplifier 114 is coupled to the voltage divider established by resistors 116, 118. In this configuration, operational amplifier 114 is operating as a positive voltage level detector. As such, the output of operational amplifier 114 remains low until a voltage is supplied to the non-inverting input of operational amplifier 114 which exceeds the positive voltage ($V_{ref}$) which is applied to the inverting input of operational amplifier 114. Once the voltage at the non-inverting input exceeds the voltage applied to the inverting input, the output of operational amplifier 114 switches from low to high. Preferably, the output of operational amplifier 114 is applied through terminal 120 to a memory device, such as a flip-flop (not depicted), but it may be applied directly to an input terminal of a pulse counting circuit which will be described in greater detail below.

7. THE STRAIN GAGE TYPE SENSOR

Figure 6:
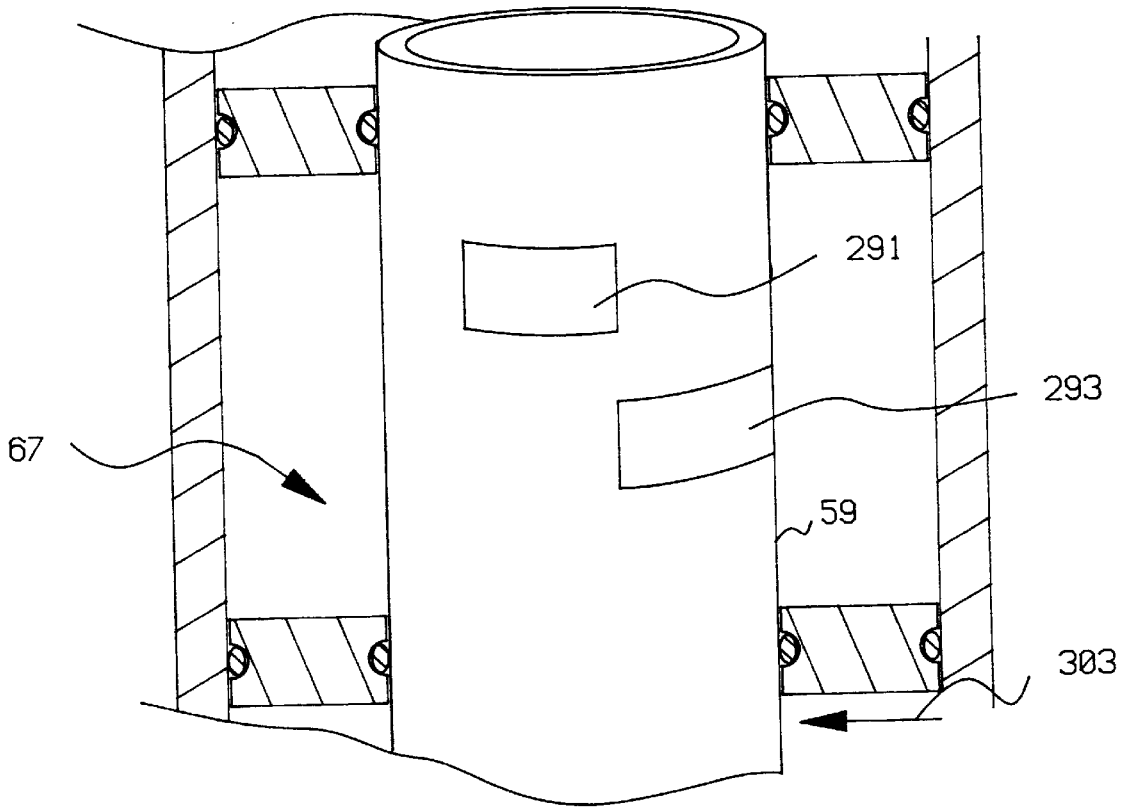
FIG. 6 is a simplified partial longitudinal section views of a strain-gage type reception apparatus, in accordance with another embodiment of the present invention, for sensing rapid changes in fluid pressure amplitude or acoustic pulses in the fluid column which serves as a communication channel.

The strain gage technique, which is an alternative to the pressure transducer technique, is depicted in simplified form in FIG. 6. The strain gage technique requires the utilization of one or more strain gage sensors to detect circumferential elastic deformation of central bore 15 of tubular member 19. FIG. 6 depicts the placement of tangential strain sensor elements 291, 293. As shown, tangential strain sensor elements 291, 293 are placed substantially traverse to the longitudinal axis 299 of mandrel member 59.

The magnitude of the tangential strain detected by strain sensor elements 291, 293 is of little importance; the proposed product utilizes a system which monitors only the rate of change in pressure amplitude as compared to a pressure amplitude threshold to detect acoustic pulses. Accordingly, the placement of tangential strain sensor elements 291, 293 relative to tubular member 19 is of little importance. As is shown in FIG. 6, tangential strain sensor element 293 may be displaced from tangential strain sensor element 291 by fifteen to thirty degrees. In alternative embodiments, the sensors could be displaced one hundred and eighty degrees. Their physical proximity to one another is of little importance. Only their ability to detect circumferential elastic deformation matters. The tangential strain sensor elements 291, 293 need not be calibrated or temperature compensated, since the reception apparatus monitors only for rapid rates of change in fluid pressure amplitude, and is not the least concerned with the magnitudes of fluid pressure within the fluid column.

Figure 7:
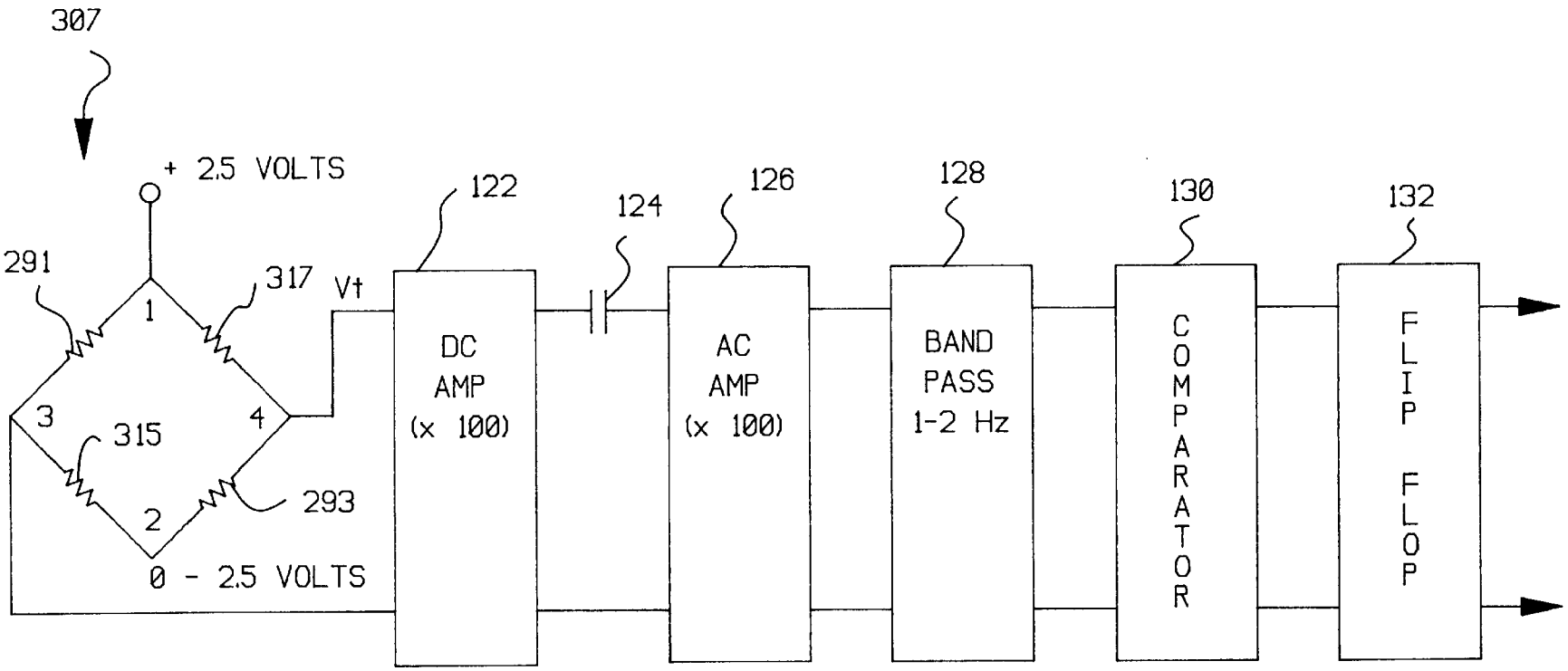
FIG. 7 is an electrical schematic representation of the strain-gage type reception apparatus, which is depicted in FIG. 6, and includes a block diagram view of signal conditioning which is performed upon the output of the strain-gage type reception apparatus when it is utilized to sense rapid changes in fluid pressure amplitude or acoustic pulses in the fluid column which serves as a communication channel.

FIG. 7 is an electrical schematic view of an electrical circuit, which includes tangential bridge circuit 307. Tangential bridge circuit 307 includes four elements, two of which are used to detect stress, and two of which are used to complete the bridge circuit. Tangential bridge circuit 307 includes tangential strain sensor element 291 and tangential strain sensor element 293. In tangential half-bridge 307, tangential strain sensor 291 and tangential strain sensor 293 are placed opposite from one another in a "half-bridge" arrangement. Bridge completion resistors 315, 317 are placed in the remaining two legs of a full bridge circuit.

In FIG. 7, tangential strain sensors 291, 293 are represented as electrical resistive components. In the preferred embodiment, tangential strain sensor elements comprise Bonded Foil Strain Gages, manufactured by Micro Measurements, of Raleigh, N.C., further identified as Model No. SK-06-250BF-10c, with each element providing 1,000 ohms of electrical resistance to current flow. Likewise, bridge completion elements 315, 317 are depicted as electrical resistive elements. As shown, tangential strain sensor element 291 is coupled between nodes 1 and 3 of tangential bridge circuit 307. Tangential strain sensor 293 is coupled between nodes 2 and 4 of tangential bridge circuit 307. Bridge completion resistor 315 is coupled between nodes 2 and 3 of tangential bridge circuit 307. Bridge completion resistor 317 is coupled between nodes 1 and 4 of tangential bridge circuit 307. Positive 2.5 volts is applied to node 1 of tangential bridge circuit 307. Negative 2.5 volts is applied to node 2 of tangential bridge circuit 307.

Bridge completion resistors 315, 317 are not coupled to a conduit member 209. In fact, bridge completion elements 315, 317 do not sense any mechanical strain whatsoever. Instead, they are placed on carrier member 319 (not depicted) which is disposed within sensor cavity 67, and not subjected to any mechanical stress. They merely complete the bridge circuit.

The "active" tangential strain sensor elements 291, 293 will change electrical resistance in response to mechanical strain. Tangential strain sensor elements 291, 293, are bonded to the exterior surface of mandrel member 59, and experience stain when conduit member 209 is subjected to tangential stress. The voltage applied to nodes 1 and 4 cause current to flow in tangential bridge circuit 307. The resulting voltage developed between nodes 3 and 4 of tangential bridge circuit 307 is represented in FIG. 7 by $V_t$, which identifies the voltage representative of the tangential strain detected by tangential bridge circuit 307.

The voltage $V_t$ which is representative of the tangential strain detected by tangential bridge circuit 307 is then subjected to signal conditioning operations which are depicted in block diagram form in FIG. 7. In accordance with signal conditioning block 122, the voltage $V_t$, is subjected to DC amplification, preferably of one hundred gain. Capacitor 124 is utilized to AC couple signal conditioning block 122 with signal conditioning block 126. In signal conditioning block 126, the AC component is subjected to AC amplification of one hundred gain. The signal is then passed to signal conditioning block 128, which performs a bandpass operation to allow for the passage of signals in the range of one to two Hertz, but which blocks all other frequency components of the signal. The signal component in the range of one to two Hertz is then passed to signal processing block 130 which performs a comparison operation, preferably to identify rapid rates of change in the pressure amplitude which are greater than two hundred and fifty pounds per square inch per second.

The voltage amplitudes of various rate changes can be determined empirically through experimentation, by utilizing a test fixture to simulate a borehole and stepping through a plurality of known fluid pressure rate changes to determine corresponding voltage level of $V_{ref}$ for comparator 130. Essentially, signal processing block 130 operates to compare the voltage amplitude which is provided as an output from signal conditioning block 128 to a selected voltage threshold established by $V_{ref}$, which is representative of a rate of change which is equivalent to two hundred and fifty pounds per square inch per second. Amplitudes which exceed the reference voltage are determined to exceed the rate of change of two hundred and fifty pounds per square inch per second, and operate to switch the output of the comparator from a normally-low condition to a high condition. The output of signal processing block 130 is provided to signal conditioning block 132, which is preferably a flip-flop, which includes one or more output pins which change state as a result of detection of a transition at the output of signal conditioning block 130. The particular components of the signal conditioning operations will be discussed in greater detail herebelow in connection with FIGS. 8A and 8B.

8. THE PRESSURE CHANGE DETECTION CIRCUIT

Figure 8A:
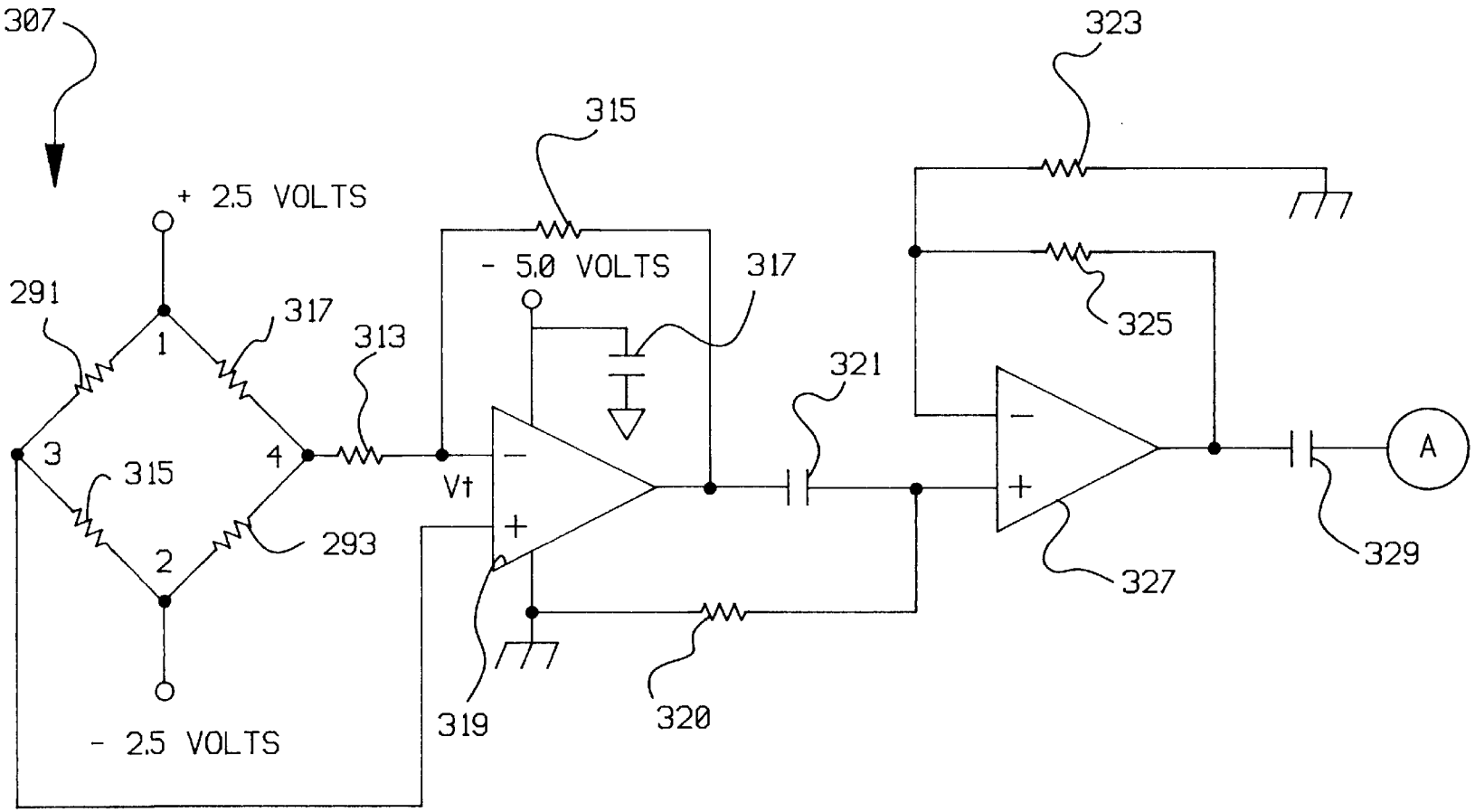
FIGS. 8A and 8B are an electrical schematic of the pressure change detection circuit.
Figure 8B:
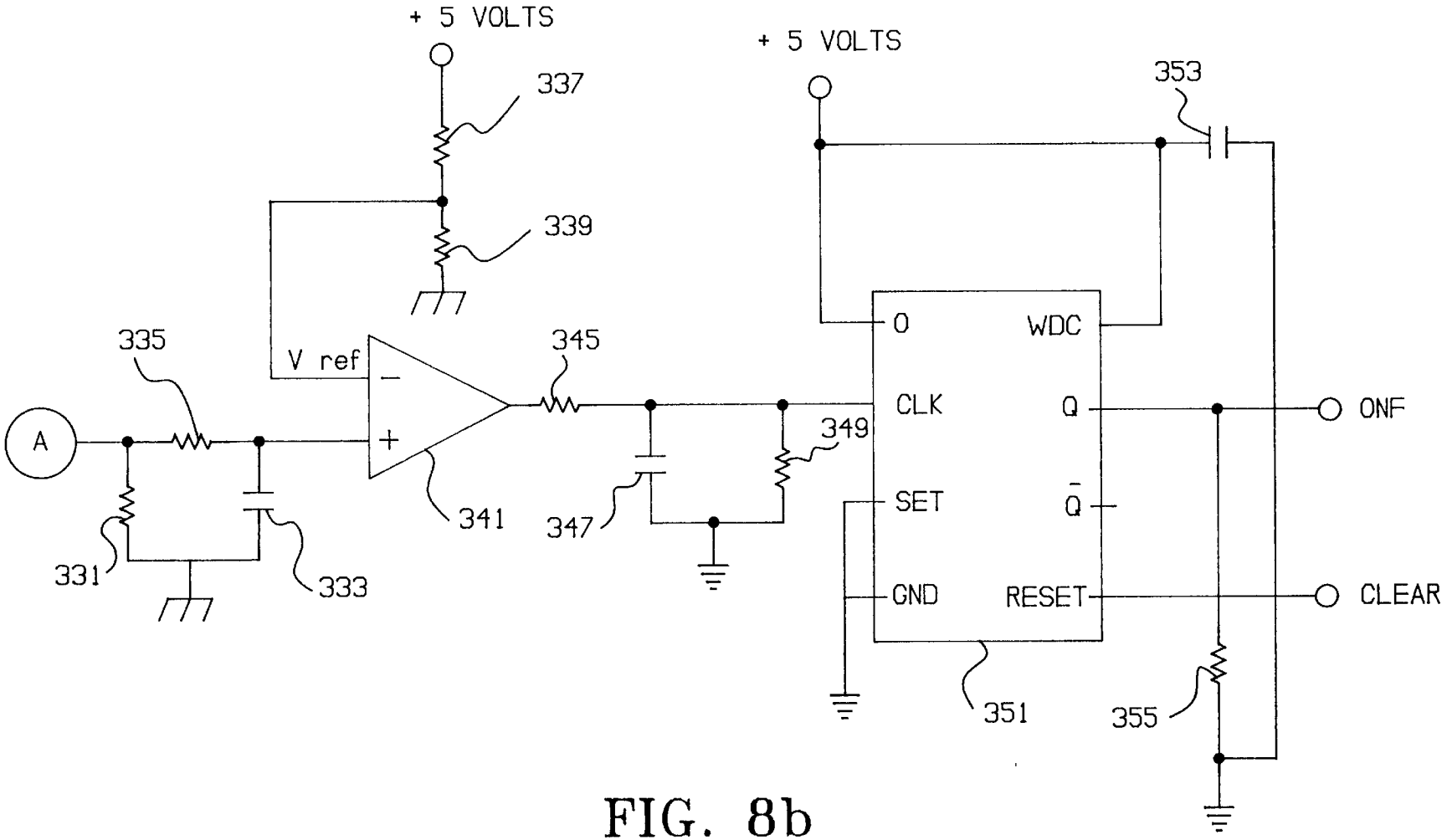

FIGS. 8A and 8B are an electrical schematic depiction of pressure change detection circuit coupled to tangential bridge circuit 307, which was discussed in considerable detail above in connection with FIG. 7. As is shown in FIGS. 8A and 8B, $V_t$, the voltage which is representative of the tangential strain, is applied between the inverting and non-inverting inputs of operational amplifier 319, which is operated as a differential DC amplifier, with a gain of approximately 100, as determined by the selection of the resistance values for resistor 313, and resistor 315. The output of operational amplifier 319 is supplied through capacitor 321 to the non-inverting input of operational amplifier 327. Capacitor 321 and resistor 320 provide AC coupling between operational amplifier 319 and 327, to allow only the alternating current components of the output of operational amplifier 319 to pass to operational amplifier 327. Operational amplifier 327 operates as an AC amplifier to provide a gain of approximately 100, as determined by selection of the resistance values for resistors 323, 325. The output of operational amplifier 327 is supplied through a bandpass filter established by capacitor 329, resistor 331, resistor 335, and capacitor 333, to the non-inverting input of operational amplifier 341. The band-pass filter established by the capacitive and resistive components allows the passage of frequencies of 1 to 2 Hertz only, and blocks all other frequency components of the output of operational amplifier 327.

9. FREQUENCY DETERMINATION CIRCUIT

Figure 9:
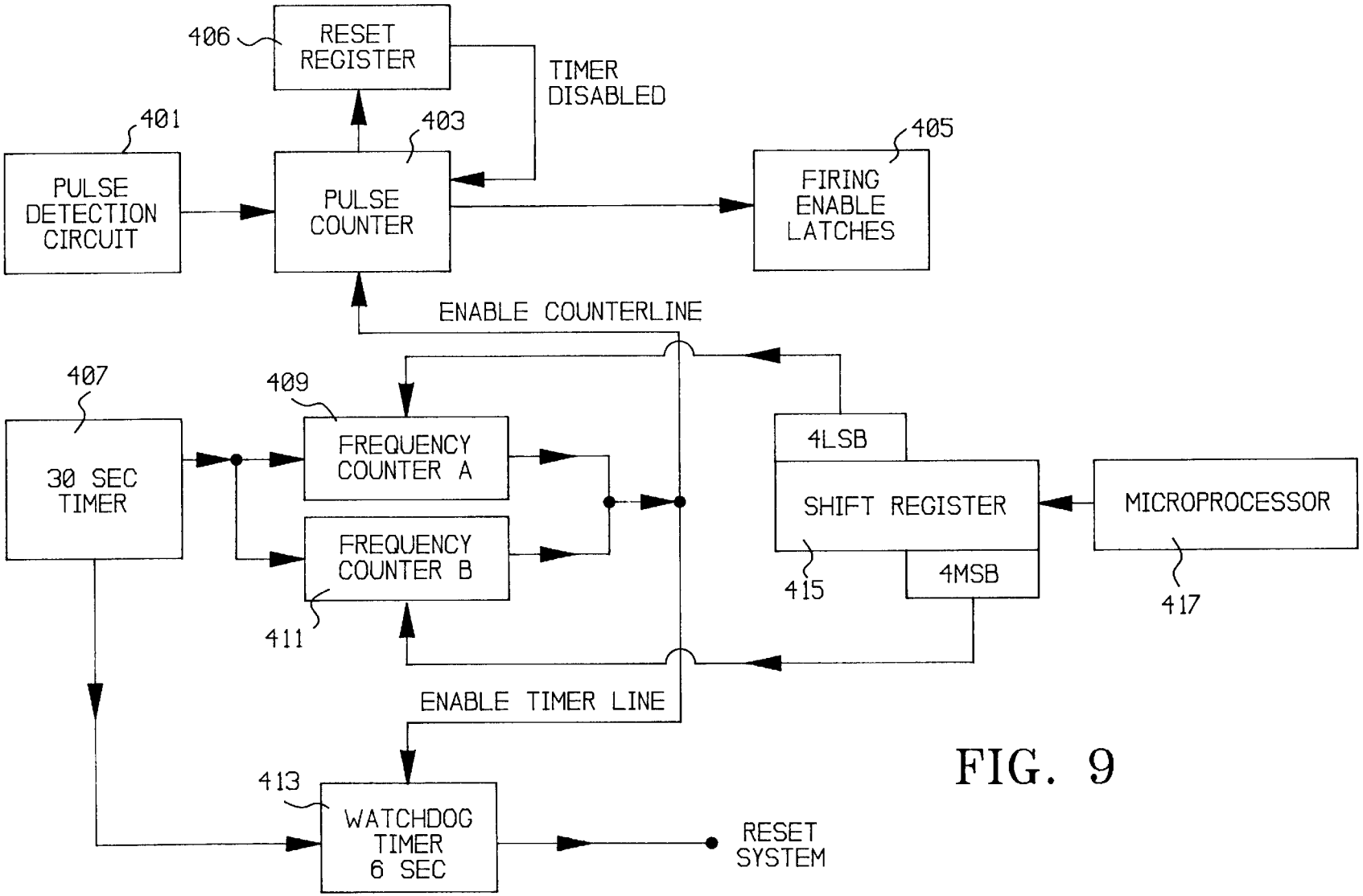
FIG. 9 is a block diagram of the frequency detection circuit.

FIG. 9 is a block diagram representation of the digital circuitry which processes the pulses detected by pulse detection circuit 401 (which corresponds to the pressure change detection circuit of FIGS. 8A and 8B. The detected pulses are passed from circuit pulse detection circuit 401 to pulse counter 403. Those pulses are counted if, and only if, an enable signal is provided on the ENABLE COUNTER line. The ENABLE COUNTER line applies an enable signal to pulse counter 403 at a predetermined frequency. The ENABLE COUNTER line provides the enable signal for only six seconds. This renders the pulse counter 403 inactive for most of the operating time, and active for only six seconds at a predetermined frequency.

In the proposed product, the predetermined frequencies which may be utilized to actuate a particular downhole tool are multiples of thirty second intervals, as defined by thirty second timer 407. In other words, the actuation frequencies that are available for use are multiples of thirty seconds. An actuation frequency which utilizes a multiple of 1 will result in enablement of pulse counter 403 for six seconds every thirty seconds, resulting in an actuation frequency of 1/30 of one Hertz. If, and only if, an acoustic transmission is detected which has this same frequency will a wellbore tool be actuated. An actuation frequency which utilizes a multiple of 2 will result in enablement of pulse counter 403 for six seconds every sixty seconds, resulting in an actuation frequency of 1/60 of one Hertz. If, and only if, an acoustic transmission is detected by pulse detection circuit 401 and pulse counter 403 which has this particular frequency will a wellbore tool be actuated. An actuation frequency which utilizes a multiple of 3 will result in enablement of pulse counter 403 for six seconds every ninety seconds, resulting in an actuation frequency of 1/90 of one Hertz. If, and only if, an acoustic transmission is detected by pulse detection circuit 401 and pulse counter 403 which has this particular frequency will a wellbore tool be actuated.

Thirty second timer 407 provides its output to frequency counter A 409, frequency counter B 411, and watch dog timer 413. Frequency counter A 409 and frequency counter B 411 are utilized to allow each particular wellbore tool to be remotely actuated utilizing two different acoustic pulse frequencies. The binary value of frequency counter A 409 establishes the particular multiple of thirty seconds which defines a first actuation frequency (1/30 of 1 Hertz; 1/60 of 1 Hertz; 1/90 of 1 Hertz, etc.). The binary value loaded into frequency counter B 411 is utilized to establish the multiple of thirty seconds which defines a second frequency of acoustic pulse transmission (1/30 of 1 Hertz; 1/60 of 1 Hertz; 1/90 of 1 Hertz, etc.). Preferably, pulse counter 403 may be jumper-configured to allow it to be either responsive to a single acoustic transmission frequency or to two consecutive acoustic transmission frequencies. The values of frequency counter A 409 and frequency counter B 411 are determined by an eight bit number which is loaded by microprocessor 417 into shift register 415. The four least significant bits of shift register 415 are loaded to frequency counter A 409, while the four most significant bits of shift register 415 are loaded into frequency counter B 411. Microprocessor 417 interacts only with shift register 415, and only for the purpose of loading the binary values to shift register 415, which are then transferred to frequency counter A 409 and frequency counter B 411.

Frequency counter A 409 receives as an input the thirty second timer pulse from thirty second timer 407, and produces as an output an enable signal which is simultaneously applied to ENABLE COUNTER line and ENABLE TIMER line. Frequency counter A 409 produces an enable signal at a multiple of the thirty second interval which is defined by the binary value of the four bit nibble loaded from shift register 415 to frequency counter A 409. Frequency counter A 409 only provides the enable signal for the first four pulses; thereafter, frequency counter B 411 provides an enable signal to ENABLE COUNTER line and ENABLE TIMER line at a multiple of the thirty second interval, depending upon the binary value of the four bit nibble loaded from shift register 415 to frequency counter B 411. Thus, frequency counter B 411 controls the monitoring of the next four possible pulses. In this manner, the first four detected acoustic pulses may define a first particular frequency, while the next four detected acoustic pulses may define a second, different, acoustic transmission frequency. In this manner, two-hundred fifty-six possible actuation signals may be provided. This allows for the utilization of a wide variety of remotely-actuated wellbore tools in a single string. For both the first four and last four actuation pulses, watch dog timer 413 operates to automatically reset the entire frequency monitoring system should an actuation pulse fail to be detected during the six second window of simultaneous enablement of pulse counter 403 and watch dog timer 413.

In the preferred embodiment of the present invention, the frequency determination circuit further includes a reset register 406 which receives a signal from pulse counter 403 when a pulse has been detected. Reset register 406 responds to the detection of a pulse by pulse counter 403 by applying a timed disable signal to pulse counter 403. This renders pulse counter 403 insensitive to echos of the acoustic pulse just detected. Bear in mind that the fluid column in the wellbore is generally a relatively closed fluid body, and that an acoustic pulse may reverberate or echo in the fluid column for a brief interval after transmission, as it bounces off of the wellbore bottom and the wellhead. Additionally, the acoustic pulse may reflect or echo off of wellbore tools or wellbore structures which are intermediate the wellhead and wellbore bottom, so a plurality of different reflective surfaces exist which may set up a series of reverberations of the acoustic transmission which generally subside or diminish in amplitude relatively quickly. Application of a timed disable signal to pulse counter 403 ensures that the echos or reverberations of the acoustic transmission are not erroneously detected by pulse counter 403. Preferably, the duration of the time disable signal is in the range of ten to fifteen seconds. This timed disable interval may be set for shorter or longer periods depending upon empirical evidence developed through prolonged use of the apparatus of the present invention.

Figure 10:
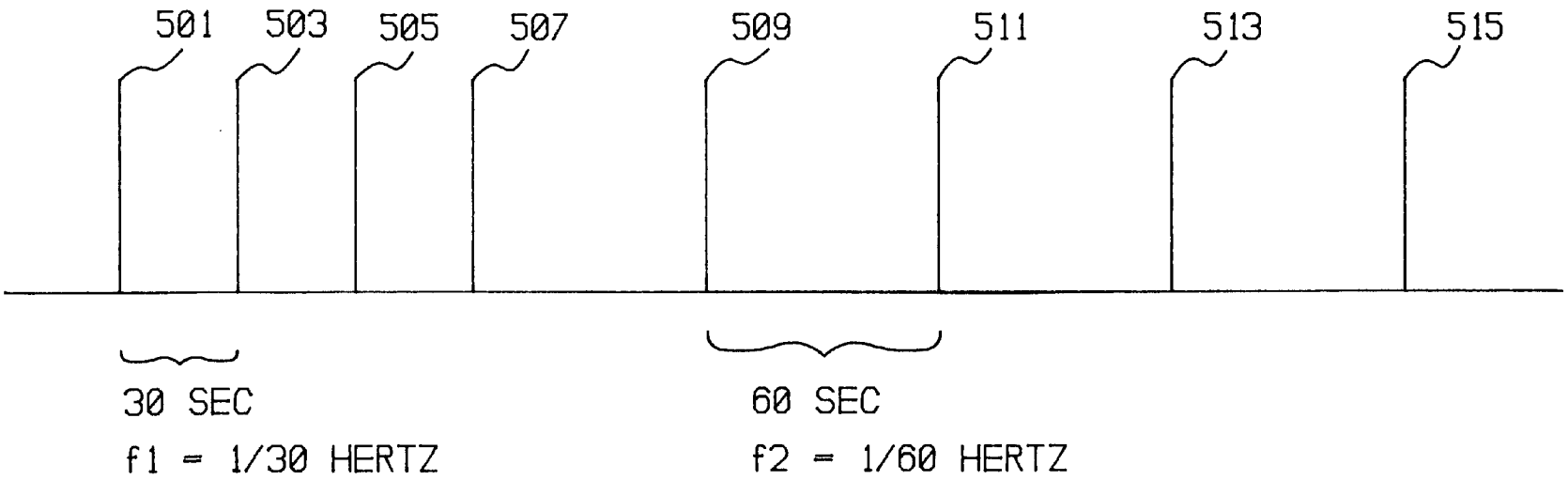
FIG. 10 is a graphical depiction of the exemplary acoustic transmissions detected by the frequency detection circuit.

FIG. 10 herebelow depicts a two frequency actuation transmission. The first four acoustic pulses are separated by thirty seconds (which means that the binary value of 0001 has been loaded into frequency counter A 409). This results in a first actuation frequency of 1/30 of one Hertz. The next four acoustic pulses are separated by sixty seconds (which means that the binary value of 0010 has been loaded into frequency counter B 411). This results in a second actuation frequency of 1/60 of one Hertz. If microprocessor 417 has loaded the binary word "00100001" into shift register 415, then the four least significant bits (0001) have been loaded into frequency counter A 409 and the four most significant bits (0010) have been loaded into frequency counter B 411, making the particular wellbore tool responsive to the consecutive acoustic transmission frequencies of 1/30 hertz (for the first four pulses) and 1/60 Hertz (for the next four pulses).

Figure 11:
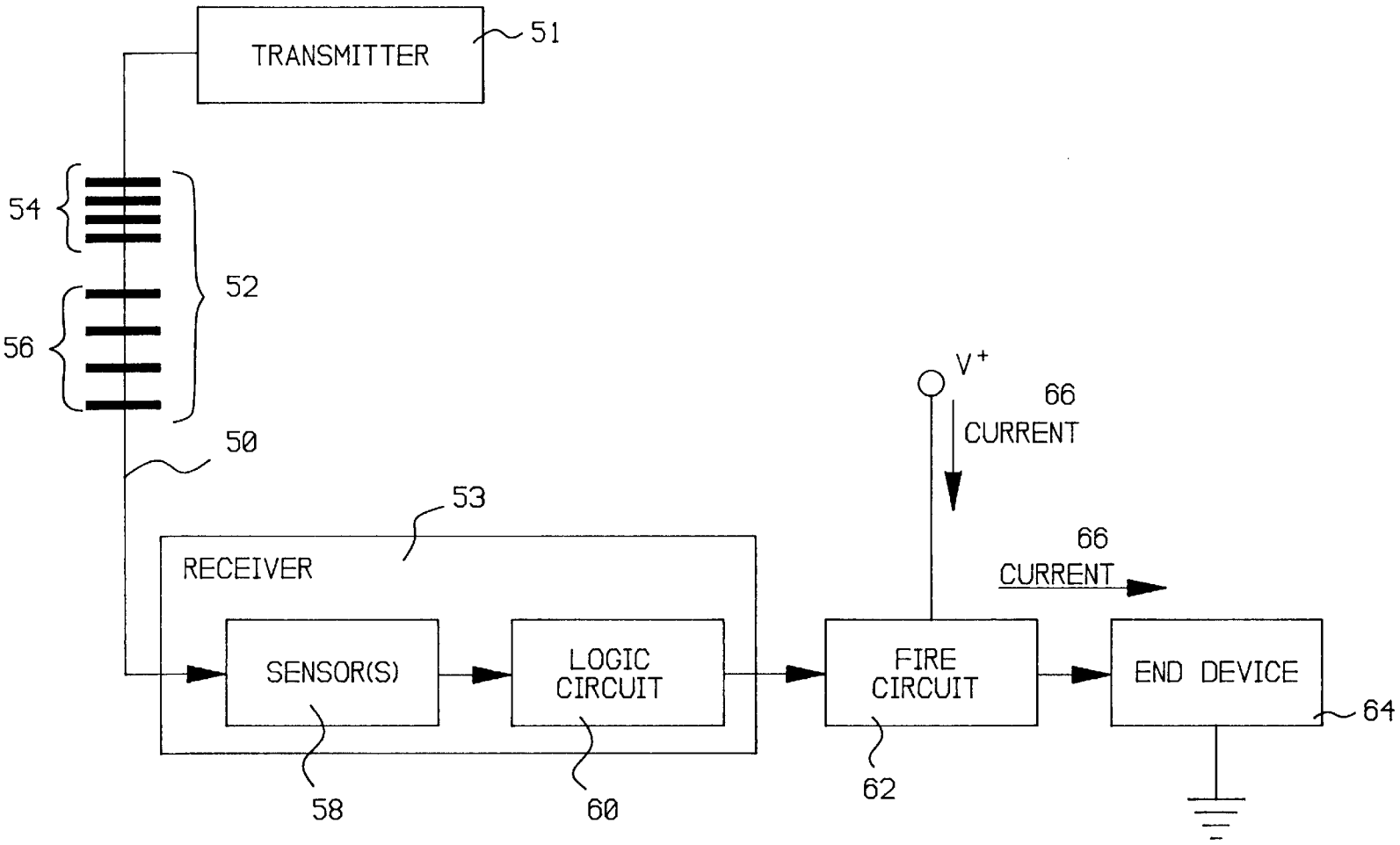
FIG. 11 is a pictorial representation of the overall operation of a remote control system which utilizes the frequency detection circuit of FIG. 9.

The operation of the communication system of the present invention is depicted in simplified form in the block diagram view of FIG. 11. As is shown, transmission apparatus 51 is remotely located from reception apparatus 53. Transmission apparatus 51 is utilized to generate a command signal 52 in a communication channel 50. Preferably, the command signal 52 is composed of acoustic pulses which define one or more acoustic transmission frequencies. In the embodiment depicted in FIG. 11, command signal 52 includes a first frequency component 54 which defines a relatively high frequency signal, and a second frequency component 56 which defines a relatively low frequency transmission. Sensors 58 within receiver 53 are utilized to detect the acoustic pulses, and transmit electrical signals representative thereof to logic circuit 60. Logic circuit 60 provides an actuation signal to fire circuit 62, if and only if, the one or more acoustic transmission frequencies correspond to one or more predetermined acoustic transmission frequencies which are programmed into logic circuit 60. Once a match is obtained between the detected acoustic transmissions and the predetermined frequencies, an actuation signal is provided to fire circuit 62. Preferably, fire circuit 62 comprises a switching circuit which impedes the flow of current 66 from voltage source V+ to ground, until an actuation signal is provided by logic circuit 60. Fire circuit, when activated, allows current 66 to pass to end device 64. Preferably, end device 64 is an electrically-actuated wellbore tool.

10. THE PROGRAMMING TERMINAL

Figure 12:
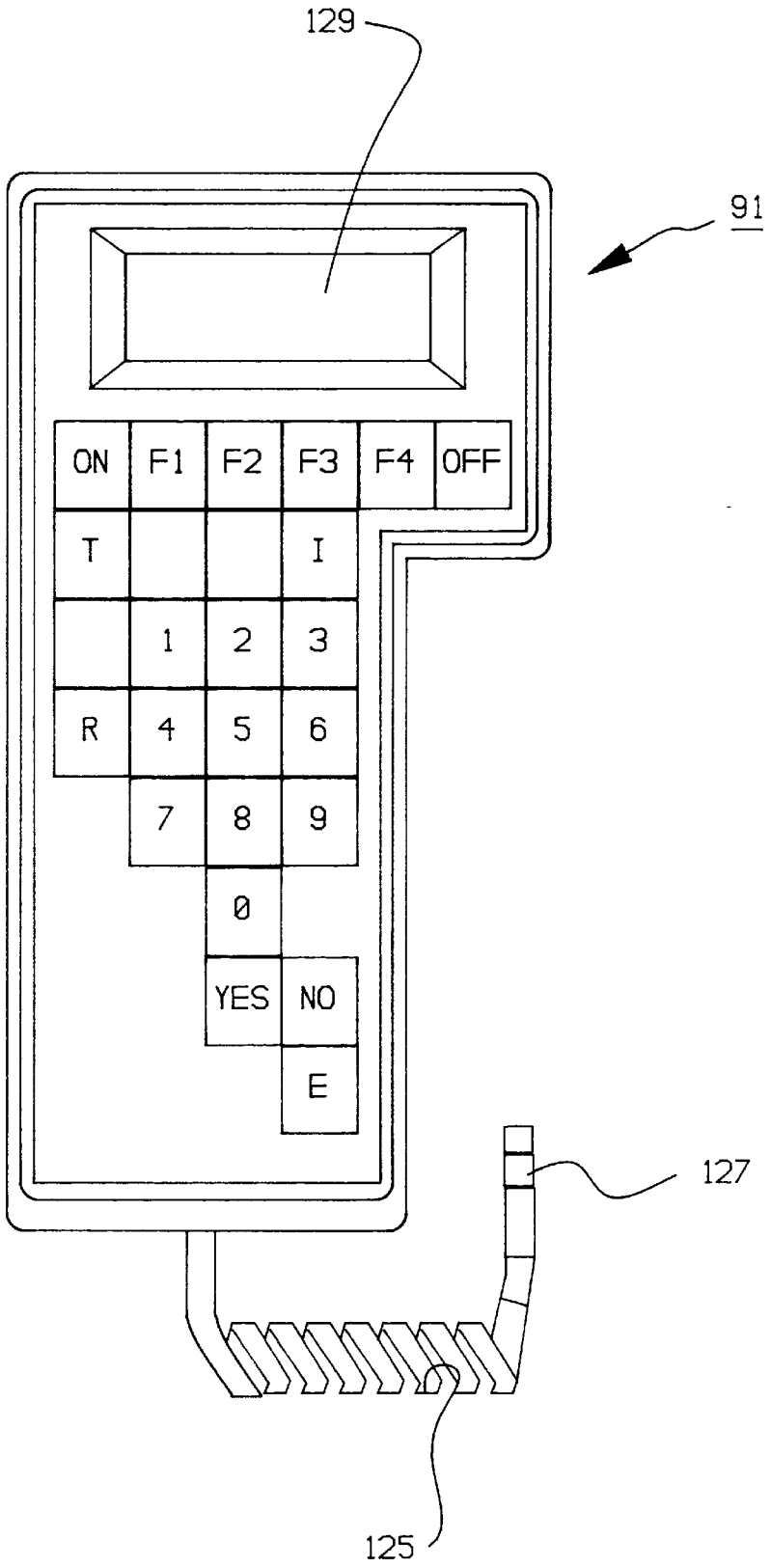
FIG. 12 is a pictorial representation of a programming terminal which is utilized to program the processor of the reception portion the wellbore communication apparatus and FIGS. 13A, 13B, and 13C are examples of the utilization of the display and keyboard to achieve bidirectional communication with the processor of the reception apparatus.

FIG. 12 is a pictorial representation of a programming terminal 91 which is utilized to allow bi-directional communication with microprocessor 417 before reception apparatus 53 is run into position within a wellbore, and is especially useful in programming a particular reception apparatus to be responsive to either one or two particular acoustic transmission frequencies.

In the preferred embodiment of the present invention, programming terminal 91 may be utilized in either (1) a transmitting mode of operation or (2) a receiving mode of operation. In the transmitting mode of operation, programming terminal 91 is utilized to produce a plurality of different ASCII characters. As is shown in FIG. 12, a plurality of dedicated keys are provided with human-readable alphanumeric characters disposed thereon. The depression of a particular key by the human operator will result in the generation of a particular, predetermined ASCII character which is directed through electrical cord 125 and electrically connector 127 to reception apparatus 53. In a receiving mode of operation, programming terminal 91 is utilized to receive ASCII characters from receiver apparatus 53 through electrical cord 125. Programming terminal 91 includes a liquid crystal display (LCD) 129 which is utilized to present human readable alphanumeric text which contains useful information from reception apparatus 53. In the preferred embodiment of the present invention, programming terminal 91 is electrically connected to receiver apparatus 53 only during programming and testing operations. Programming terminal 93 is disconnected from reception apparatus 53 after it has been adequately programmed and tested. Thereafter, reception apparatus 53 is run into a desired location within a wellbore, and requires no further interaction with programming terminal 91 to perform its program functions.

As can be seen from FIG. 12, programming terminal 91 includes a plurality of alphanumeric keys, including: an "ON" key and an "OFF" key which are utilized to turn programming terminal 91 on and off; an initialize key which carries the letter "I" which is utilized to enter a programming mode of operation during which reception apparatus 53 is programmed to respond to one or two particular acoustic pulse transmission frequencies; a test key which carries the character "T" which is utilized to test a variety of electrical characteristics of reception apparatus 53, as will be described herebelow in further detail; a read key which carries the character "R", and which is utilized to read data from reception apparatus 53 to allow confirmation of the programmed content of reception apparatus 53. Keys with the numeric characters 0 through 9 are also provided in programming terminal 91, as well as a "YES" key, a "NO" key, and an enter key which carries the character "E", all of which are utilized to respond to microprocessor generated queries displayed at LCD display 129.

In the preferred embodiment of the present invention, exchanges of information between the human operator and reception apparatus 53 are facilitated by a plurality of automatically generated prompts and operator queries. The "YES" key and the "NO" key can be utilized to confirm or deny the accuracy of a human operator entry at programming terminal 91. For example, if an operator accidentally enters an incorrect value during the programming mode of operation, the user prompt provides an opportunity to correct the error before receiver apparatus 53 is programmed.

Figure 13A:
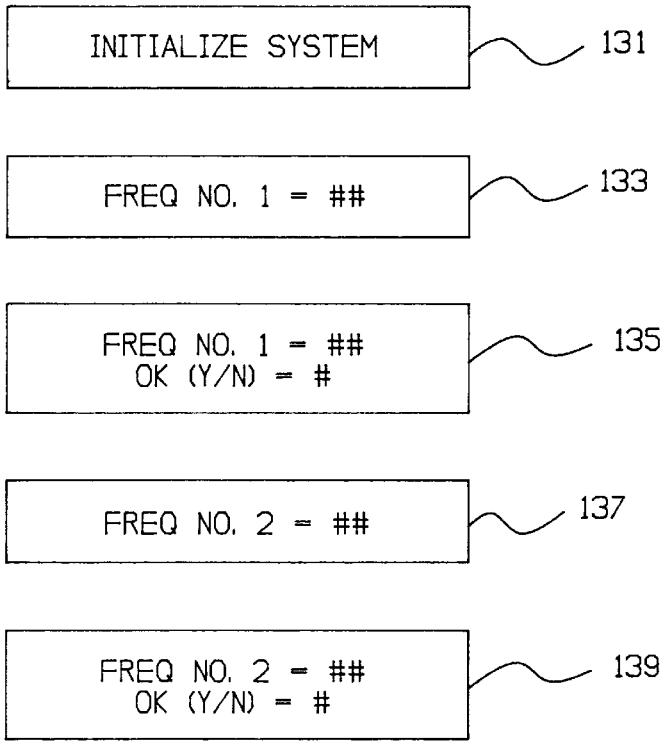
Figure 13B:
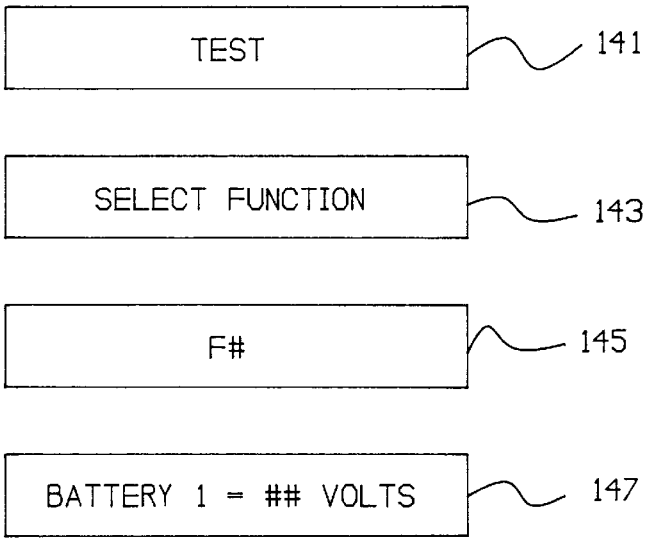
Figure 13C:
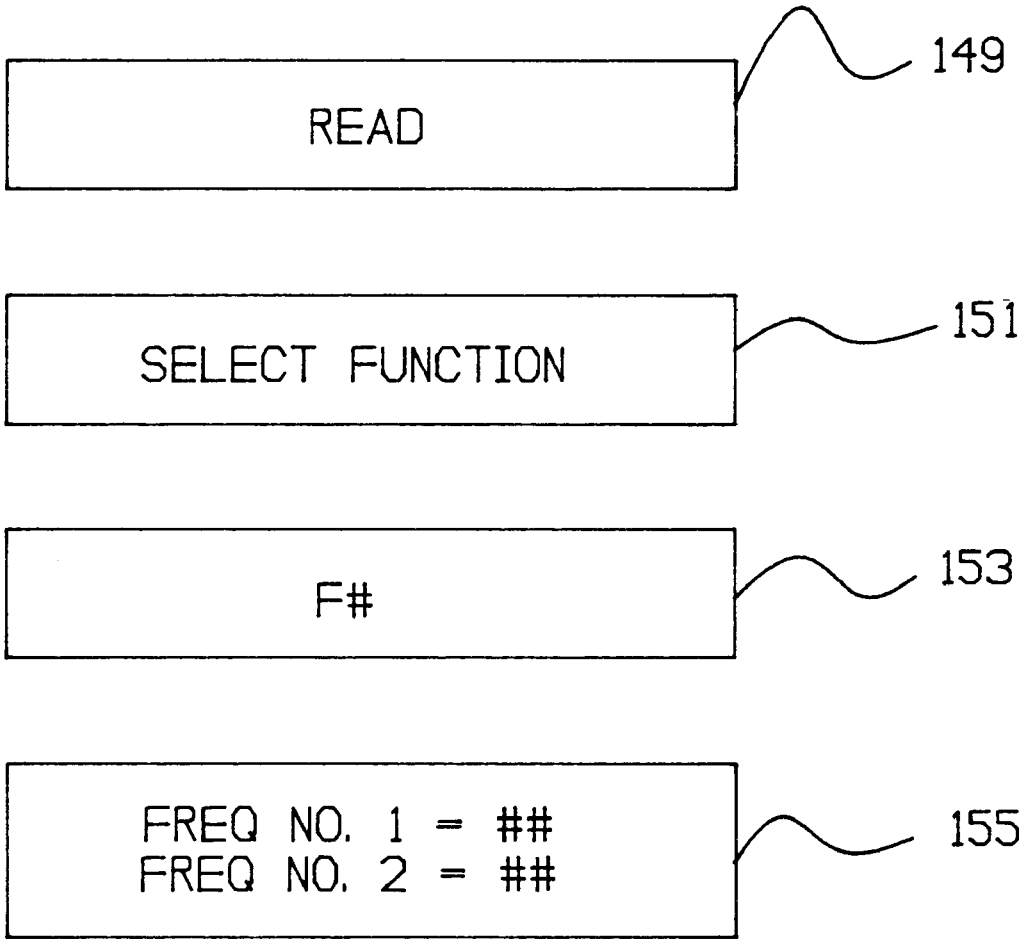

FIGS. 13A, 13B, and 13C provide graphic representation examples of the utilization of programming terminal 91 to program reception apparatus 53, to test particular functions of reception apparatus 53, and to read particular data from programming apparatus 53.

FIG. 13A depicts the alphanumeric characters displayed in LCD display 129 during a programming mode of operation. Once the initialize key is depressed, LCD display 129 displays the message "initialize system" as depicted in block 131. The microprocessor within programming terminal 91 then provides the user prompt which is depicted in block 133 which prompts the user to enter the first acoustic transmission frequency which is identified as "FREQ NO. 1". In accordance with block 135, the user then enters a number from the keypad of programming unit 91, and the LCD display 129 provides an opportunity for the user to delete an incorrect entry and provide a correct entry by prompting "OK (Y/N)", which prompts the user to depress either the "YES" key or the "NO"key. Then, in accordance with block 137, programming terminal 91 prompts the user to enter the second acoustic transmission frequency which is identified as "FREQ NO. 2". The operator should respond by pressing particular ones of the numeric keys in programming terminal 91. In accordance with block 139, programming terminal 91 informs the user of his or her selection and prompts the user to depress the "YES" key or the "NO" key to confirm the accuracy of the entry.

In another embodiment, reception apparatus 53 can be preprogrammed with a plurality of predefined codes each of which is assigned a predetermined identifying numeral, to simplify the programming process. For example, the following identifying numerals can be assigned as follows:

| Identifying Numeral | Transmission Frequency |
|---|---|
| 1 | 1/30 Hertz |
| 2 | 1/60 Hertz |
| 3 | 1/90 Hertz |
| 4 | 1/120 Hertz |
| 5 | 1/150 Hertz |
| 6 | 1/180 Hertz |

FIG. 13B is a representation of a test operation. Alphanumeric display 129 displays the prompt "TEST" in response to the operator selection of the test key. In accordance with block 143, the operator is prompted to select a particular function for which the test is desired. The function keys F1, F2, F3, and F4 are predefined to correspond to a particular functions. In accordance with block 145, the operator selects a particular function. The microprocessor reads the data from reception unit 53 and displays it, in accordance with block 147.

In the preferred embodiment of the present invention, programming terminal 91 will provide the following diagnostic capabilities:

1. it will display the approximate battery life remaining on command from the user;
2. it will display the initialization variables on command from the user;
3. it will conduct an EEPROM Test on command from the user;
4. it will conduct a timer test on command from the user;
5. it will enable any igniter circuits on command from the user;
6. it will conduct a battery load test to verify that the batteries are capable of supplying the necessary current to ignite the actuation system;
7. it will determine if any of the igniters in the actuation system are open;
8. it will display a ROM Check Sum on command from the user; and
9. it will display an EEPROM Check Sum on command from the user.

FIG. 13C is a representation of a read operation, which is initiated by depressing the read key. LCD display 129 displays a prompt to the user that the read mode of operation has been entered, as depicted in block 149. Next, in accordance with block 151, the user is prompted to select a particular function. Once again, the functions keys F1, F2, F3, and F4 are preassigned to particular data which may be accessed through a read operation. The operator enters a particular function, as depicted in block 153. Then, in accordance with block 155, the LCD display provides an alphanumeric representation of the particular data requested by the operator. In the case shown in FIG. 13C, the LCD display 129 displays the first and second acoustic transmission frequencies uniquely associated with a particular reception apparatus. This is depicted in block 155.

In the preferred embodiment of the present invention, programming terminal 91 is a hand-held bar code terminal which is manufactured by Computerwise of Olathe, Kans., and which is further identified by Model No. TTT-00. It may be programmed for particular functions in accordance with instructions provided by the manufacturer. In the present invention, it is customized by the addition of an interface circuit which will be described in detail in FIGS. 14, 15, and 16.

11. OVERVIEW OF THE RECEPTION APPARATUS

Figure 14:
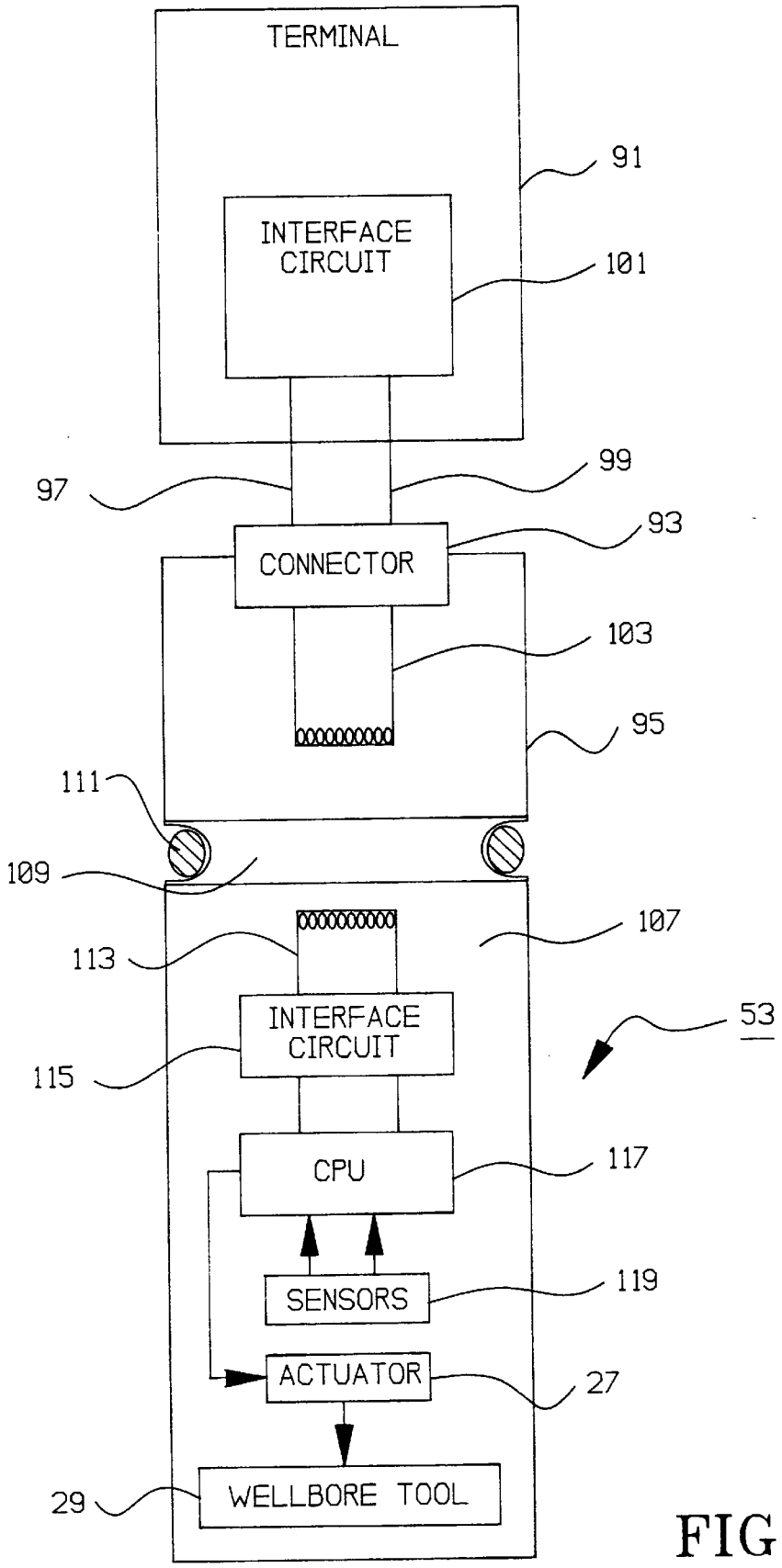
FIG. 14 is a simplified block diagram representation of a magnetic interface which facilitates communication between the programming terminal and the processor of the reception apparatus, without requiring a direct electrical connection.

FIG. 14 is a block diagram view of reception apparatus 53, actuator 27, and wellbore tool 29, disposed within housing 95, and releasably electrically coupled to programming terminal 91. As is shown, programming terminal 91 includes interface circuit 101 which is electrically connected by electrical connectors 97, 99 to connector 93 which is carried by housing 95. As is shown, connector 93 allows for the electrical connection between interface circuit 101 and electromagnetic coil 103. Electromagnetic coil 103 is separated from chamber 107 by barrier 109 which includes seal 111 which serves to prevent the leakage of fluid into chamber 107 which includes delicate electronic instruments which may be easily damaged by moisture. Electromagnetic coil 113 is disposed within chamber 107. Electromagnetic coils 103, 113 are utilized to transmit information across barrier 109, allowing an operator to program central processing unit 117 to respond to particular coded messages through the utilization of programming terminal 91, and to allow programming terminal 91 to be utilized to receive information from central processing unit 117. As is shown in FIG. 14, interface circuit 115 is provided between electromagnetic coil 113 and central processing unit 117. Sensor(s) 119 provide data to central processing unit 117. Central processing unit 117 continuously analyzes data provided by sensor(s) 119, and provides an actuation signal to actuator 27 upon recognition of a coded message which it is programmed to respond to during a programming mode of operation. Actuator 27 in turn actuates wellbore tool 29 to perform a wellbore operation. Wellbore tool 29 may be a packer, perforating gun, valve, liner hanger, or any other conventional wellbore tool which may be utilized to accomplish an engineering objective during drilling, completion, and production operations.

Figure 15:
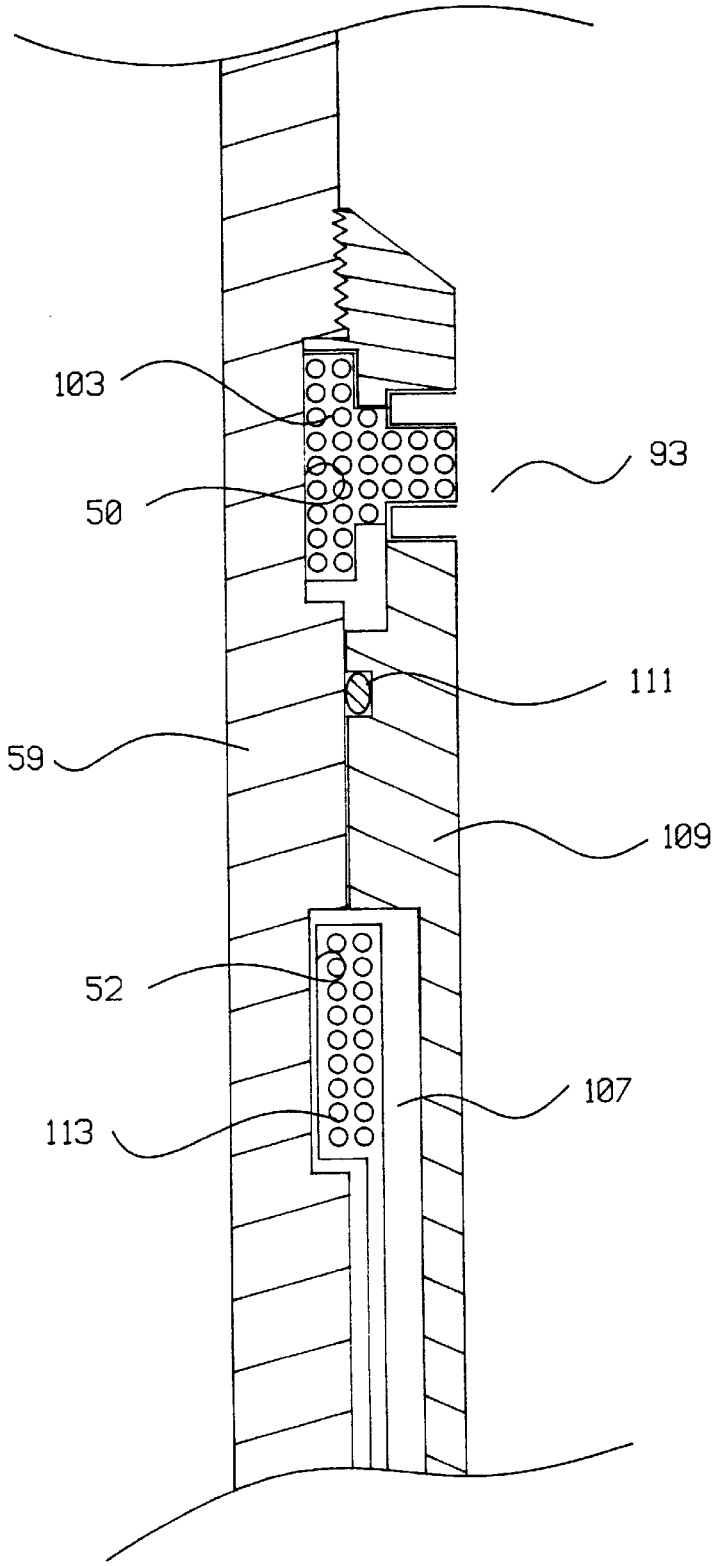
FIG. 15 is a simplified partial longitudinal section view of the magnetic circuit component of the magnetic interface.

FIG. 15 is a simplified and partial longitudinal section view of wellbore communication apparatus 11, and depicts the interaction of electromagnetic coil 103 and electromagnetic coil 113. As is shown, mandrel member 59 includes recessed region 50 which is adapted to receive the windings of electromagnetic coil 103. In this figure, connector 93 is depicted in simplified form; it allows the releasable electrical connection with programming terminal 91. Mandrel member 59 further includes recessed region 52 which is adapted for receiving the windings of electromagnetic coil 113. Seal 111 is disposed in a position intermediate electromagnetic coil 103 and electromagnetic coil 113, and is carried by barrier 109 which at least partially defines a housing which surrounds chamber 107. As is shown, electromagnetic coil 113 is disposed within the sealed chamber 107, while electromagnetic coil 103 is disposed exteriorly of the sealed chamber 107. In this configuration, mandrel member 59 operates as the core of a transformer. Electrical current which passes through electromagnetic coil 103 generates a magnetic field within the ferromagnetic material of mandrel member 59 (mandrel member 59 is typically formed of oil-field grade steel). This magnetic field passes through mandrel member 59 and induces a current to flow within the windings of electromagnetic coil 113. In this manner, the windings of electromagnetic coils 103, 113 and mandrel member 59 together form a magnetic circuit component which incorporates the structural ferromagnetic component 59 in a manner which facilitates communication across seal 111 and barrier 109 without having direct electrical connection therebetween. These components together cooperate as a "transformer" with a gain of approximately one. When communication is desired in the opposite direction, electrical current is passed through the windings of electromagnetic coil 113. This causes a magnetic flux to flow through the ferromagnetic material of mandrel member 59. The magnetic flux passing through mandrel member 59 causes a current to be generated in the windings of electromagnetic coil 103. The electrical current is directed outward through connector 93 to programming terminal 91.

12. THE MAGNETIC INTERFACE TERMINAL OF THE PROGRAMMING UNIT

Figure 16:
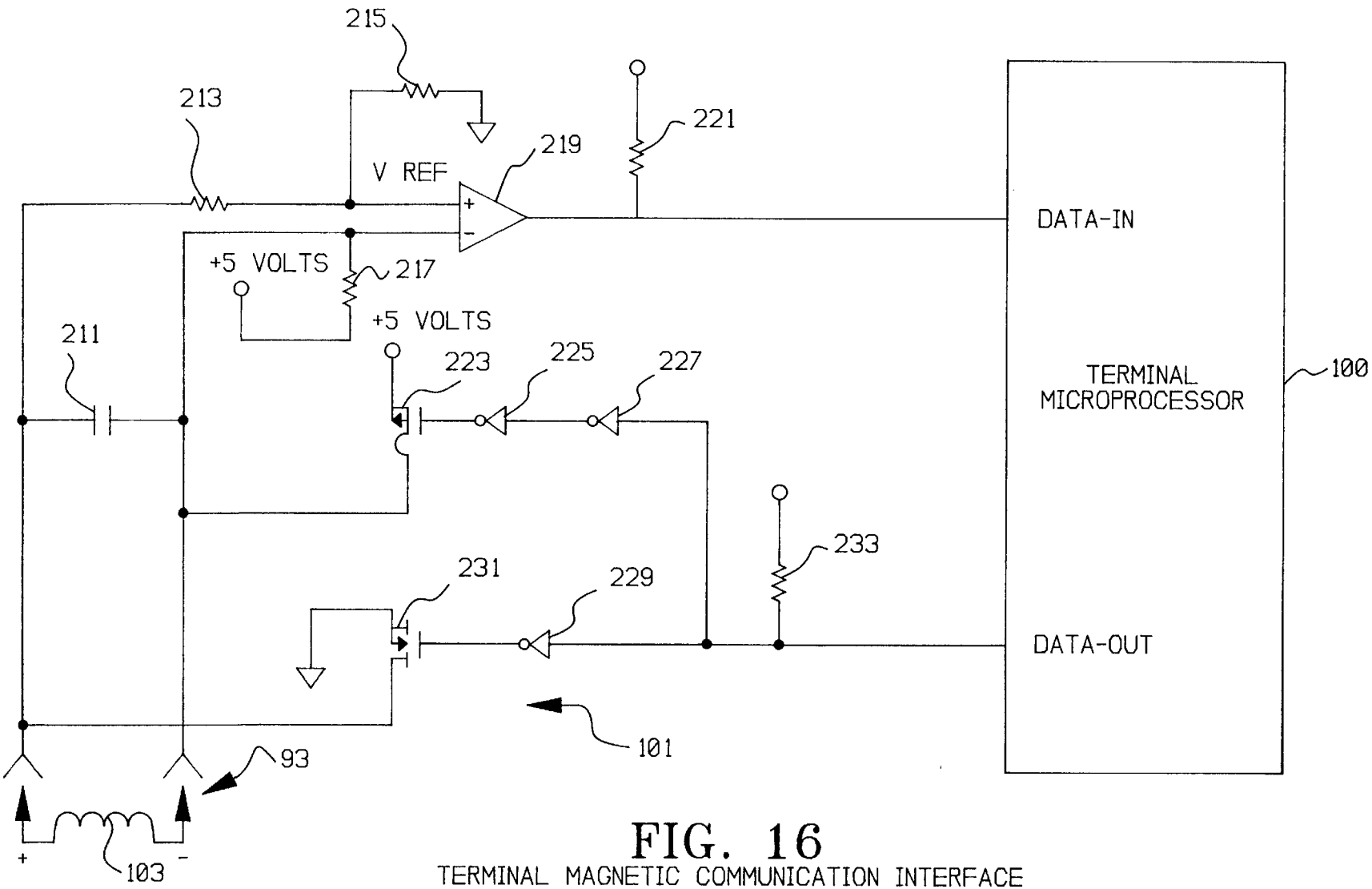
FIG. 16 is an electrical schematic of the programming terminal's magnetic communication interface.

FIG. 16 is an electrical schematic depiction of interface circuit 101 of programming terminal 91, which is coupled to terminal microprocessor 100 at DATA-IN pin and DATA-OUT pin. The passage of current through electromagnetic coil 113 (of FIG. 14) generates an electromagnetic field which causes the development of a voltage across electromagnetic coil 103. Snubber capacitor 211 allows electromagnetic coil 103 to change its voltage level more rapidly, but also limits the voltage across electromagnetic coil 103. As shown, a voltage of slightly less than five volts is applied to the non-inverting input of operational amplifier. The inverted voltage which is developed across electromagnetic coil 103 is also provided to the non-inverting input of operational amplifier 219. Operational amplifier 219 is configured to operate as a positive voltage level detector. As such, the output of operational amplifier 219 remains high, for so long as the voltage provided at the non-inverting input of operational amplifier 219 exceeds the small voltage $V_{ref}$ which is supplied to the inverting input of operational amplifier 219. The reference voltage $V_{ref}$ which is applied to the inverting input of operational amplifier 219 is established by selection of the resistance values for resistor 217, resistor 213, and resistor 215. As is shown in FIG. 16, five volts is applied to one terminal of resistor 217; this five volts causes a small current to flow through resistors 217, 213, and 215, establishing the reference voltage $V_{ref}$ at the inverting input of operational amplifier 219. When the sum of voltages applied to the non-inverting input of operational amplifier 219 falls below the voltage level of the voltage applied to the inverting input of operational amplifier 219, the output of operational amplifier 219 goes from high to low, and is detected by terminal microprocessor 100 at the DATA-IN pin.

The DATA-OUT pin of terminal microprocessor 100 may be utilized to selectively energize electromagnetic coil 103 to communicate a binary stream of ASCII characters to electromagnetic coil 113 (of FIG. 14) and interface circuit 115 (of FIG. 14). As is shown in FIG. 16, the output of the DATA-OUT pin of terminal microprocessor 100 is applied through inverter 229 to field effect transistor 231. The output of the DATA-OUT pin of terminal microprocessor 100 is also applied through inverters 227, 225 to field effect transistor 223. Field effect transistor 223 is a P-channel field effect transistor, but field effect transistor 231 is an N-channel field effect transistor. When the DATA-OUT pin of terminal microprocessor 100 goes high, field effect transistors 223, 231 switch on, allowing the five volts DC (which are applied to one input of field effect transistor 223) to be applied across electromagnetic coil 103, to cause an electromagnetic field to be generated which is detected by electromagnetic coil 113 (of FIG. 14). A stream of binary ASCII characters may be provided as a serial output of terminal microprocessor 100 at the DATA-OUT pin. The binary characters cause the selective application of voltage to electromagnetic coil 103, which is detected by electromagnetic coil 113. Interface circuit 115 (of FIG. 14) is utilized to reconstruct the serial binary character string which is representative of ASCII characters.

13. THE MICROPROCESSOR CIRCUIT

Figure 17:
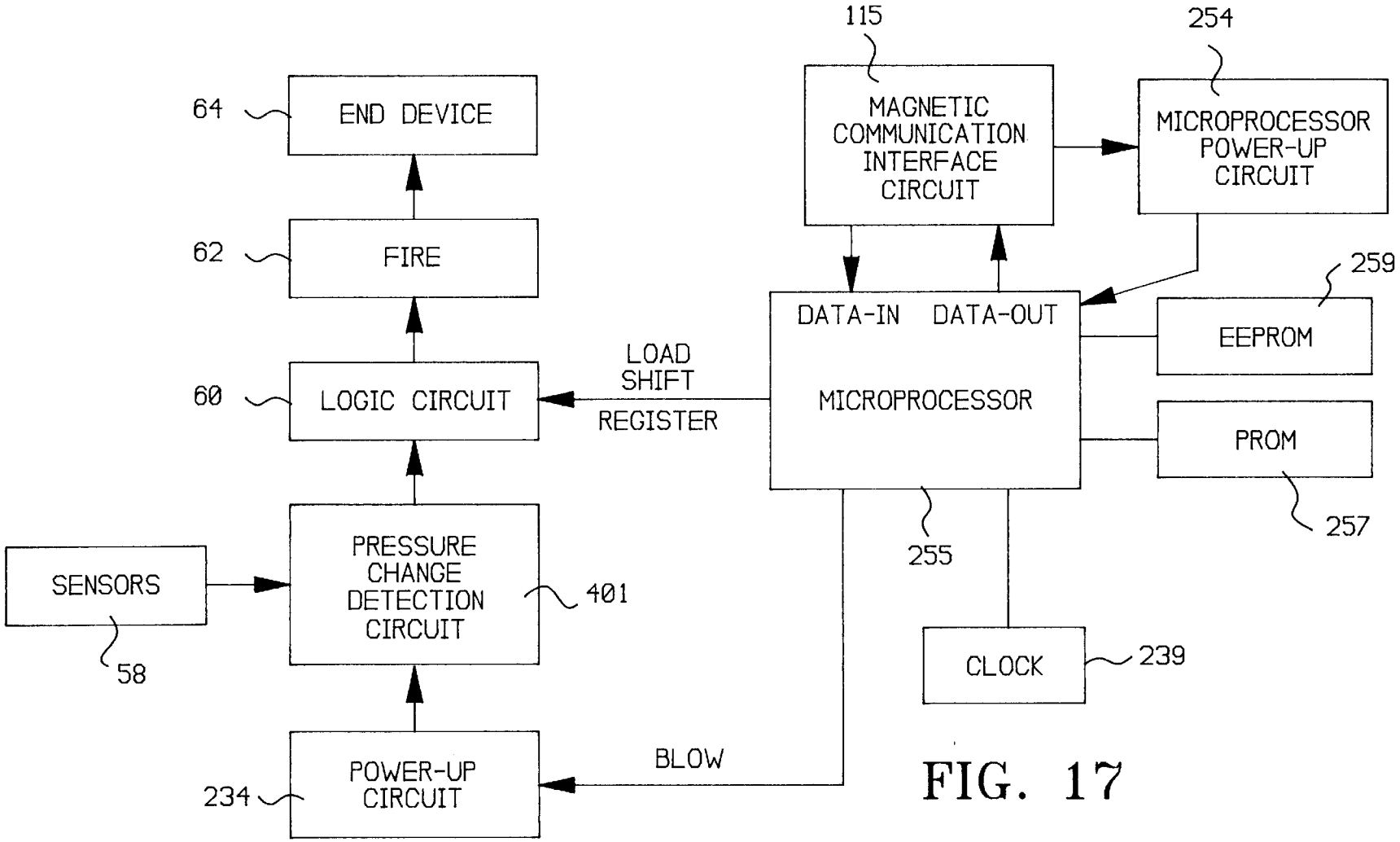
FIG. 17 is an electrical schematic and block diagram view of the electronic and processor components of the reception portion of the wellbore communication apparatus of the present invention.

FIG. 17 is a block diagram depiction of the electrical components which cooperate together to perform the operations of reception apparatus 53. FIGS. 18A through 20 provide detailed electrical schematic views of various components of the block diagram view of FIG. 17.

As is shown in FIG. 17, microprocessor 255 interfaces with a plurality of electrical components. Clock 239 provides a clock signal for microprocessor 255. EEPROM 259 provides an electrically-erasable memory space which is utilized to record information provided by the operator during the programming mode of operation. PROM 257 is utilized to store a computer program which is executed by microprocessor 255.

Microprocessor 255 receives and transmits information through magnetic communication interface circuit 115 during initialization of the system, testing of system components, or reading operations, all of which are performed through utilization of programming terminal 91. Magnetic communication interface 115 communicates with microprocessor 255 through DATA-OUT pin and DATA-IN pin to transmit serial binary data streams which are representative of ASCII characters.

Microprocessor 255 communicates in a limited manner with the circuit components of reception apparatus 53. First, it provides a "BLOW" command to power-up circuit 234 (the details of which will be provided below). Second, it provides a binary eight-bit word to logic circuit 60 as was discussed in detail above.

Just before the reception apparatus is lowered into a wellbore, the operator utilizes terminal 91 to communicate with microprocessor 255 through magnetic communication interface circuit 115. This commences the initiation of the tool. The first magnetic pulse triggers the operation of microprocessor power-up circuit 254. Microprocessor 255 utilizes a program stored in PROM 257, as well as binary value stored in memory of EEPROM 259. Microprocessor 255 directs a digital command through "BLOW" line to power-up circuit 234. This causes the application of power to pressure change detection circuit 401. Then, microprocessor 255 utilizes the LOAD SHIFT REGISTER line to pass an eight-bit binary word to logic circuit 60.

The reception apparatus 53 is then lowered into the wellbore. Sensors 58 detect the transmission of acoustic pulses through a fluid column in contact with reception apparatus 53. The raw sensor data is directed from sensors 58 to pressure change detection circuit 401, and are supplied to logic circuit 60 which is utilized to determine whether the acoustic transmissions match the one or more transmission frequencies which this particular reception apparatus is programmed to be responsive to. If a match is found between the transmission frequency of acoustic pulses and the preprogrammed one or two acoustic transmission frequencies, then logic circuit 60 supplies a command signal to fire circuit 62. Preferably, fire circuit 62 is simply a transistor switching circuit which allows the application of a relatively high amount of current to end device 64.

The following sections discuss the operations of magnetic communication interface circuit 115, power-up circuit 234, and microprocessor power-up circuit 254.

14. THE MAGNETIC COMMUNICATION INTERFACE OF THE RECEPTION APPARATUS

Figure 18A:
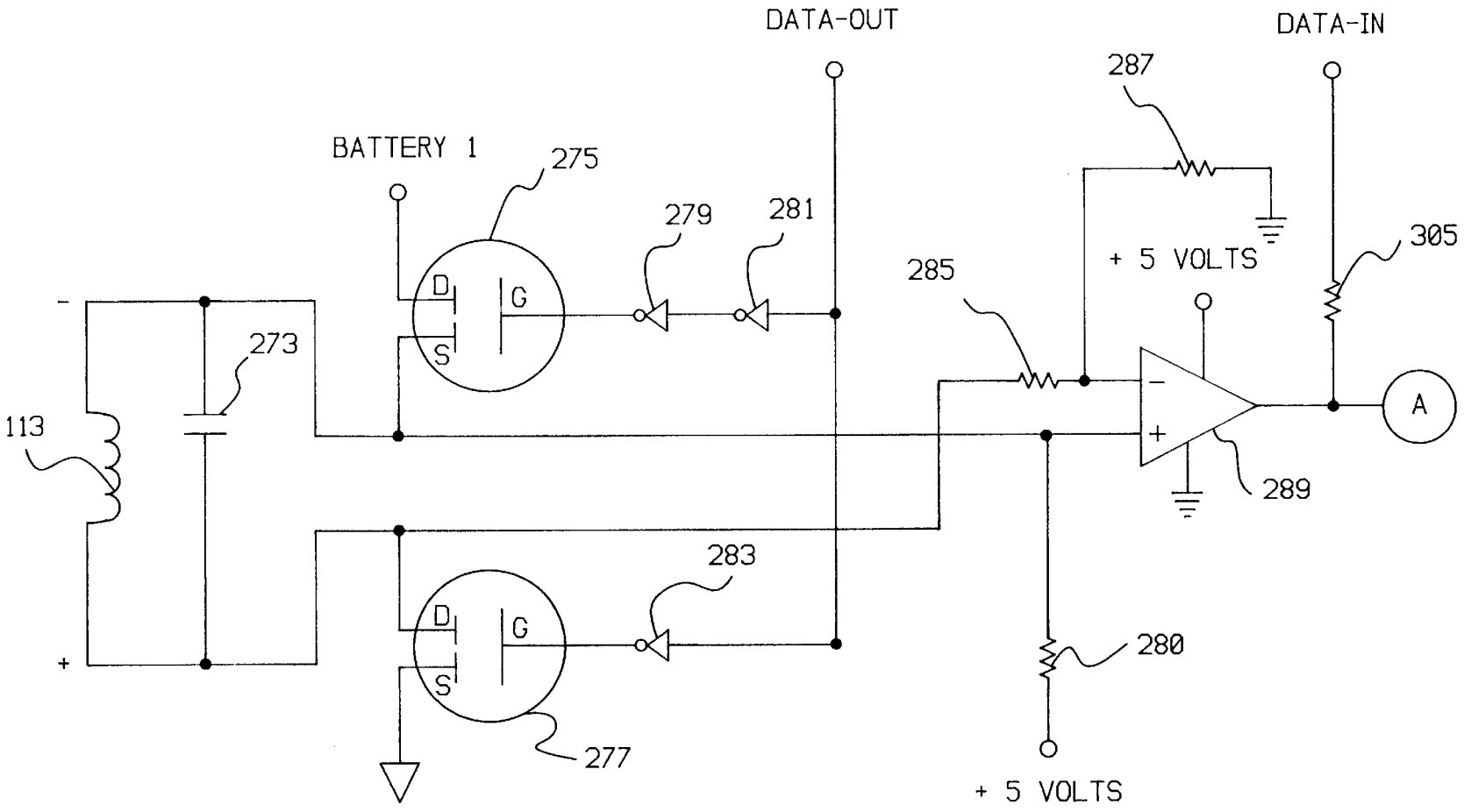
FIGS. 18A and 18B are an electrical schematic of magnetic communication interface for the reception apparatus.
Figure 18B:
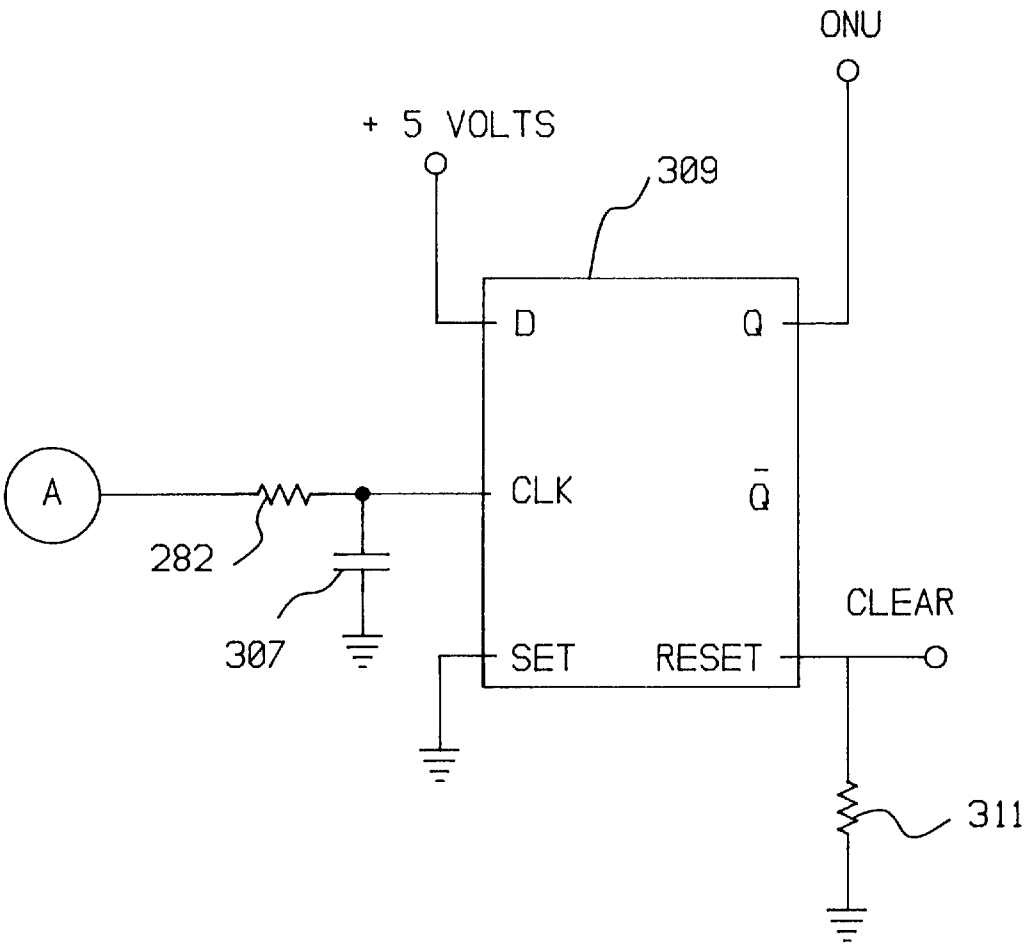

FIGS. 18A and 18B are an electrical schematic depiction of magnetic communication interface circuit 115, which receives signals from electromagnetic coil 103, which is part of programming terminal 91. The voltage which is developed across electromagnetic coil 113 is applied to operational amplifier 289, which is operated as a positive voltage level comparator. Positive five volts DC is applied through resistor 280 to the non-inverting input of operational amplifier 289. The inverse of the voltage which is developed across electromagnetic coil 113 is also applied to the non-inverting input of operational amplifier 289. A small DC current flows through resistor 280, electromagnetic coil 113, resistor 285, and resistor 287, to ground. The voltage developed across resistor 287 is applied to the inverting input of operational amplifier 289. When a digital signal is received, the voltage developed across electromagnetic coil 113 is subtracted from the slightly less than five volts applied to the non-inverting input of operational amplifier 289, causing the voltage detected at this input to decrease and eventually fall below the voltage level applied to the inverting input of operational amplifier 289. As a consequence, the normally-high output of operational amplifier 289 switches low for the duration of the binary signal received by electromagnetic coil 113. This voltage is applied through resistor 305 to the DATA-IN terminal of microprocessor 255. Additionally, the voltage is passed through the low-pass filter established by resistor 282 and capacitor 307 to the CLOCK input of flip-flop 309, causing the Q output of flip-flop 309 to go from a normally-low state to a high state. As is shown in FIGS. 18A and 18B, the Q output of flip-flop 309 is supplied to the ONU terminal of microprocessor 255. As will be discussed in greater detail herebelow, the CLEAR output of microprocessor 255 may be utilized to reset flip-flop 309 and cause the output of the Q pin to go from high to low.

The magnetic communication interface circuit 115 also allows microprocessor 255 to transmit a serial stream of binary bits, which are representative of ASCII characters, through electromagnetic coil 113. The binary character string is applied to the magnetic communication interface circuit 115 through the DATA-OUT pin of microprocessor 255. A binary zero which is applied to the DATA-OUT pin of microprocessor 255 causes a binary zero to be applied to the gate of N-channel field effect transistor 275, and a binary one to be applied to the gate of P-channel field effect transistor 277, allowing current to flow from BATTERY 1 through field effect transistor 275, inductor 113, field effect transistor 277 to ground. The passage of current through electromagnetic coil 113 creates an electromagnetic field which may be detected by electromagnetic coil 103. The application of a binary one to the DATA-OUT pin of microprocessor 255 prevents the passage of current through field effect transistors 275, 277, thus preventing the passage of current through electromagnetic coil 113 and preventing the generation of an electromagnetic field. In this manner, a binary zero is represented by the creation of an electromagnetic field at electromagnetic coil 113, while a binary one is represented by the absence of an electromagnetic field at electromagnetic coil 113. The sequential presence or absence of the electromagnetic fields at electromagnetic coil 113 represents a serial binary data stream, which may be detected by electromagnetic coil 103 and which may be reconstructed by interface circuit 101 and directed to the terminal microprocessor 100.

15. THE POWER-UP CIRCUIT FOR PRESSURE CHANGE DETECTION CIRCUIT

Figure 19:
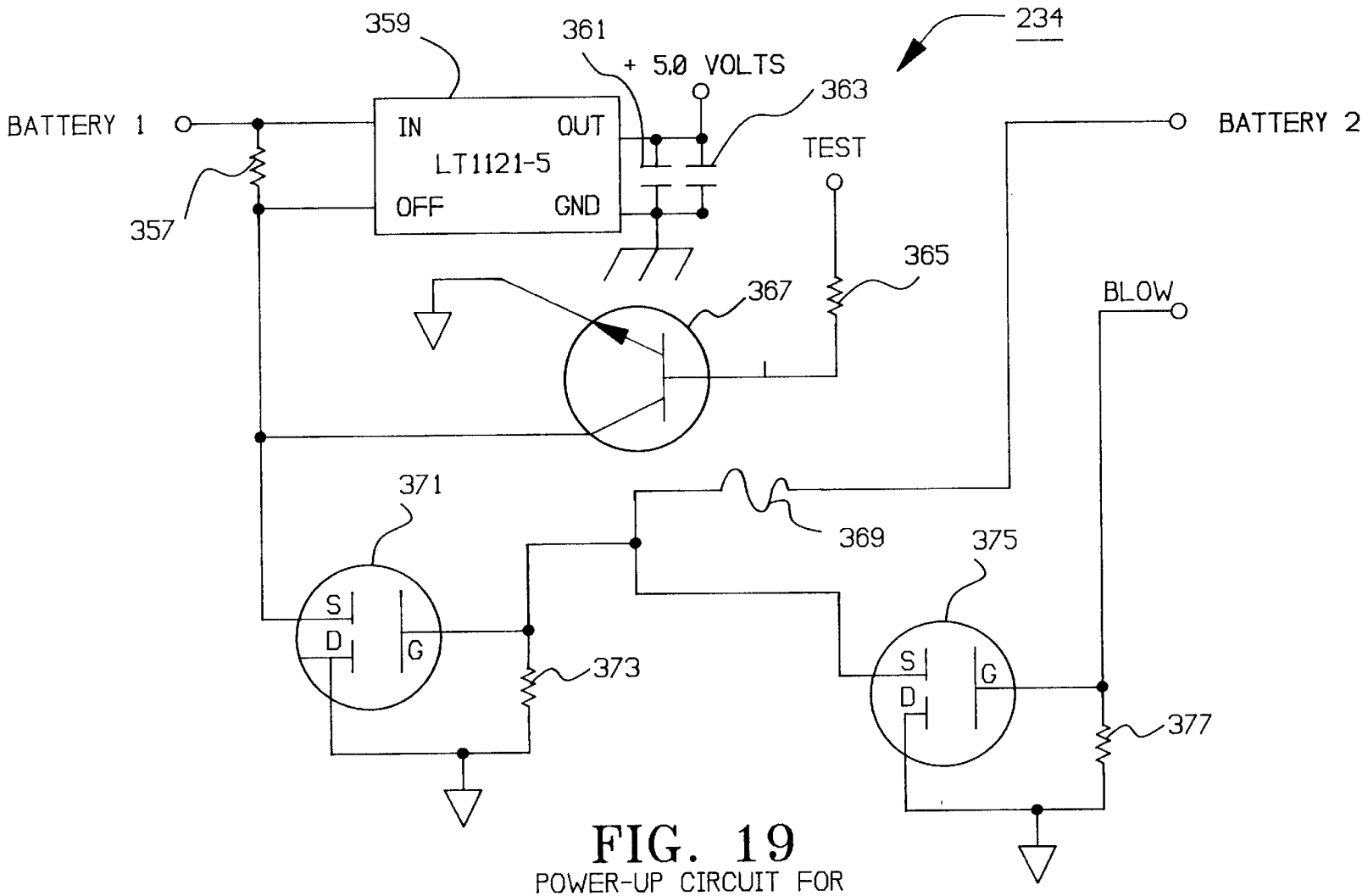
FIG. 19 is an electrical schematic of the power-up circuit for the pressure change detection circuit.

FIG. 19 is an electrical schematic depiction of power-up circuit 234, which is utilized to allow microprocessor 255 to allow the consumption of power by the pressure change detection circuit of FIG. 8, only after reception apparatus 53 has been initialized by the operator. Microprocessor 255 utilizes the BLOW output pin to blow fuse 369 which the causes the application of power to the components which comprise the pressure change detection circuit. As is shown in FIG. 19, the BLOW output pin of microprocessor 255 is coupled to the gate of field effect transistor 375. The drain of field effect transistor 375 is connected to BATTERY 2 through fuse 369. Application of voltage to the gate of field effect transistor 379 allows current to flow from BATTERY 2 through fuse 369 and field effect transistor 375 to ground, causing fuse 369 to blow. Prior to blowing of fuse 369, the voltage of BATTERY 2 is directly applied to the gate of field effect transistor 371, causing the transistor to be turned off. Resistor 373 should be sufficiently large to limit the current flowing through fuse 369 to an amount which does not blow the fuse.

The application of voltage to the gate of field effect transistor 375 creates a short circuit path around resistor 373, allowing a greater current to flow through fuse 369. Once fuse 369 is blown, the gate of field effect transistor 371 is permanently tied to ground, thus locking field effect transistor 371 in a permanent conducting condition, allowing current to flow from BATTERY 1 to ground through resistor 375. This causes linear regulator 359 to go from a OFF condition to an ON condition. Linear regulator 359 only operates if there is a voltage difference between the voltage applied to the IN terminal and the OFF terminal. The voltage difference exists only if current can flow from BATTERY 1, through resistor 357 and field effect transistor 371 to ground. The blowing of fuse 369 allows current to flow in this path, and thus turns linear regulator 359 from an ON condition to an OFF condition. Linear regulator 359 receives as an input voltage from BATTERY 1, and produces as an output five volts DC at the OUT terminal. The output of linear regulator 359 supplies power to microprocessor 255 and the other components which cooperate therewith. Transistor switch 367 is provided for selectively enabling linear regulator 359 by application of voltage to the TEST pin. This allows testing of the operation of the pressure change detection circuit without requiring the blowing if fuse 369. When five volts DC is applied to the TEST terminal, transistor switch 367 switches from an OFF condition to an ON condition, allowing current to flow from BATTERY 1, through resistor 357 and transistor switch 367 to ground, thus enabling operation of linear regulator 359.

16. THE POWER-UP CIRCUIT FOR THE MICROPROCESSOR

Figure 20:
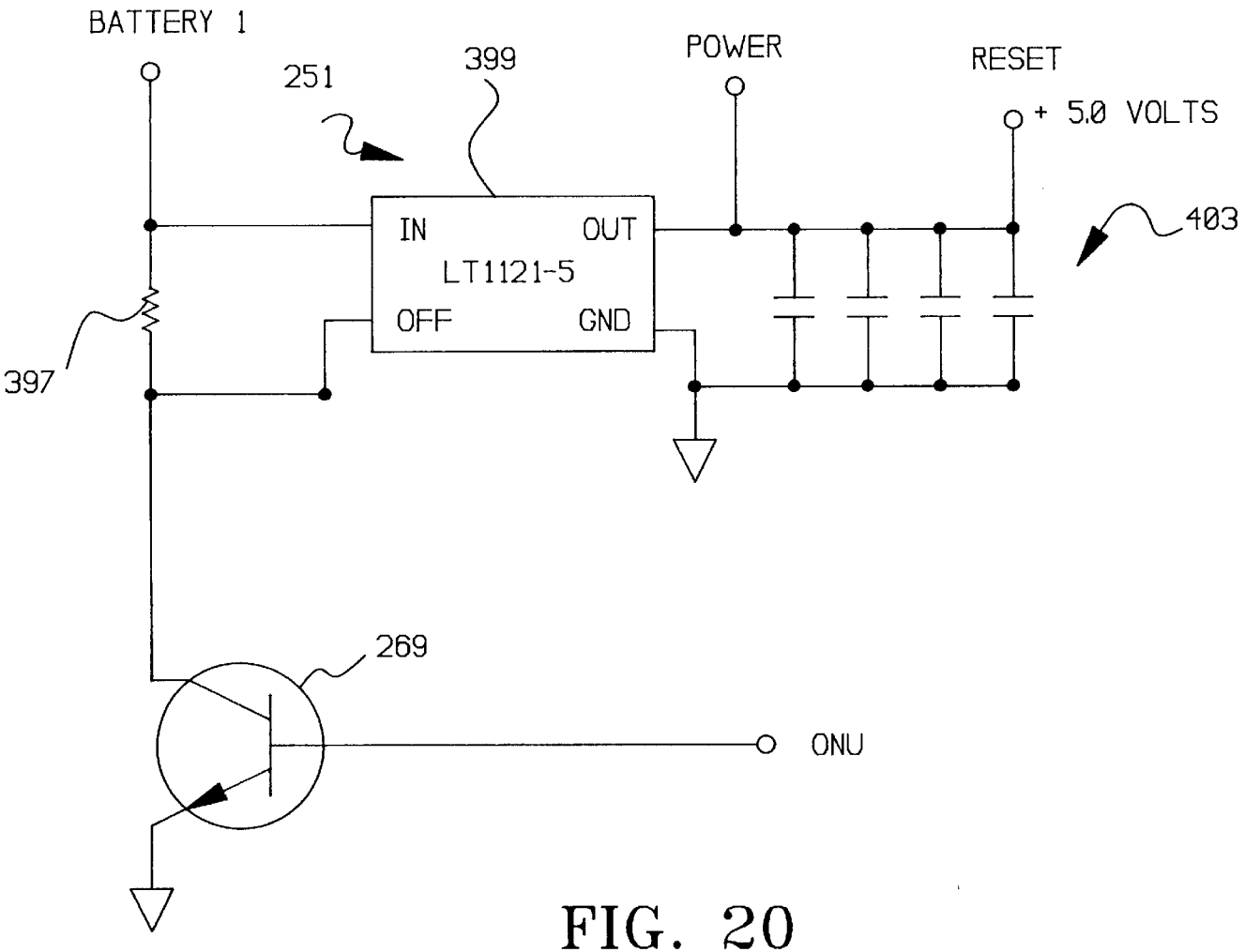
FIG. 20 is an electrical schematic of a power-up circuit for the microprocessor of the reception apparatus.

FIG. 20 is an electrical schematic depiction of a power-up circuit for microprocessor 255. As is shown in FIG. 20, the ONU signal is supplied to the base of switching transistor 269. If ONU goes high, transistor 269 is switched from an OFF condition to an ON condition, allowing current to pass from BATTERY 1, through resistor 397 and transistor 269 to ground. Linear regulator 399 will operate only if a voltage difference exists between the IN pin and the OFF pin. Until switching transistor 269 switches from an OFF condition to an ON condition, linear regulator 399 is off, and no voltage is supplied at the OUT pin; however, once switching transistor 269 is switched from an OFF condition to an ON condition, a voltage is developed across resistor 397, and linear regulator 399 receives the voltage of BATTERY 1 at the IN pin and produces five volts DC as an output which is supplied to both the power pin of microprocessor 255 and the RESET pin of microprocessor 255. Capacitor array 403 are provided as a noise filter to ensure that the RESET pin is not unintentionally triggered. The circuit operates to power-up the microprocessor, when the first bit received from the terminal 91.

17. THE COMPUTER PROGRAM

FIGS. 21A through 22D are flowchart representations of a computer program which is resident in memory of ROM 257 and EEPROM 259 of FIG. 17, and which is executed by microprocessor 255 to program a particular reception apparatus to be responsive to one or two acoustic transmission frequencies.

Figure 21A:
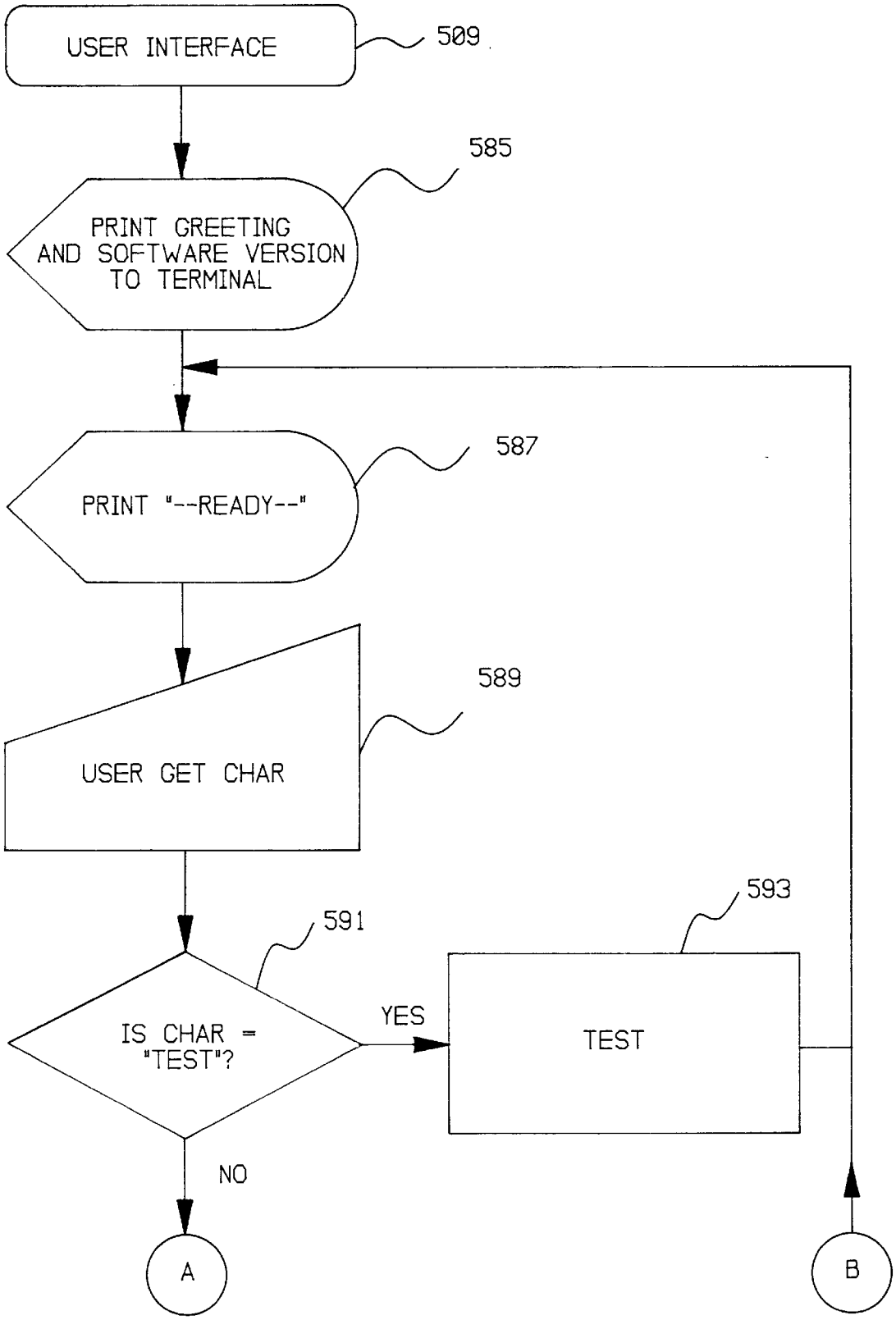
FIGS. 21A and 21B are a flowchart representation of a user interface routine which allows communication between the reception apparatus and the programming terminal.
Figure 21B:
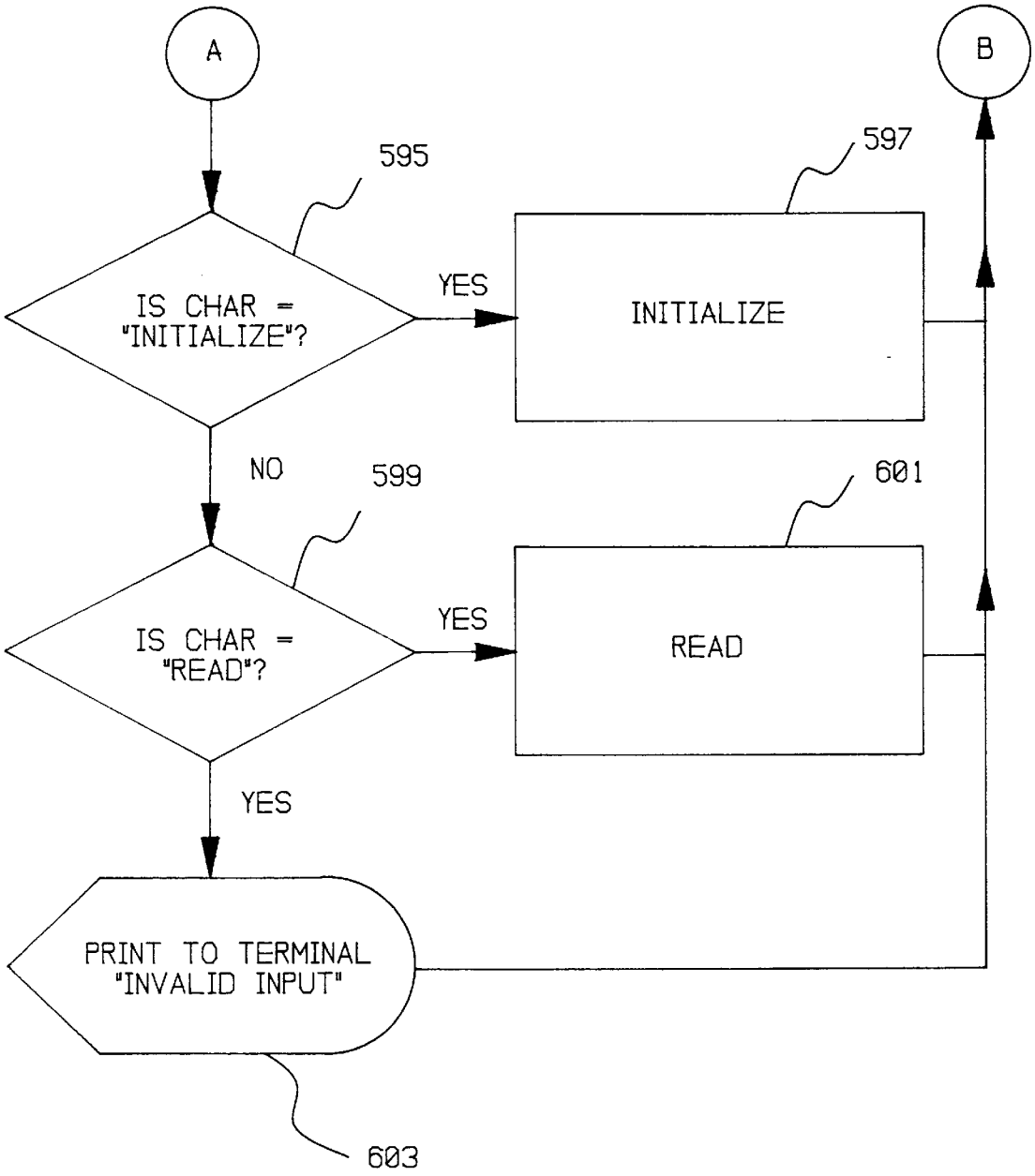
Figure 22A:
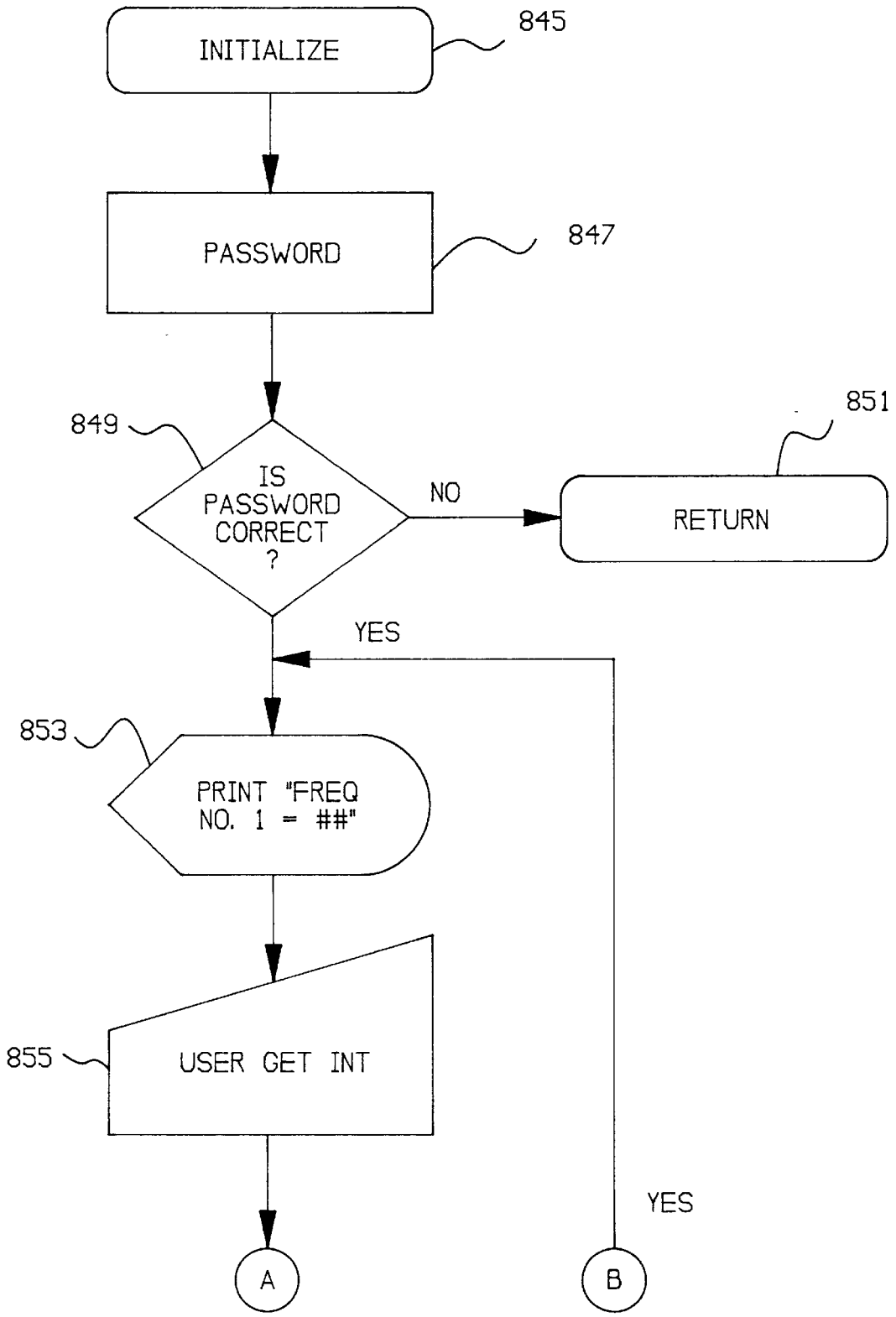
FIGS. 22A through 22D are a flowchart representation of an initialization routine.
Figure 22B:
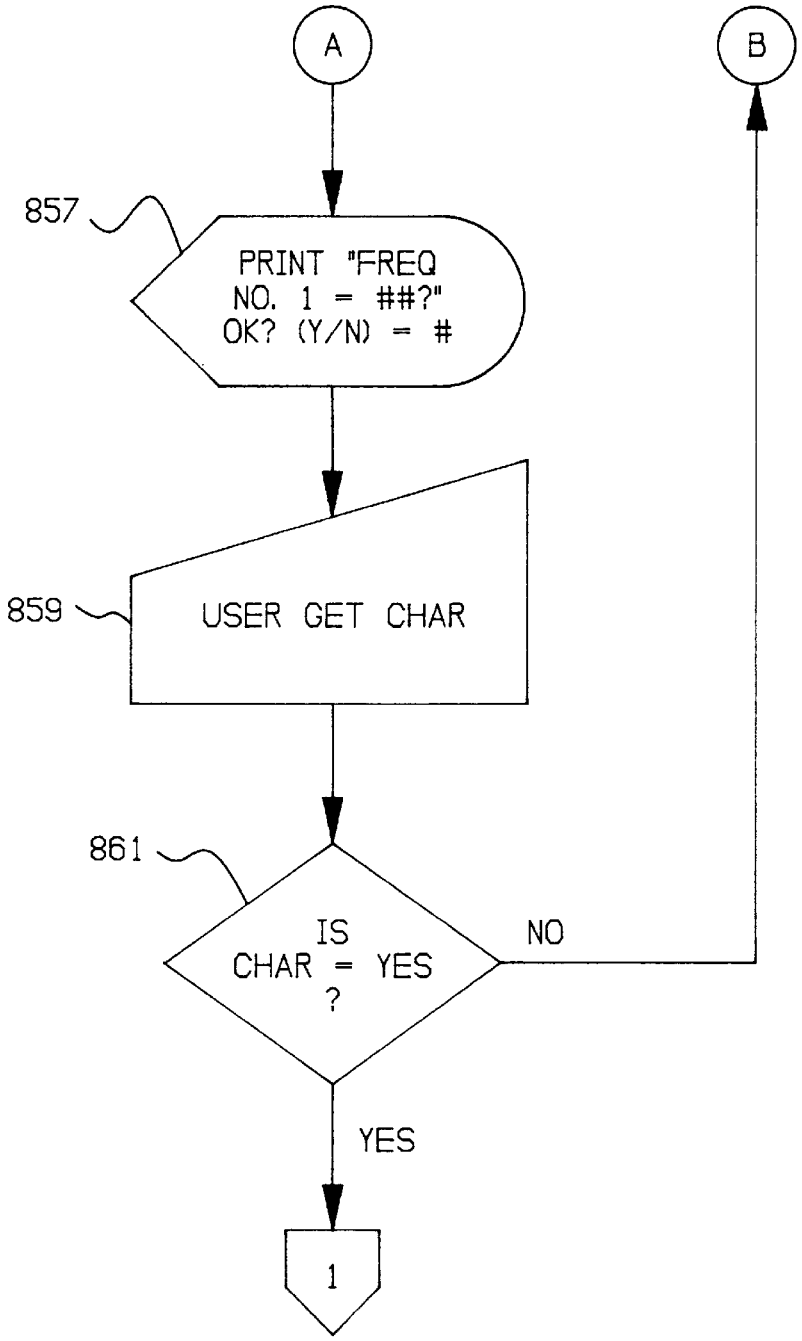
Figure 22C:
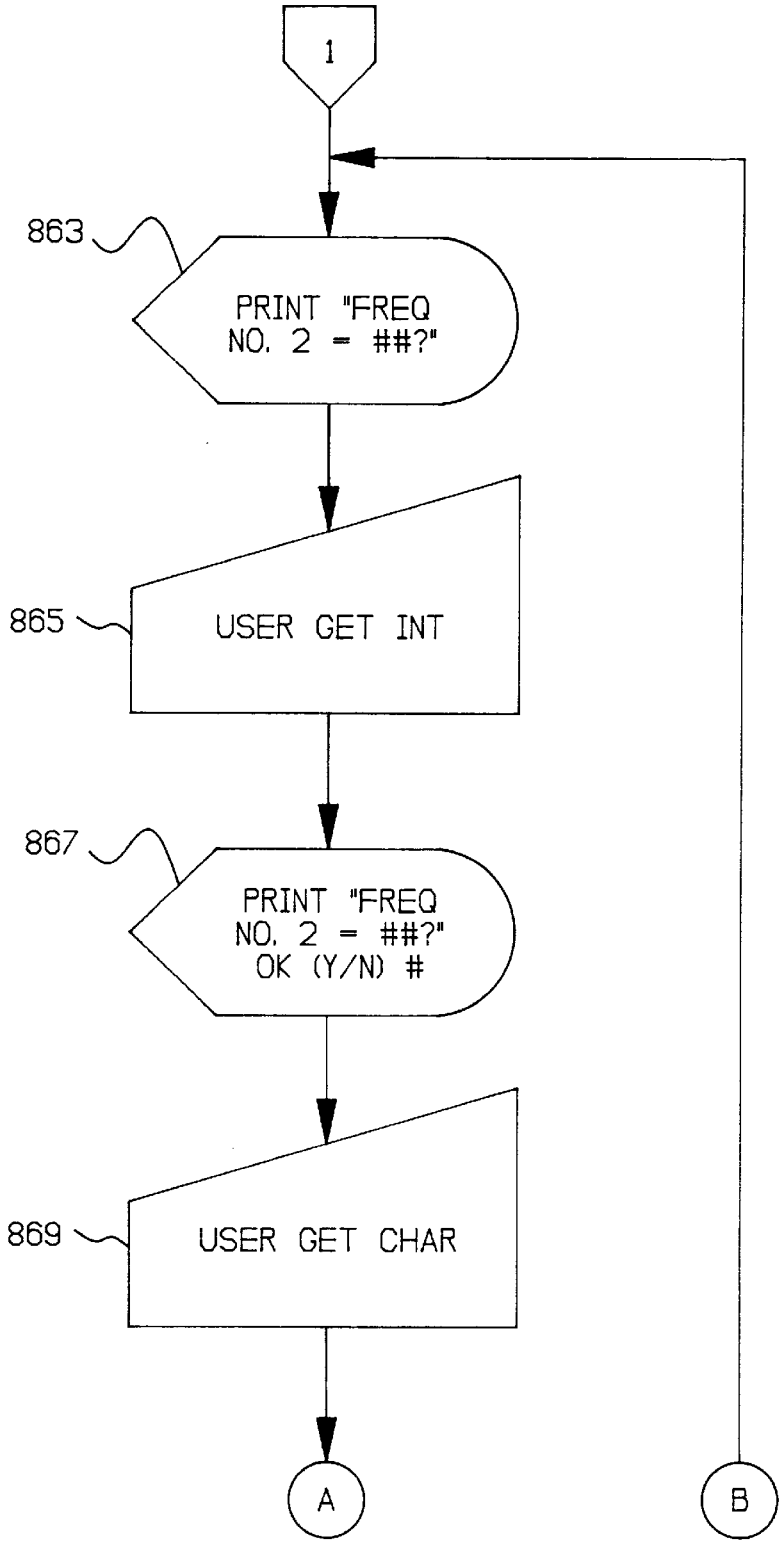
Figure 22D:
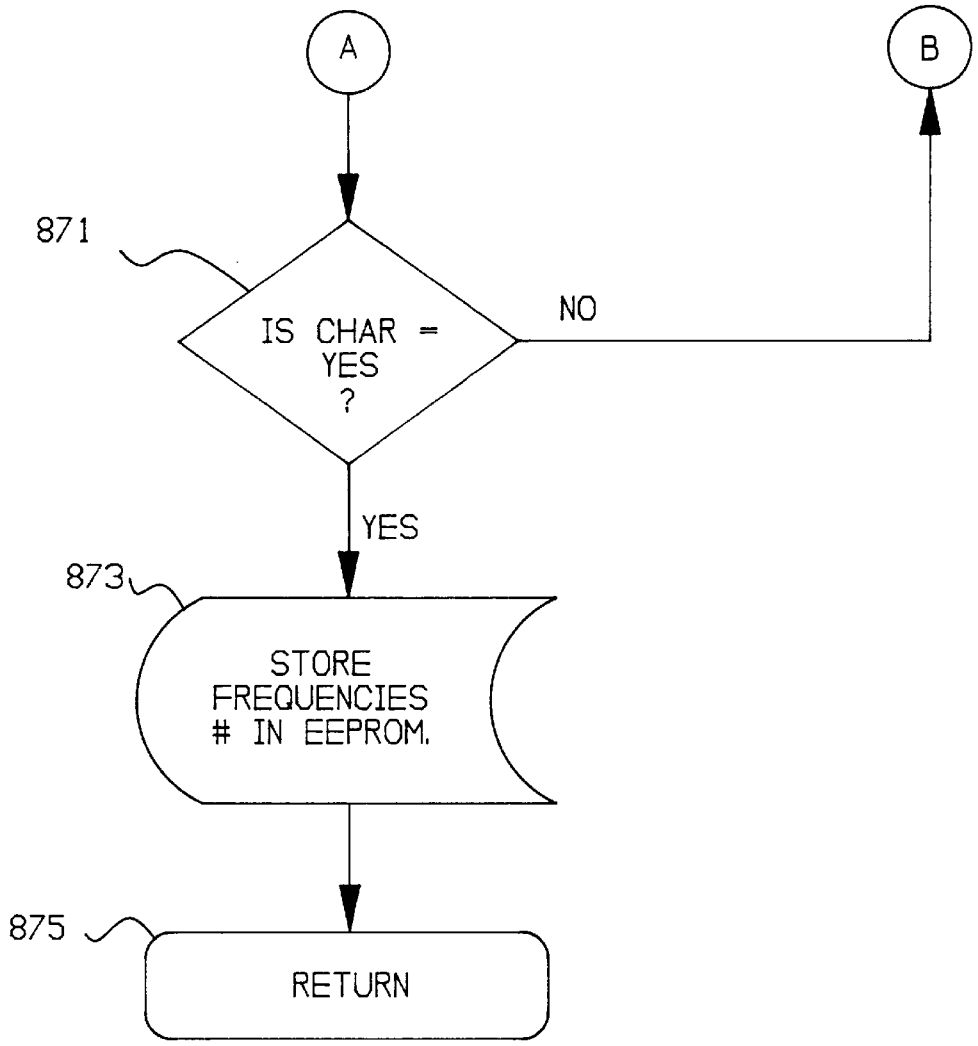

FIGS. 21A and 21B are a flowchart representation of the preferred user interface routine. The process begins at software block 509, wherein microprocessor 255 calls the user interface routine. In accordance with software block 585, microprocessor 255 generates and sends an ASCII character string through magnetic communication interface circuit 115; if programming terminal 91 is coupled to reception apparatus 53, the display of programming terminal 91 will print a greeting and identify the software version resident in PROM 257. Next, in accordance with software block 587, microprocessor 255 produces an ASCII character string which comprises a user prompt, which prompts the user to select a particular operation by depressing a key on programming terminal 91. Microprocessor 255 then enters a routine for retrieving the subroutine associated with the character selection of the operator, in accordance with software block 589.

The process continues in software block 591, 595, and 599, wherein the user input is analyzed to determine whether the user is requesting "test" operations, "initialization" operations, or "reading" operations. The program continues at the appropriate software block, including software block 593 for testing operations, software block 597 for initialization operations, and software block 601 for reading operations. If the user input is something other than selection of the "T", "I", or "R" keys of programming terminal 91, the computer program continues in software block 603 by printing to programming terminal 91 a message which states that the operator input is "invalid". In order to simplify the present discussion, only the initialization operation will be discussed.

The "initialize" functions will now be described with reference to FIGS. 22A through 22D.

If it is determined in the flowchart representation of the user interface routine of FIGS. 21A and 21B that the operator has selected the initialization routine, microprocessor 255 performs the operations set forth in the flowchart representation of FIGS. 22A through 22D. The process begins at software block 845, wherein microprocessor 255 calls the initialization routine for execution. An optional password protection feature may be provided, which challenges the operator to enter a secret password, in accordance with software block 847, and then examines the entry, in accordance with software blocks 849, and 851, to determine whether or not to allow initialization of the wellbore communication apparatus. If the operator passes the password challenge, the process continues in accordance with software block 853, wherein the operator is prompted to identify a particular one of a plurality of pre-defined codes which are represented by the arabic numerals 1 through N, with each arabic numeral representing a particular acoustic pulse transmission frequency. In accordance with software block 855, microprocessor 255 fetches the operator selection, and then prompts the operator to verify the selection, in accordance with software block 857. In software block 859, microprocessor 255 fetches the operator's verification of the selected frequency. If, in software block 861, it is determined that the operator has verified the selection, the process continues; however, if the operator denies the selection, the operator is once again prompted to select a pre-defined frequency.

In accordance with software block 863, microprocessor 255 prompts the operator to enter a second particular acoustic pulse transmission frequency. In accordance with software block 865, microprocessor 255 fetches the operator selection, and then prompts the operator to confirm the selection in accordance with software block 867. In accordance with software block 869, microprocessor 255 fetches the operator's verification or denial of the selected delay interval. If the operator's response is "no", the process returns to software block 863, wherein the operator is provided another opportunity to enter a delay interval; however, if the response is "yes", the process continues at software block 873, wherein the operator selected frequencies are stored in EEPROM 259, and microprocessor returns to the main program in accordance with software block 875.

18. COMPLETION OPERATIONS

Figure 23A:
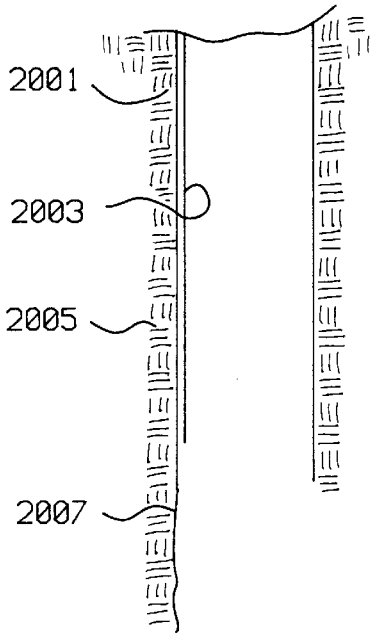
FIGS. 23A through 23E are simplified schematic views of the utilization of the present invention to perform a completion operation.
Figure 23B:
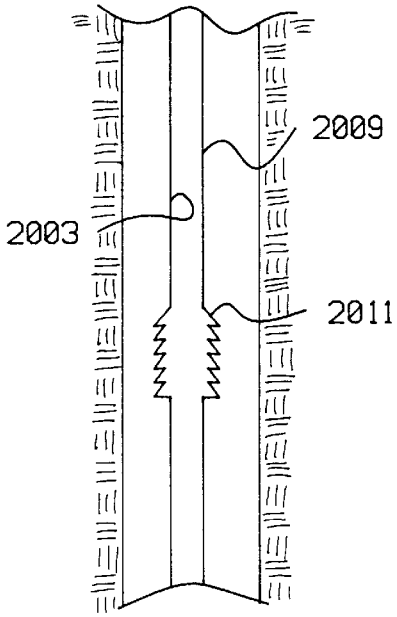
Figure 23C:
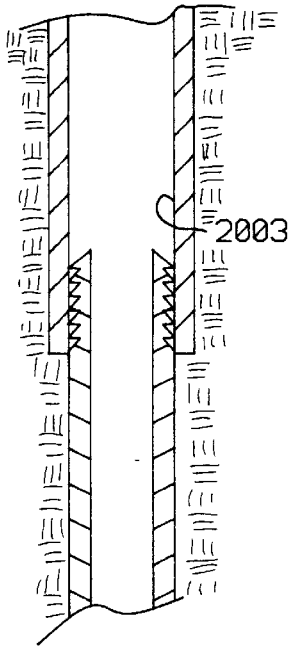
Figure 23D:
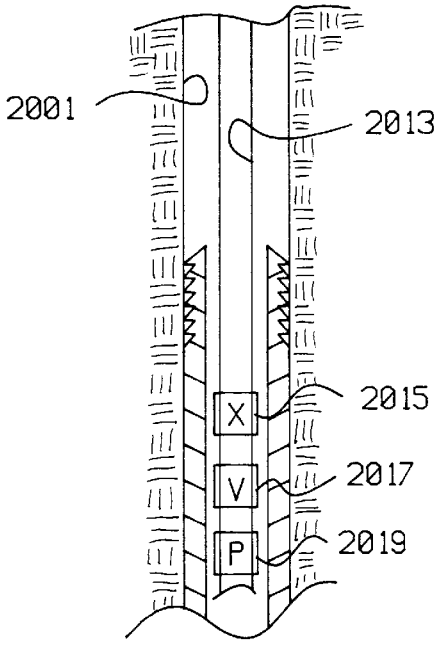
Figure 23E:
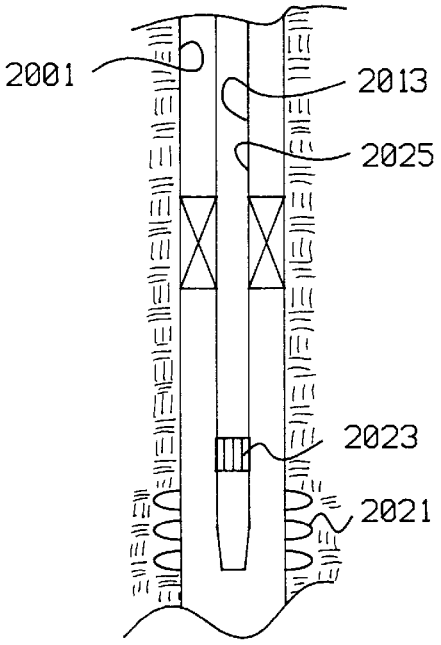

The present invention may find particular utility in conventional wellbore operations, such as completion operations. FIGS. 23A through 23E depict in simplified form one type of completion operation which can be accomplished with the present invention. FIG. 23A depicts wellbore 2001 which is partially cased by casing 2003 which is held in position by cement 2005, but also includes uncased portion 2007. As is shown in FIG. 23B, an electrically-actuable liner hanger mechanism 2011 may be conveyed within wellbore 2001 on tubing string 2009, and set against casing 2003 when a reception apparatus contained within electrically-actuable liner hanger mechanism 2011 recognizes a transmission frequency which is transmitted through a wellbore fluid column. The reception apparatus portion of liner hanger mechanism 2011 may initiate a power charge reaction which is utilized to set a gripping mechanism into gripping engagement with the interior surface of casing 2003, as depicted in FIG. 23C. Tubing string 2009 is then removed from the wellbore. Next, as is depicted in FIG. 23D, tubing string 2013 may be lowered within wellbore 2001. Tubing string 2013 includes packer mechanism 2015, valve mechanism 2017, and perforating gun mechanism 2019. Each of these wellbore devices includes a reception apparatus which is preprogrammed to provide an actuation signal upon reception of a particular transmission frequency. The acoustic pulses may be sent upon a wellbore fluid column to perforate the wellbore with perforating mechanism 2019, open a sliding sleeve valve with valve mechanism 2017, and pack tubular conduit 2013 off against the casing of wellbore 2001. In this configuration, wellbore fluids may flow into wellbore 2001 through perforations 2021, and into central bore 2025 of tubular conduit string 2013 through openings 2023 of valve mechanism 2017, and be brought to the surface by conventional means, such as a sucker rod pump mechanism or a submersible pump disposed within the wellbore.

In an alternative embodiment, a fluid flow regulator valve may be included within the tubular conduit string 2013 which allows the operator to remotely control the amount of fluids flowing from wellbore 2001 to central conduit 2025 of tubular conduit string 2013.

While the foregoing has described the types of completion operations which can be performed utilizing the method and apparatus for remote control of the present invention, several alternative end devices will now be discussed in order to provide examples of actuation techniques which may be utilized in completion tools.

First, an exploding fastener end device will be discussed. This end device has the outward shape, appearance, and size of an ordinary fastener, such as a bolt; however, the exploding fastener includes an electrically-actuable power charge disposed within a cavity. The application of current to electrical leads will result in fragmentation of the exploding fastener end device.

Second, a Keviar coupling end device will be discussed which utilizes a Kevlar string to tie together portions of a wellbore tool until their separation is desired. An electrical current is applied to a heating element which is wound about at least a portion of the Keviar string, to weaken it and cause it to break.

Third, a sliding sleeve assembly end device will be discussed which includes a piston member which is secured in position by a Kevlar string or an exploding fastener. When change of the closure state of the valve is desired, an electrical current is applied to either the Kevlar string or the exploding fastener, to allow pressure differentials (and preferably hydrostatic fluid pressure differentials) to act upon the piston member, to cause it to shift in position to change the closure state of the valve. If the valve is a normally-opened valve, the application of electrical current to the electrically-actuable Kevlar string or exploding fastener will cause the valve to move to a closed condition. Conversely, if the valve is normally-closed, application of the electrical current to the Kevlar string or exploding fastener will cause the valve to move to an open condition.

These particular three end devices will be discussed in detail in the following sections.

19. EXPLODING FASTENER END DEVICE

Figure 24:
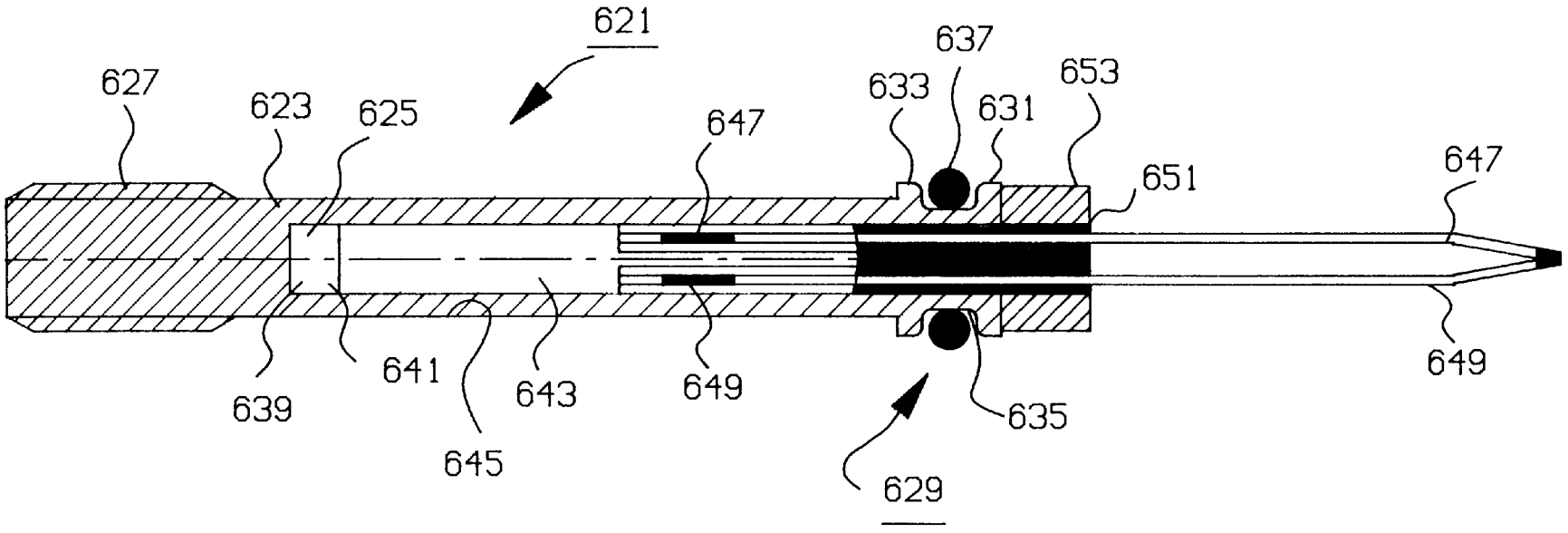
FIG. 24 is a longitudinal section view of the preferred exploding fastener end device of the present invention.

FIG. 24 is a longitudinal section view of the preferred exploding fastener end device of the present invention. Exploding fastener 621 is preferably shaped exteriorly to conform to the functional requirements of a particular fastener. In the embodiment discussed herein, the particular fastener employed is a bolt structure. Therefore, exploding fastener 621 includes bolt body 623 which is preferably cylindrical in shape, but which includes cavity 625 which contains components which cause the fragmentation and fracture of bolt body 623 when an electrical current is passed inwardly utilizing electrical leads 647, 649. The exploding fastener 621 may be utilized with the remote control system of the present invention to receive an actuating electrical current through electrical leads 647, 649 when the reception apparatus has determined that the frequency of the acoustic transmissions matches one or more preprogrammed frequencies.

In the particular embodiment depicted in FIG. 24, bolt body includes external threads 627 at one end, and seal assembly 629 at the other end. External threads 627 may be machined onto bit body 623 to define any conventional or novel thread type, which thus may be suited for mating with any particular internally threaded bore. The seal assembly 629 preferably includes inner lip 631 and outer lip 633 which together define O-ring cavity 635. O-ring cavity 635 is adapted to receive annular O-ring seal 637 therein. In this configuration, seal assembly 629 is adapted to form a seal with any appropriately dimensioned cylindrical cavity. Preferably, seal assembly 629 is disposed in a circular port. Preferably, this port leads to a substantially fluid-tight chamber which carries the electrical and electronic components which make up the reception apparatus of the present invention.

Cavity 625 of exploding fastener 621 includes power charge 639, which is preferably a heat-actuable lead azide power charge which explodes when heated above a predetermined heat threshold. Heating element 641 extends into power charge 639 and is preferably an electrical resistance heating element which receives electrical current and which generates heat, preferably heat sufficient to exceed the actuation threshold of power charge 639. Cavity 625 of exploding fastener 621 additionally includes glass insulating body 643 which electrically isolates heating element 641 to prevent accidental and unintentional discharge of power charge 639 due to stray currents or charges. Electrical leads 647, 649 extend through cavity 625 to define the current path to and from heating element 641. Preferably, electrical connections are included in the circuit path defined by electrical lead 647 and electrical lead 649 to allow the disconnection of the electrical circuit during intervals of nonuse and transportation. Cavity 625 of exploding fastener 621 further includes sealant 645 which secures the glass insulating body 643 in position within cavity 625 and which prevents moisture from entering cavity 625 and altering the reactive properties of power charge 639. Additionally, epoxy body 651 is included within cavity 625 in order to further seal and electrically isolate the power charge 639 and electrical conductors of electrical lead 647, 649. As is shown in FIG. 24, end piece 53 is provided in abutment with seal assembly 629.

Application of an electrical current to electrical lead 647 causes an electrical current to pass into exploding fastener 651, to energize heating element 641, causing it to generate heat in an amount which is sufficient to trigger the explosion of power charge 639. When power charge 639 explodes, exploding fastener 621 is fragmented along bolt body 623 between external threads 627 and seal assembly 629. Exploding fastener may be utilized in wellbore tools to secure in position a wellbore tool component which is engaged by external threads 627 of exploding fastener 621. For example, exploding fastener 621 may be utilized to secure a sliding or moving component, in order to restrain movement until a desired time. The sliding or moving component may be under load, so that fracturing or disintegration of exploding fastener 621 by the passage of electrical current into the fastener allows the piece or component to move in the direction of the force bias.

20. THE KEVLAR COUPLING END DEVICE

Figure 25:
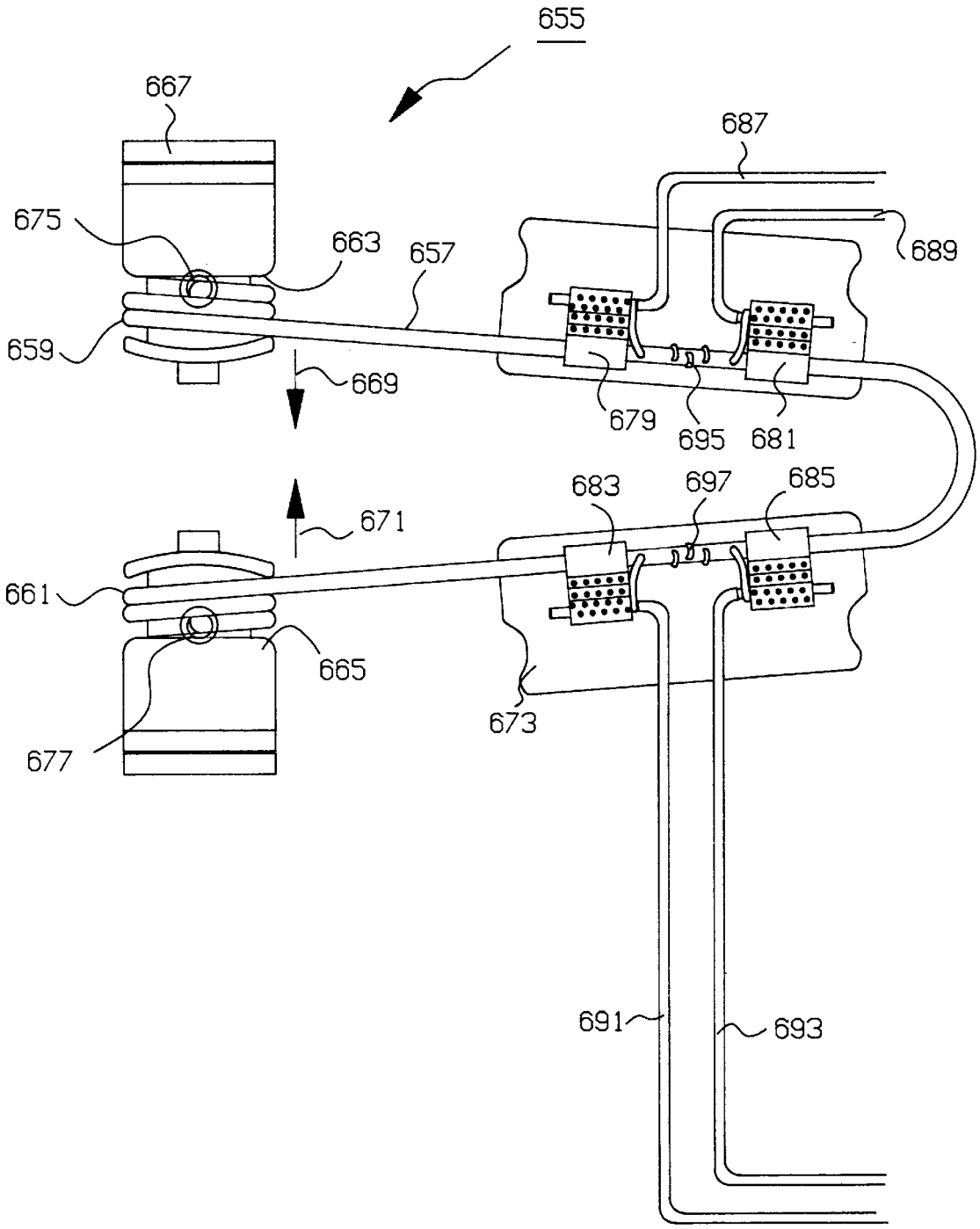
FIGS. 25, and 26 depict a Kevlar coupling end device which may be utilized with the remote control apparatus of the present invention.
Figure 26:
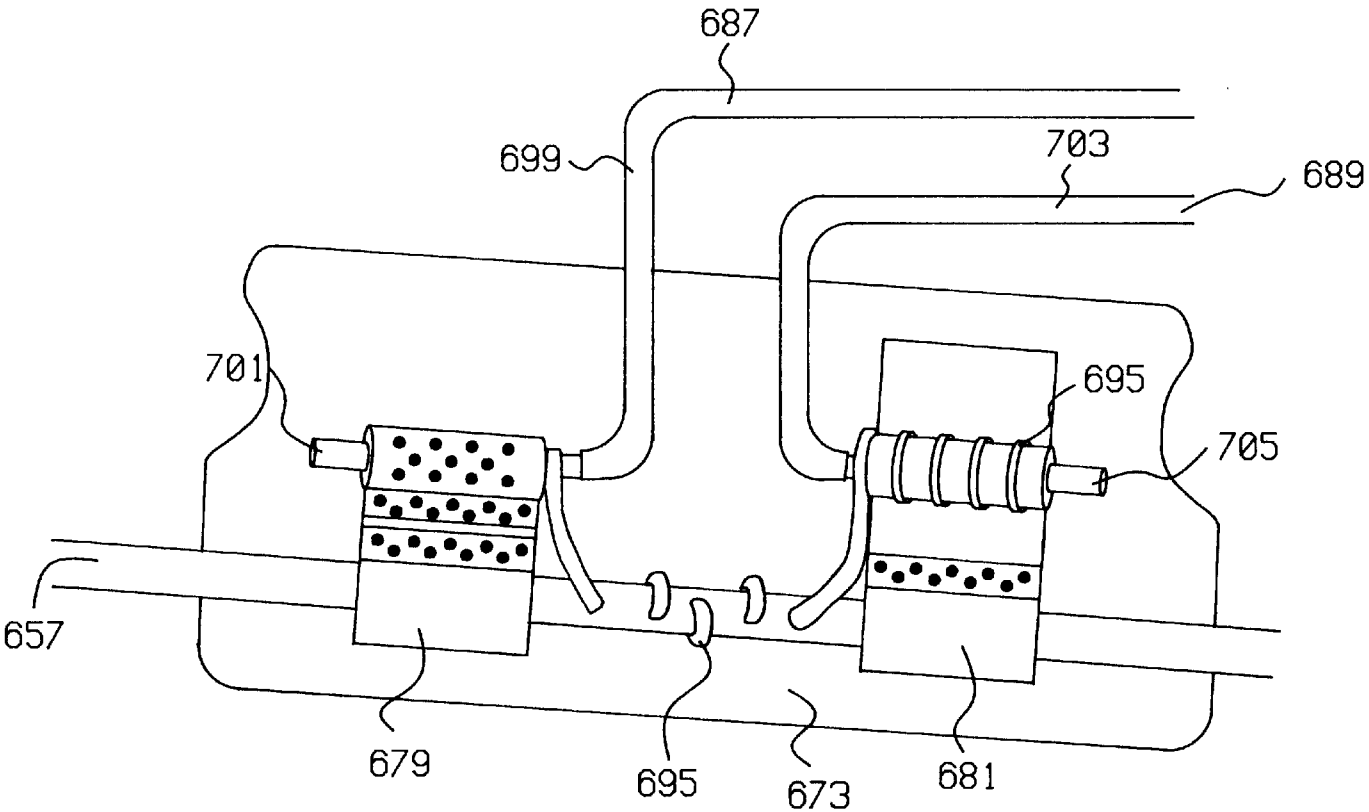

FIGS. 25, and 26 depict a Kevlar coupling end device which may be utilized with the remote control apparatus of the present invention. Kevlar coupling 655 includes Kevlar string 657 which is utilized to secure one or more otherwise-moveable mechanical components in a wellbore tool. In the particular embodiment depicted in FIG. 25, Kevlar string 657 is utilized to secure C-ring 667 (of which, only the end pieces are shown) in a tight, substantially closed position by applying force to C-ring 657 in the direction of force arrows 669, 671. Preferably, Kevlar string 657 is wrapped about turnbuckles 663, 665, with the ends of Kevlar string 657 passed through holes 675, 677. Kevlar string 657 is routed to, and secured in position relative to, anchor component 673, which may comprise a mandrel or other structural component which is fixed in position relative to C-ring 667. Kevlar string 657 is secured in position with to anchor component 673 by solder tabs 679, 681, 683, and 685. Electrical conductors 687, and 689 carry a current which passes through solder tabs 679, and 681, and a conductive, heat-generating wire 695 which is connected therebetween, and which is wrapped around and through Kevlar string 657 in the region intermediate solder tabs 679 and 681. Likewise, electrical conductors 691 and 693 which carry a current which passes through solder tabs 691 and 693 carry a current which passes through solder tabs 683 and 695 which passes through an electrical conductor which is connected therebetween and which is wrapped around and through Kevlar string 657 in the region intermediate solder tabs 683 and 685.

The details of the electrical and mechanical connection are best described with reference to FIG. 26, which is a detail view of solder tabs 679, 681, with solder tab 681 shown in an intermediate construction condition. As is shown, electrical conductor 687 includes an insulating sheath 699 and an internally disposed conductor 701 which is exposed at the end of electrical conductor 687. Electrical conductor 689 is likewise composed of an insulating sheath 703 disposed over a conductor 705. As is best depicted and described with reference to solder tab 681, the solder tab is secured to anchor member 673 in a manner which defines a pathway between solder tab 681 and anchor component 673 for passage of Kevlar string 657. The electrical conductor 705 is located in an intermediate position relative to the remaining portion of solder tab 681. A current-carrying heating element 695 is wrapped about electrical conductor 705 and threaded through and around the strands which make up Kevlar string 657. Solder tab 681 is then folded over the electrical conductor 705, and soldered into position to ensure a good mechanical and electrical connection at the junction of solder tab 681, electrical conductor 705, and current-carrying heating element 695.

In the preferred embodiment of the present invention, Kevlar string 659 comprises a multi-strand Kevlar 29 Aramid braided yarn, such as can be purchased from Western Fillaments, Inc. as Product No. 500KOR 12. Preferably the core diameter of the string is 0.057 inches, plus or minus 0.005 inches, with a break strength of five hundred pounds, plus or minus ten pounds. Preferably, the material retains ninety percent or more of its strength at temperatures up to 480° Fahrenheit. The fiber of Kevlar string 657 begins to decompose at 800° Fahrenheit when tested in accordance with ASTM D276-80. Preferably, the Kevlar strength has a zero strength at temperatures of 850° Fahrenheit or above.

Also, in the preferred embodiment of the present invention, the current-carrying heating element comprises three inches of nichrome wire, which can be purchased from California Fine Wire Company of Grover Beach, Calif, which is sold under the mark of "Stableohm 650", Material No. 100187 annealed 0.005 or 36AWG Wire, 26 Ohms per foot, plus or minus three percent ohms per foot, and sold under Part No. WVXMMN017.

Preferably, in the preferred embodiment of the present invention, a battery pack is constructed of nine staves, with each stave being composed of two three-volt Sanyo Lithium Cell Batteries (Model No. CR12600SE), connected in series to provide six volts. This should provide enough power for the microprocessor and other electrical and electronic components of the reception apparatus, as well as sufficient power to heat (and thus destroy) Kevlar string 657.

21. THE SLIDING SLEEVE END DEVICE

Figure 28A:
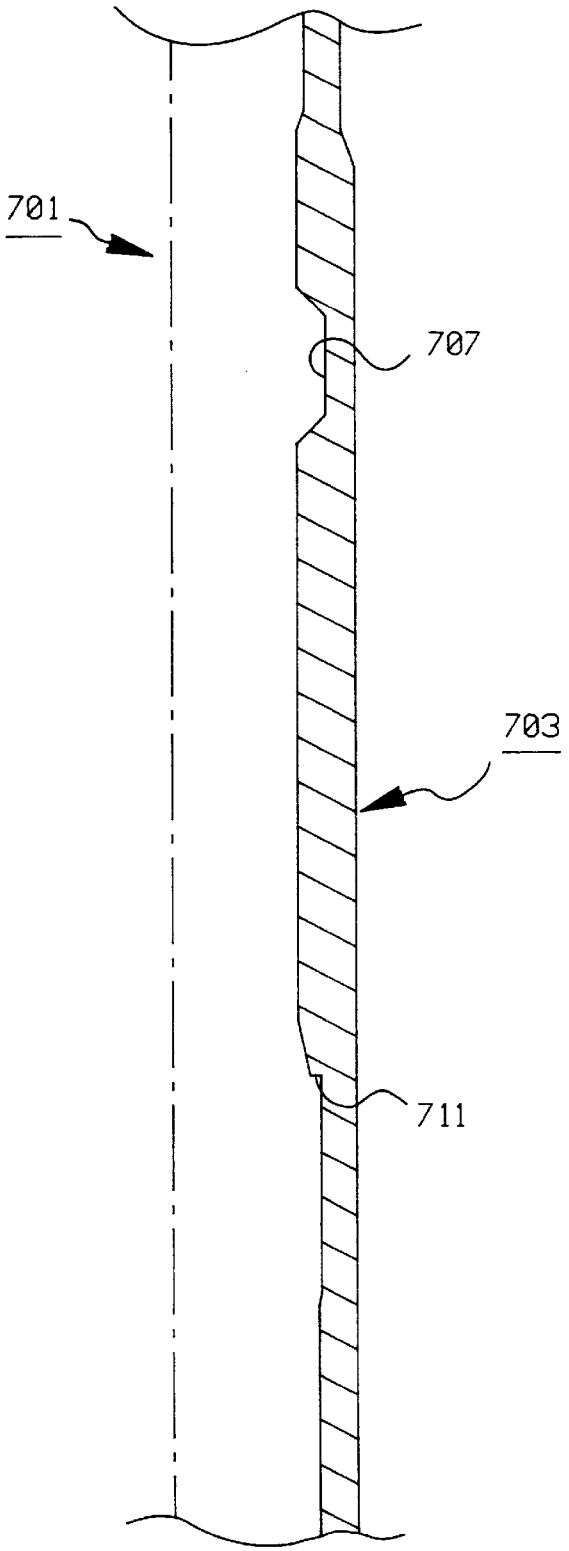
FIGS. 27A, 27B, 27C, 27D, 28A, 28B, 28C, and 28D depict a sliding sleeve valve end device.
Figure 27A:
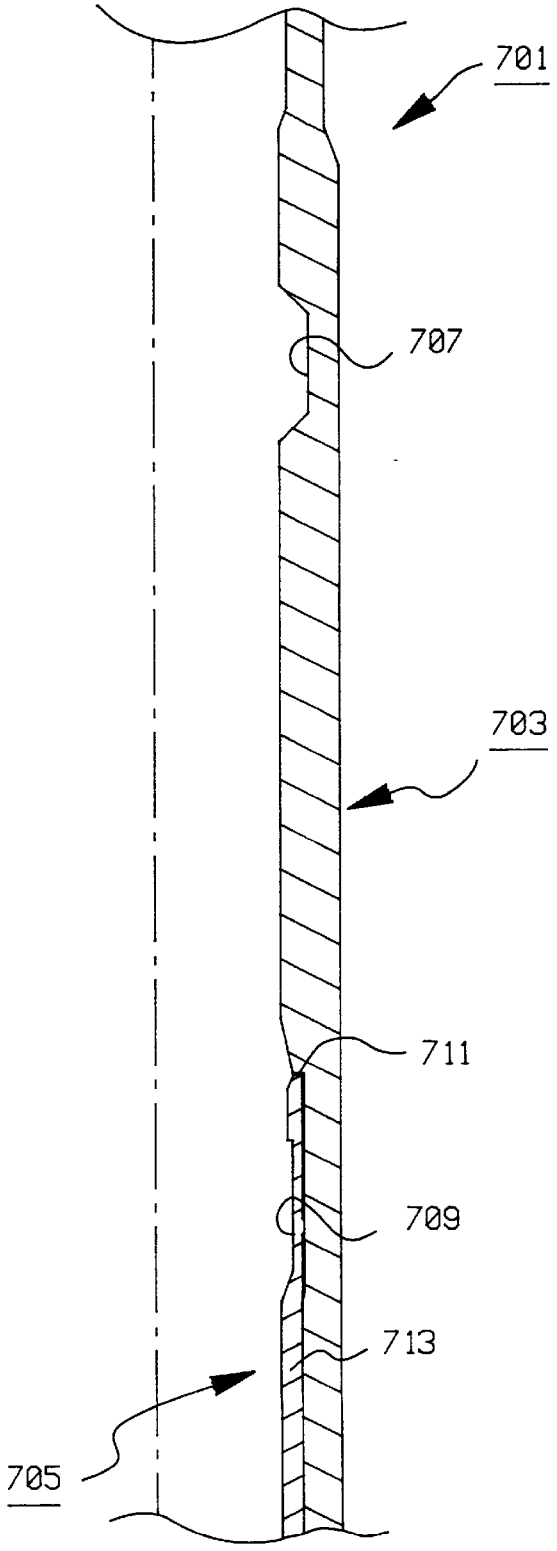

FIGS. 27A through 27D and FIGS. 28A through 28D are fragmentary longitudinal section views of a sliding sleeve valve insert which may be utilized in a completion string during completion operations to selectively allow communication between the central bore of the production tubing stream and the annulus defined between the production tubing string and the wellbore wall or casing. FIGS. 27A through 27D depict one preferred normally-open sliding sleeve valve in accordance with the present invention. FIGS. 28A through 28D depict the same valve in a closed condition. In accordance with the present invention, the sliding sleeve valve 701 includes threaded connections at its upper and lower ends, which are not depicted in the views of FIGS. 27A through 27D. Sliding sleeve valve 701 includes a stationary sleeve assembly 703 and a moveable sleeve assembly 705. In the views of FIGS. 27A and 28A, the stationary sleeve assembly 703 is shown as including nipple profile 707 which facilitates the retrieval of the valve assembly with conventional completion equipment. Additionally, stationary sleeve assembly 703 is shown as including sleeve stop 711 which serves to define the upper limit of travel for moveable sleeve assembly 705. When moveable sleeve assembly 705 is in its normally-opened condition, upper portion 713 is in abutment with sleeve stop 711. In the view of FIG. 27A, the upper portion 713 of moveable sleeve assembly 705 is shown as including latch profile 709 which is utilized to engage conventional completion tools to facilitate movement of moveable sleeve assembly 705 relative to stationary sleeve assembly 703 after the initial actuation of the sliding sleeve valve 701 (from a normally-opened condition to a closed condition). Latch profile 709 is thus defined as the "up-profile", since it facilitates engagement with a running tool to effect the upward movement of moveable sleeve assembly 705.

Figure 28B:
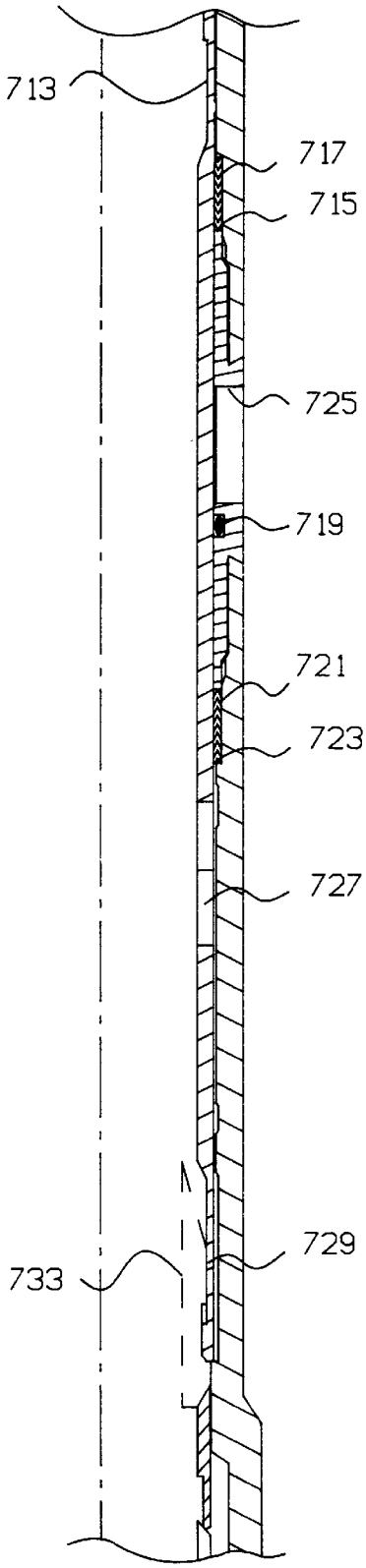
Figure 27B:
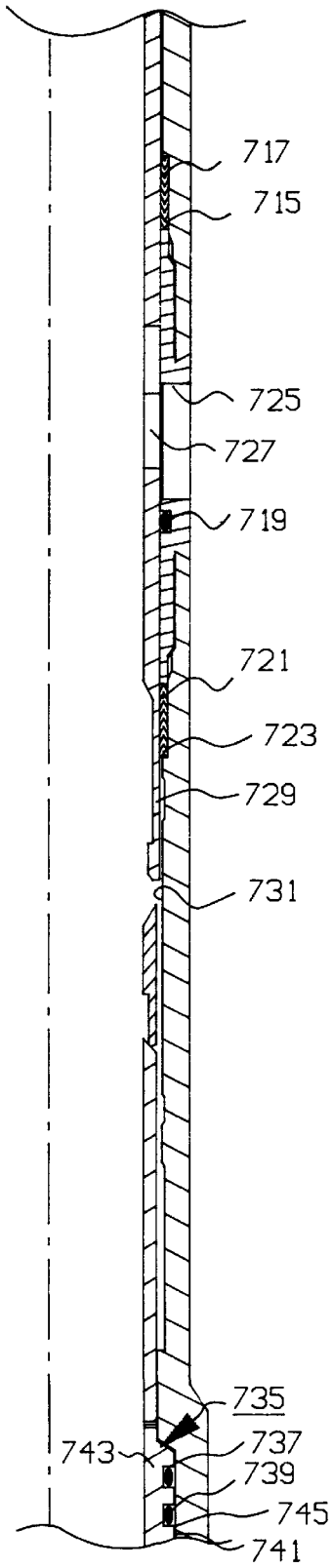

FIGS. 27B and 28B depict some conventional components of a seal assembly. The structure and various components of the present seal assembly is similar to that depicted, described, and claimed in U.S. Pat. No. 5,309,993, entitled "Chevron Seal For A Well Tool", which issued on May 10, 1994 to Coon et al., and which is incorporated herein by reference as if fully set forth. As is shown in FIGS. 27B and 28B, a seal gland 715 is defined by stationary sleeve assembly 703 and moveable sleeve assembly 705 in a position above flowports 725 and 727 in the stationary sleeve assembly 703 and moveable sleeve assembly 705. Likewise, a seal gland 721 is defined by stationary sleeve assembly 703 and moveable sleeve assembly 705 in a position below flowports 725, 727. Seal assembly 717 is disposed within seal gland 717, and seal assembly 723 is disposed within seal gland 721. Additionally, a cavity is defined beneath flowport 725 of stationary sleeve assembly 703 which receives a diffuser ring 719. All of these components are discussed and described in detail in the Coon et al. prior art reference. If the normally-open condition, flowports 725, 727 are aligned to allow the passage of fluid between the central bore of the sliding sleeve valve 701 and the annular region. As is shown in FIG. 28B, in the closed condition, sliding sleeve valve 701 allows flowport 727 to be positioned beneath seal 723, and thus out of fluid communication with flowport 725. As is shown in both FIGS. 27B and 28B, moveable sleeve assembly 705 includes latch profile 729 which is adapted for mating with conventional completing running tools, and which is especially suited for engagement with those running tools in order to move moveable sleeve assembly 705 downward relative to stationary sleeve assembly 703. In the view of FIG. 28B, a conventional latch 733 is depicted in phantom as engaging latch profile 729 which allows downward movement of moveable sleeve assembly 705. The connection between the latch and the latching profile breaks with the application of 7,000 pounds of force. An O-ring seal assembly 735 is disposed in the lowermost portion of FIG. 27B, and includes an enlarged portion which carries upper and lower O-ring seals 737, 739. The upper and lower O-ring seals 737, 739 are adapted to provide a moveable sealing engagement between enlarged head 723 and sliding surface 745. An atmospheric chamber 741 is defined downward from O-ring seal assembly 735. An electrical actuation of the sliding sleeve valve 701 causes the downward movement of sliding sleeve valve 731 in response to the pressure differential between the atmospheric chamber 741 and the ambient wellbore fluid.

Figure 27C:
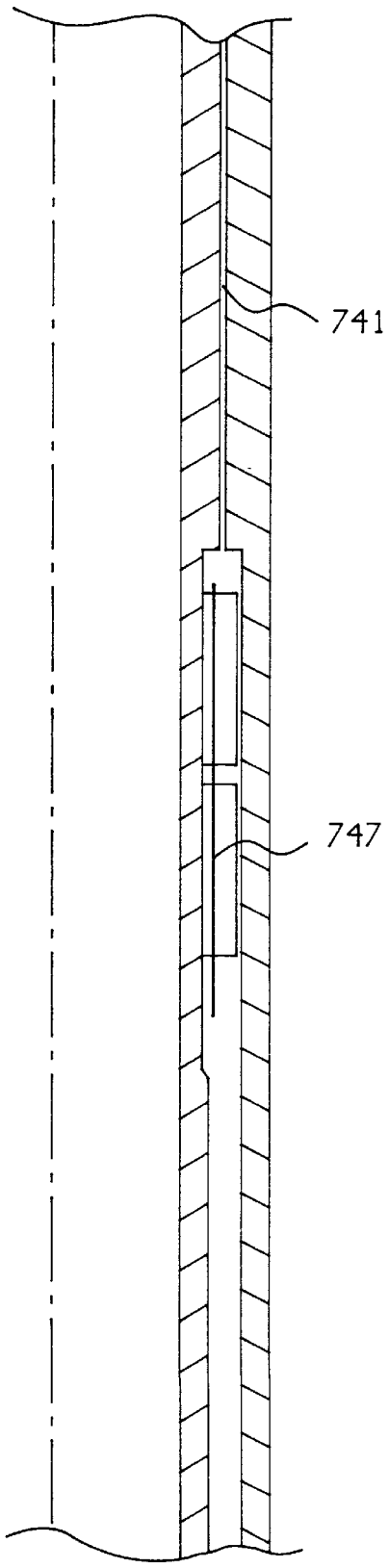
Figure 28D:
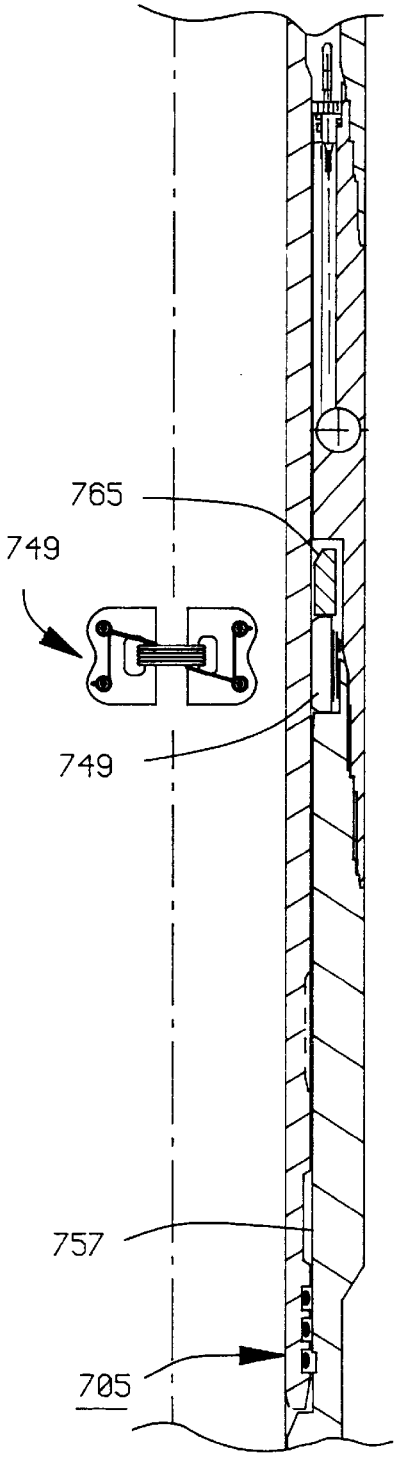
Figure 27D:
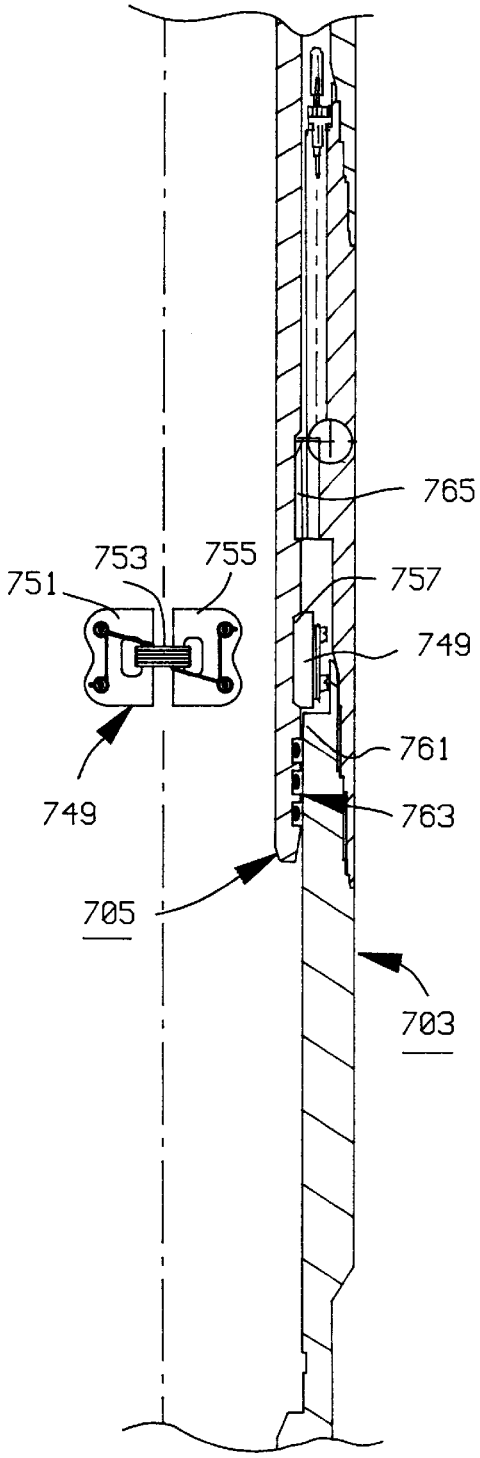

FIG. 27C depicts enlarged head 743 of O-ring seal assembly 735 in its resting condition after the sliding sleeve valve 701 is actuated for the first time between the normally-closed condition and the opened condition by application of an electrical current to a Kevlar coupling end device.

Figure 28C:
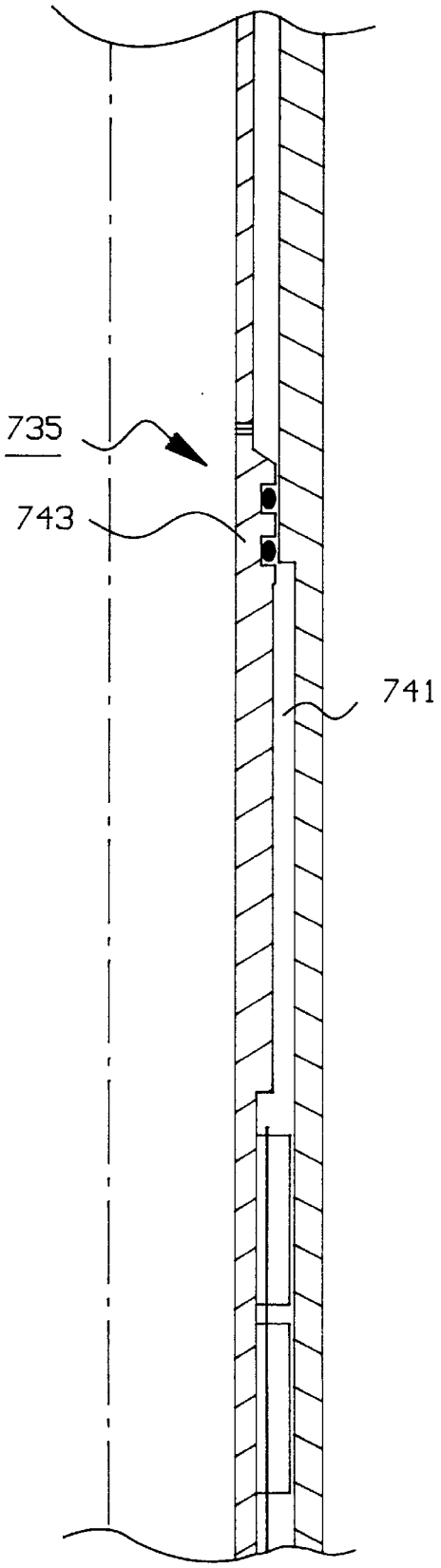

Continuing now with FIGS. 27C and 28C, it will be appreciated that the electronic circuit boards 747 which carry the sensor assembly, logic, microprocessor, and associated electrical and electronic components is located with atmospheric chamber 741 of sliding sleeve valve 701. When one or more acoustic transmissions having the one or more preprogrammed frequencies are detected by the sensors carried within atmospheric chamber 741, an electrical current is supplied to Kevlar coupling 749 of FIGS. 27D and 28D. Kevlar coupling 749 is shown in both plan and longitudinal section view in FIGS. 27D and 28D. As discussed above in considerable detail, Kevlar coupling 749 includes a Kevlar string 753 which secures the ends 751, 755 of a C-ring which fits in C-ring groove 757. Kevlar coupling 749 (including the C-ring) is in abutment with shoulder 761 of stationary sleeve assembly 703. O-ring seal assembly 763 is disposed below Kevlar coupling 749, and serves to provide a fluid-type sliding interface between moveable sleeve assembly 705 and stationary sleeve assembly 703. When an actuating current is provided to Kevlar string 753, it heats and disintegrates, allowing the C-ring to expand. This allows the pressure differential between atmospheric chamber 741 and the ambient pressure to drive moveable sleeve assembly 705 downward relative to stationary sleeve assembly 703, with Kevlar coupling 749 coming to rest in the position depicted in FIG. 28D. Key 765 (best depicted in FIGS. 28D) is provided adjacent to Kevlar coupling 749 in order to allow for the making and breaking of threaded connections in the drillstring. It serves to keep the assembly locked and resistant to rotation. As moveable sleeve assembly 705 moves downward relative to stationary sleeve assembly 703, Kevlar coupling 749 and key 65 remain in substantially the same location, while the groove 757 which housed Kevlar coupling 749 is moved downward with moveable sleeve assembly 705.

In the preferred embodiment of the present invention, once the electrically-actuated sliding sleeve valve 701 is moved from a normally-open condition to a closed condition, the valve may be moved repeatedly between open and closed conditions through utilization of a conventional running tool which latches with either the up latch or down latch in order to effect mechanical actuation of a sliding sleeve valve. it will be appreciated by those skilled in the art that the simplified depiction of FIGS. 27A through 28D omit a housing which surrounds these valve components, and that the insert portion of the valve alone is depicted in FIGS. 27A through 28D.

While the invention has been shown in only one of its forms, it is not thus limited but is susceptible to various changes and modifications without departing from the spirit thereof.

What is claimed is:

1. A method of controlling a remotely located wellbore tool between modes of operation, comprising:

providing (a) an electrically-actuable wellbore tool, (b) an acoustic transmission sensor, and (c) a digital circuit for continually examining during monitoring operations detected acoustic transmissions and providing a control signal if said acoustic transmission defines a plurality of sequentially transmitted acoustic transmission segments each defining a particular predetermined actuation frequency;

said digital circuit including:

(a) a detection circuit communicatively coupled to said acoustic transmission sensor for generating a pulse signal corresponding to each one of said acoustic transmissions;

(b) a counter circuit communicatively coupled to said detection circuit for counting said pulse signal; and (c) an enabling circuit for selectively enabling said counter circuit;

(d) wherein said detection circuit, said counter circuit, and said enabling circuit cooperatively operate to cause the generation of said control signal;

securing said electrically-actuable wellbore tool, said acoustic transmission sensor, and said digital circuit to a tubular conduit string;

lowering said tubular conduit string within said wellbore to a selected wellbore location;

providing a wellbore fluid column in contact with a portion of said tubular conduit but out of contact with said pressure sensor;

generating an acoustic transmission in said wellbore fluid column which defines said plurality of sequentially transmitted acoustic transmission segments each defining a particular predetermined frequency; and providing a control signal to said electrically-actuable wellbore tool when said digital circuit determines that said acoustic transmissions define said plurality of sequentially transmitted acoustic transmission segments each defining a particular predetermined frequency.

2. A method of controlling a remotely located wellbore tool according to claim 1, further comprising:

during monitoring operations, resetting said digital circuit if it is determined that detected acoustic transmissions define a frequency other than said plurality of particular predetermined actuation frequencies.

3. A method of communicating in a wellbore between a transmission node and a reception node, through a fluid column extending therebetween, comprising the method steps of:

providing a transmission apparatus at said transmission node which is in communication with said fluid column;

providing a reception apparatus at said reception node which includes:

(a) a sensor which detects acoustic pulses;

(b) an electronic circuit which examines said acoustic pulses one at a time to determine whether or not they correspond to at least one predefined actuation frequency;

utilizing said transmission apparatus to generate an acoustic transmission in said fluid column; and utilizing said reception apparatus to monitor said acoustic transmission to during predefined reception intervals associated with said at least one predefined actuation frequency (1) provide an actuation signal if said acoustic transmission is determined to correspond to said at least one actuation frequency and (2)

reset said electronic circuit if said acoustic transmission is determined to define some frequency other than said at least one predefined actuation frequency.

4. A method of communicating in a wellbore, according to claim 3 wherein said electronic circuit includes:

(a) a pulse counter circuit component; and (b) an enabler member for enabling said pulse counter in a timing pattern corresponding to said at least one predefined actuation frequency which determines said predefined reception Intervals.

5. A method of communicating in a wellbore, according to claim 3, wherein during said step of utilizing said reception apparatus, said electronic circuit is automatically reset if an expected pulse is not detected in said predefined reception intervals.

6. A method of switching a remotely located wellbore tool between modes of operation, comprising:

providing (a) an electrically-actuable wellbore tool, (b) an acoustic pulse detection sensor, and (c) a frequency determination circuit;

programming said frequency determination circuit to provide an actuation signal to said electrically-actuable wellbore tool in response to a detection of a particular plurality of sequential acoustic transmission frequencies;

securing said electrically-actuable wellbore tool, said acoustic pulse detection sensor, and said frequency determination circuit to a tubular conduit string;

lowering said tubular conduit string within said wellbore to a selected wellbore location;

providing a wellbore fluid column in contact with a portion of said tubular conduit but out of contact with said acoustic pulse detection sensor;

generating a plurality of acoustic pulse transmissions in said wellbore fluid column;

utilizing said frequency determination circuit to switch said electrically-actuable wellbore tool between modes of operation, when it is determined that said acoustic transmissions match said particular plurality of sequential acoustic transmission frequencies; and resetting said frequency determination circuit if it is determined that a detection acoustic pulse transmission corresponds to frequencies other than said particular plurality of sequential acoustic transmission.

7. A method of controlling a remotely located wellbore tool between modes of operation, comprising:

providing (a) an electrically-actuable wellbore tool, (b) an acoustic transmission sensor, (c) a digital circuit for continually examining during monitoring operations detected acoustic transmissions and providing a control signal if said acoustic transmission defines at least one predetermined actuation frequency, and (d) an assignment member for assigning said at least one predetermined actuation frequency to said digital circuit;

said digital circuit including:

(a) a detection circuit communicatively coupled to said acoustic transmission sensor for generating a pulse signal corresponding to each one of said acoustic transmissions;

(b) a counter circuit communicatively coupled to said detection circuit for counting said pulse signal; and (c) an enabling circuit for selectively enabling said counter circuit;

(d) wherein said detection circuit, said counter circuit, and said enabling circuit cooperatively operate to cause the generation of said control signal;

assigning said at least one predetermined actuation frequency to said digital circuit;

securing said electrically-actuable wellbore tool, said acoustic transmission sensor, and said digital circuit to a tubular conduit string;

lowering said tubular conduit string within said wellbore to a selected wellbore location;

providing a wellbore fluid column in contact with a portion of said tubular conduit;

generating an acoustic transmission in said wellbore fluid column which defines said at least one predetermined actuation frequency; and providing a control signal to said electrically-actuable wellbore tool when said digital circuit determines that said acoustic transmission defines said at least one predetermined actuation frequency.

8. A method of controlling a remotely located wellbore tool, according to claim 7, wherein:

said at least one predetermined actuation frequency is defined by a plurality of consecutively generated acoustic transmission segments, each defining a particular frequency.

9. A method of controlling a remotely located wellbore tool according to claim 8, wherein said step of providing a control signal comprises:

providing a control signal to said electrically-actuable wellbore tool when said digital circuit determines that said plurality of consecutively generated acoustic transmissions define said at least one predetermined actuation frequency.

10. A method of controlling a remotely located wellbore tool according to claim 7, further comprising:

during monitoring operations, resetting said digital circuit if it is determined that detected acoustic transmissions define a frequency other than said at least one predetermined actuation frequency.

11. A method of controlling a remotely located wellbore tool, according to claim 7, wherein said means for assigning comprises a means for assigning said at least one predetermined actuation frequency to said digital circuit comprises:

means for assigning at least one discrete predetermined actuation frequency from a set of available discrete predetermined actuation frequencies to said digital circuit.

12. A method of controlling a remotely located wellbore tool according to claim 11, wherein said means for assigning includes a programmable controller.

13. A method of controlling a remotely located wellbore tool according to claim 11, wherein:

during said step of assigning, at least an operator-selected one of said set of available discrete predetermined actuation frequencies is assigned to said digital circuit, and is thus identified to said electrically-actuable wellbore tool.

14. An apparatus for communicating a control signal in a wellbore between a transmission node and a reception node, through a fluid column extending therebetween, comprising:

a transmission apparatus at said transmission node which is in communication with said fluid column, for generating an acoustic transmission having at least one acoustic transmission frequency;

a reception apparatus at said reception node which includes: (a) an electrically-actuable wellbore tool, (b) an acoustic transmission sensor, and (c) a digital circuit for continually examining during monitoring operations detected acoustic transmissions and providing a control signal if said acoustic transmission define at least one particular actuation frequency;

wherein, during a communication mode of operation:

(a) said transmission apparatus is utilized to generate said acoustic transmission; and (b) said reception apparatus is utilized to detect said acoustic transmission in said fluid column;

a reception minimizer for minimizing reception sensitivity of said reception apparatus in a predefined manner by enabling a pulse counting circuit at predetermined times corresponding to at least one particular actuation frequency.

15. An apparatus for communicating a control signal according to claim 14, wherein said reception minimizer comprises:

reception minimizer for minimizing reception sensitivity of said reception apparatus by disabling at least a portion of said digital circuit for at least one predefined interval during monitoring operations.

16. An apparatus for communicating a control signal, according to claim 15, wherein said at least one predefined interval comprises:

a predefined time interval after detection of a pulse of said acoustic transmission which is detected in a time interval consistent with said at least one particular actuation frequency.

17. An apparatus for communicating a control signal, according to claim 16, wherein said predefined time interval is of a duration sufficient to prevent detection of echo signals associated with each pulse of said acoustic transmission.

18. A method of communicating in a wellbore between a transmission node and a reception node, through a fluid column extending therebetween, comprising the method steps of:

providing a transmission apparatus at said transmission node which is in communication with said fluid column including a controller for automatically generating at least one sequence of acoustic pulses which define at least one predefined actuation frequency;

providing a reception apparatus at said reception node which includes:

(a) a sensor means which detects acoustic pulses;

(b) means for examining said acoustic pulses one at a time with a pulse counting circuit to determine whether or not they correspond to said at least one predefined actuation frequency;

utilizing said transmission apparatus to generate an acoustic transmission in said fluid column; and utilizing said reception apparatus to monitor said acoustic transmission to provide an actuation signal if said acoustic transmission is determined to correspond to said at least one predefined actuation frequency.

19. A method of communicating in a wellbore, according to claim 18 wherein said transmission apparatus includes:

(a) a valve assembly for applying a high velocity fluid slug into said fluid column;

(b) a programmable controller for actuating said valve assembly.

20. A method of switching a remotely located wellbore tool between modes of operation, comprising:

providing (a) an electrically-actuable wellbore tool, (b) an acoustic pulse detection sensor, and (c) a frequency determination circuit including a digital counter and a counter enabling circuit;

programming said frequency determination circuit to provide an actuation signal to said electrically-actuable wellbore tool in response to a detection of a particular acoustic transmission frequency;

securing said electrically-actuable wellbore tool, said acoustic pulse detection sensor, and said frequency determination circuit to a tubular conduit string;

lowering said tubular conduit string within said wellbore to a selected wellbore location;

providing a wellbore fluid column in contact with a portion of said tubular conduit;

providing a computer-controlled valve assembly;

generating an acoustic pulse transmission in said wellbore fluid column utilizing said computer-controlled valve assembly; and utilizing said counter enabling circuit to enable said digital counter of said frequency determination circuit to switch said electrically-actuable wellbore tool between modes of operation, when it is determined that said acoustic transmission matches said particular acoustic transmission frequency.

* * * * *